US006297788B1

(12) United States Patent
Shigeta et al.

(10) Patent No.: US 6,297,788 B1
(45) Date of Patent: Oct. 2, 2001

(54) HALF TONE DISPLAY METHOD OF DISPLAY PANEL

(75) Inventors: Tetsuya Shigeta; Nobuhiko Saegusa; Hirofumi Honda, all of Yamanashi (JP)

(73) Assignee: Pioneer Electronic Corporation, Tokyo (JP)

( * ) Notice: Subject to any disclaimer, the term of this patent is extended or adjusted under 35 U.S.C. 154(b) by 0 days.

(21) Appl. No.: 09/107,996

(22) Filed: Jun. 30, 1998

(30) Foreign Application Priority Data

Jul. 2, 1997 (JP) ..... 9-177388
May 11, 1998 (JP) ..... 10-127898

(51) Int. Cl.[7] ..... G09G 3/28

(52) U.S. Cl. ..... 345/63; 345/63; 345/67; 345/589

(58) Field of Search ..... 345/60–68, 204, 345/147, 149, 432, 589; 315/169.1–169.4; 348/671

(56) References Cited

U.S. PATENT DOCUMENTS 5,854,540 * 12/1998 Matsumoto et al. ..... 315/169.1
5,874,932 * 2/1999 Nagaoka et al. ..... 345/60
5,907,316 * 5/1999 Mikoshiba et al. ..... 345/147
5,940,142 * 8/1999 Wakitani et al. ..... 348/671
6,040,819 * 3/2000 Someya ..... 345/147
6,052,101 * 12/1998 Moon ..... 345/55
6,069,610 * 2/1999 Denda et al. ..... 345/149

* cited by examiner

*Primary Examiner*—Dennis-Doon Chow
*Assistant Examiner*—Amr Awad
(74) *Attorney, Agent, or Firm*—Morgan, Lewis & Bockius LLP

(57) ABSTRACT

A half tone display method of a display panel which can prevent the generation of a pseudo outline and can improve a contrast and a display picture quality. In the driving operation to cause light emission of the display panel having a plurality of row electrodes arranged in the horizontal direction corresponding to display lines and a plurality of column electrodes which are arranged in the vertical direction which perpendicularly crosses the row electrodes and form discharge cells at crossing points, a unit display period is divided into a plurality of divided periods and a plurality of light emitting modes in which the orders of light emitting periods which are allocated to each of the divided periods are made different are switched and executed every discharge cell or every discharge cell block in which a plurality of adjacent discharge cells form one set.

28 Claims, 55 Drawing Sheets

FIG. 3

| HALF TONE LEVEL | INPUT PIXEL DATA | 1ST CONVERSION TABLE | | | | | | 2ND CONVERSION TABLE | | | | | |
|---|---|---|---|---|---|---|---|---|---|---|---|---|---|
| | | CONVERSION PIXEL DATA A | | | | | | CONVERSION PIXEL DATA B | | | | | |
| | 654321 | 6 | 5 | 4 | 3 | 2 | 1 | 6 | 5 | 4 | 3 | 2 | 1 |
| 00 | 000000 | 0 | 0 | 0 | 0 | 0 | 0 | 0 | 0 | 0 | 0 | 0 | 0 |
| 01 | 000001 | 1 | 0 | 0 | 0 | 0 | 0 | 0 | 0 | 0 | 0 | 0 | 1 |
| 02 | 000010 | 0 | 0 | 0 | 0 | 0 | 1 | 1 | 0 | 0 | 0 | 0 | 0 |
| 03 | 000011 | 1 | 0 | 0 | 0 | 0 | 1 | 1 | 0 | 0 | 0 | 0 | 1 |
| 04 | 000100 | 0 | 1 | 0 | 0 | 0 | 0 | 0 | 0 | 0 | 0 | 1 | 0 |
| 05 | 000101 | 1 | 1 | 0 | 0 | 0 | 0 | 0 | 0 | 0 | 0 | 1 | 1 |
| 06 | 000110 | 0 | 1 | 0 | 0 | 0 | 1 | 1 | 0 | 0 | 0 | 1 | 0 |
| 07 | 000111 | 1 | 1 | 0 | 0 | 0 | 1 | 1 | 0 | 0 | 0 | 1 | 1 |
| 08 | 001000 | 0 | 0 | 0 | 0 | 1 | 0 | 0 | 1 | 0 | 0 | 0 | 0 |
| 09 | 001001 | 1 | 0 | 0 | 0 | 1 | 0 | 0 | 1 | 0 | 0 | 0 | 1 |
| 10 | 001010 | 0 | 0 | 0 | 0 | 1 | 1 | 1 | 1 | 0 | 0 | 0 | 0 |
| 11 | 001011 | 1 | 0 | 0 | 0 | 1 | 1 | 1 | 1 | 0 | 0 | 0 | 1 |
| 12 | 001100 | 0 | 1 | 0 | 0 | 1 | 0 | 0 | 1 | 0 | 0 | 1 | 0 |
| 13 | 001101 | 1 | 1 | 0 | 0 | 1 | 0 | 0 | 1 | 0 | 0 | 1 | 1 |
| 14 | 001110 | 0 | 1 | 0 | 0 | 1 | 1 | 1 | 1 | 0 | 0 | 1 | 0 |
| 15 | 001111 | 1 | 1 | 0 | 0 | 1 | 1 | 1 | 1 | 0 | 0 | 1 | 1 |
| 16 | 010000 | 0 | 0 | 1 | 0 | 0 | 0 | 0 | 0 | 0 | 1 | 0 | 0 |
| 17 | 010001 | 1 | 0 | 1 | 0 | 0 | 0 | 0 | 0 | 0 | 1 | 0 | 1 |
| 18 | 010010 | 0 | 0 | 1 | 0 | 0 | 1 | 1 | 0 | 0 | 1 | 0 | 0 |
| 19 | 010011 | 1 | 0 | 1 | 0 | 0 | 1 | 1 | 0 | 0 | 1 | 0 | 1 |
| 20 | 010100 | 0 | 1 | 1 | 0 | 0 | 0 | 0 | 0 | 0 | 1 | 1 | 0 |
| 21 | 010101 | 1 | 1 | 1 | 0 | 0 | 0 | 0 | 0 | 0 | 1 | 1 | 1 |
| 22 | 010110 | 0 | 1 | 1 | 0 | 0 | 1 | 1 | 0 | 0 | 1 | 1 | 0 |
| 23 | 010111 | 1 | 1 | 1 | 0 | 0 | 1 | 1 | 0 | 0 | 1 | 1 | 1 |
| 24 | 011000 | 0 | 0 | 1 | 0 | 1 | 0 | 0 | 1 | 0 | 1 | 0 | 0 |
| 25 | 011001 | 1 | 0 | 1 | 0 | 1 | 0 | 0 | 1 | 0 | 1 | 0 | 1 |
| 26 | 011010 | 0 | 0 | 1 | 0 | 1 | 1 | 1 | 1 | 0 | 1 | 0 | 0 |
| 27 | 011011 | 1 | 0 | 1 | 0 | 1 | 1 | 1 | 1 | 0 | 1 | 0 | 1 |
| 28 | 011100 | 0 | 1 | 1 | 0 | 1 | 0 | 0 | 1 | 0 | 1 | 1 | 0 |
| 29 | 011101 | 1 | 1 | 1 | 0 | 1 | 0 | 0 | 1 | 0 | 1 | 1 | 1 |
| 30 | 011110 | 0 | 1 | 1 | 0 | 1 | 1 | 1 | 1 | 0 | 1 | 1 | 0 |
| 31 | 011111 | 1 | 1 | 1 | 0 | 1 | 1 | 1 | 1 | 0 | 1 | 1 | 1 |

FIG. 4

| HALF TONE LEVEL | INPUT PIXEL DATA | 1ST CONVERSION TABLE | | | | | | 2ND CONVERSION TABLE | | | | | |
|---|---|---|---|---|---|---|---|---|---|---|---|---|---|
| | | CONVERSION PIXEL DATA A | | | | | | CONVERSION PIXEL DATA B | | | | | |
| | 654321 | 6 | 5 | 4 | 3 | 2 | 1 | 6 | 5 | 4 | 3 | 2 | 1 |
| 32 | 100000 | 0 | 0 | 0 | 1 | 0 | 0 | 0 | 0 | 1 | 0 | 0 | 0 |
| 33 | 100001 | 1 | 0 | 0 | 1 | 0 | 0 | 0 | 0 | 1 | 0 | 0 | 1 |
| 34 | 100010 | 0 | 0 | 0 | 1 | 0 | 1 | 1 | 0 | 1 | 0 | 0 | 0 |
| 35 | 100011 | 1 | 0 | 0 | 1 | 0 | 1 | 1 | 0 | 1 | 0 | 0 | 1 |
| 36 | 100100 | 0 | 1 | 0 | 1 | 0 | 0 | 0 | 0 | 1 | 0 | 1 | 0 |
| 37 | 100101 | 1 | 1 | 0 | 1 | 0 | 0 | 0 | 0 | 1 | 0 | 1 | 1 |
| 38 | 100110 | 0 | 1 | 0 | 1 | 0 | 1 | 1 | 0 | 1 | 0 | 1 | 0 |
| 39 | 100111 | 1 | 1 | 0 | 1 | 0 | 1 | 1 | 0 | 1 | 0 | 1 | 1 |
| 40 | 101000 | 0 | 0 | 0 | 1 | 1 | 0 | 0 | 1 | 1 | 0 | 0 | 0 |
| 41 | 101001 | 1 | 0 | 0 | 1 | 1 | 0 | 0 | 1 | 1 | 0 | 0 | 1 |
| 42 | 101010 | 0 | 0 | 0 | 1 | 1 | 1 | 1 | 1 | 1 | 0 | 0 | 0 |
| 43 | 101011 | 1 | 0 | 0 | 1 | 1 | 1 | 1 | 1 | 1 | 0 | 0 | 1 |
| 44 | 101100 | 0 | 1 | 0 | 1 | 1 | 0 | 0 | 1 | 1 | 0 | 1 | 0 |
| 45 | 101101 | 1 | 1 | 0 | 1 | 1 | 0 | 0 | 1 | 1 | 0 | 1 | 1 |
| 46 | 101110 | 0 | 1 | 0 | 1 | 1 | 1 | 1 | 1 | 1 | 0 | 1 | 0 |
| 47 | 101111 | 1 | 1 | 0 | 1 | 1 | 1 | 1 | 1 | 1 | 0 | 1 | 1 |
| 48 | 110000 | 0 | 0 | 1 | 1 | 0 | 0 | 0 | 0 | 1 | 1 | 0 | 0 |
| 49 | 110001 | 1 | 0 | 1 | 1 | 0 | 0 | 0 | 0 | 1 | 1 | 0 | 1 |
| 50 | 110010 | 0 | 0 | 1 | 1 | 0 | 1 | 1 | 0 | 1 | 1 | 0 | 0 |
| 51 | 110011 | 1 | 0 | 1 | 1 | 0 | 1 | 1 | 0 | 1 | 1 | 0 | 1 |
| 52 | 110100 | 0 | 1 | 1 | 1 | 0 | 0 | 0 | 0 | 1 | 1 | 1 | 0 |
| 53 | 110101 | 1 | 1 | 1 | 1 | 0 | 0 | 0 | 0 | 1 | 1 | 1 | 1 |
| 54 | 110110 | 0 | 1 | 1 | 1 | 0 | 1 | 1 | 0 | 1 | 1 | 1 | 0 |
| 55 | 110111 | 1 | 1 | 1 | 1 | 0 | 1 | 1 | 0 | 1 | 1 | 1 | 1 |
| 56 | 111000 | 0 | 0 | 1 | 1 | 1 | 0 | 0 | 1 | 1 | 1 | 0 | 0 |
| 57 | 111001 | 1 | 0 | 1 | 1 | 1 | 0 | 0 | 1 | 1 | 1 | 0 | 1 |
| 58 | 111010 | 0 | 0 | 1 | 1 | 1 | 1 | 1 | 1 | 1 | 1 | 0 | 0 |
| 59 | 111011 | 1 | 0 | 1 | 1 | 1 | 1 | 1 | 1 | 1 | 1 | 0 | 1 |
| 60 | 111100 | 0 | 1 | 1 | 1 | 1 | 0 | 0 | 1 | 1 | 1 | 1 | 0 |
| 61 | 111101 | 1 | 1 | 1 | 1 | 1 | 0 | 0 | 1 | 1 | 1 | 1 | 1 |
| 62 | 111110 | 0 | 1 | 1 | 1 | 1 | 1 | 1 | 1 | 1 | 1 | 1 | 0 |
| 63 | 111111 | 1 | 1 | 1 | 1 | 1 | 1 | 1 | 1 | 1 | 1 | 1 | 1 |

DIVIDING PERIOD

COLUMN ELECTRODE D1~m

ROW ELECTRODE X1~n

ROW ELECTRODE Y1

ROW ELECTRODE Y2

ROW ELECTRODE Y3

ROW ELECTRODE Yn

DP1~m
APEV
APOD
IPx
RPx
RPY
IPY
SP
EP
ta
RESET (R)
ADDRESS (AD)
1ST SUSTAIN DISCHAGE (I1)
SELECTIVE ALL ERASE (S)
2ND SUSTAIN DISCHAGE (I2)
ALL ERASE

1ST FIELD
FIG.10A PIXEL DATA
D11
D12
D13
D14
D1m
D31
D32
FIG.10B CK2
FIG.10C DITHER COEFFICIENT
DITHER PATTERN
a
c
b
d
a
c
b
d
FIG.10D DITHER ADDITION PIXEL DATA
D11+a
D11+c
D12+b
D12+d
D13+a
D13+c
D14+b
D14+d
FIG.10E DITHER PROCESSING PIXEL DATA Z
Z(D11+a)
Z(D11+c)
Z(D12+b)
Z(D12+d)
Z(D13+a)
Z(D13+c)
Z(D14+b)
Z(D14+d)
FIG.10F SELECTION SIGNAL
FIG.10G OUTPUT OF SELECTOR 32
AZ(D11+a)
BZ(D11+c)
BZ(D12+b)
AZ(D12+d)

2ND FIELD
FIG.11A PIXEL DATA
D21
D22
D23
D24
D2m
D41
D42
FIG.11B CK2
FIG.11C DITHER COEFFICIENT
DITHER PATTERN
d b c a d b c a
FIG.11D DITHER ADDITION PIXEL DATA
D21+d D21+b D22+c D22+a D23+d D23+b D24+c D24+a
FIG.11E DITHER PROCESSING PIXEL DATA Z
Z(D21+d) Z(D22+b) Z(D22+c) Z(D22+a) Z(D23+d) Z(D23+b) Z(D24+c) Z(D24+a)
FIG.11F SELECTION SIGNAL
FIG.11G OUTPUT OF SELECTOR 32
AZ(D21+d)
BZ(D21+b)
BZ(D22+c)
AZ(D22+a)

3RD FIELD
FIG.12A PIXEL DATA
D11
D12
D13
D14
D1m
D31
D32
FIG.12B CK2
FIG.12C DITHER COEFFICIENT
DITHER PATTERN
d b c a d b c a
FIG.12D DITHER ADDITION PIXEL DATA
D11+d D11+b D12+c D12+a D13+d D13+b D14+c D14+a
FIG.12E DITHER PROCESSING PIXEL DATA Z
Z(D11+d) Z(D11+b) Z(D12+c) Z(D12+a) Z(D13+d) Z(D13+b) Z(D14+c) Z(D14+a)
FIG.12F SELECTION SIGNAL
FIG.12G OUTPUT OF SELECTOR 32
AZ(D11+d)
BZ(D11+b)
BZ(D12+c)
AZ(D12+a)

4TH FIELD
FIG.13A PIXEL DATA
D21
D22
D23
D24
D2m
D41
D42
FIG.13B CK2
FIG.13C DITHER COEFFICIENT
DITHER PATTERN
a
c
b
d
a
c
b
d
FIG.13D DITHER ADDITION PIXEL DATA
D21+a
D21+c
D22+b
D22+d
D23+a
D23+c
D24+b
D24+d
FIG.13E DITHER PROCESSING PIXEL DATA Z
Z(D21+a)
Z(D21+c)
Z(D22+b)
Z(D22+d)
Z(D23+a)
Z(D23+c)
Z(D24+b)
Z(D24+d)
FIG.13F SELECTION SIGNAL
FIG.13G OUTPUT OF SELECTOR 32
AZ(D21+a)
BZ(D21+c)
BZ(D22+b)
AZ(D22+d)

1ST FIELD

2ND FIELD

3RD FIELD

4TH FIELD

FIG.17

| HALF TONE LEVEL | INPUT PIXEL DATA | 1ST CONVERSION TABLE | | | | | | | | 2ND CONVERSION TABLE | | | | | | | |
|---|---|---|---|---|---|---|---|---|---|---|---|---|---|---|---|---|---|
| | | CONVERSION PIXEL DATA A | | | | | | | | CONVERSION PIXEL DATA B | | | | | | | |
| | 654321 | 8 | 7 | 6 | 5 | 4 | 3 | 2 | 1 | 8 | 7 | 6 | 5 | 4 | 3 | 2 | 1 |
| 00 | 000000 | 0 | 0 | 0 | 0 | 0 | 0 | 0 | 0 | 0 | 0 | 0 | 0 | 0 | 0 | 0 | 0 |
| 01 | 000001 | 0 | 0 | 0 | 0 | 0 | 1 | 0 | 0 | 0 | 0 | 1 | 0 | 0 | 0 | 0 | 0 |
| 02 | 000010 | 0 | 0 | 1 | 0 | 0 | 0 | 0 | 0 | 0 | 0 | 0 | 0 | 0 | 1 | 0 | 0 |
| 03 | 000011 | 0 | 0 | 1 | 0 | 0 | 1 | 0 | 0 | 0 | 0 | 1 | 0 | 0 | 1 | 0 | 0 |
| 04 | 000100 | 0 | 0 | 0 | 0 | 1 | 0 | 0 | 0 | 0 | 0 | 0 | 1 | 0 | 0 | 0 | 0 |
| 05 | 000101 | 0 | 0 | 0 | 0 | 1 | 1 | 0 | 0 | 0 | 0 | 1 | 1 | 0 | 0 | 0 | 0 |
| 06 | 000110 | 0 | 0 | 1 | 0 | 1 | 0 | 0 | 0 | 0 | 0 | 0 | 1 | 0 | 1 | 0 | 0 |
| 07 | 000111 | 0 | 0 | 1 | 0 | 1 | 1 | 0 | 0 | 0 | 0 | 1 | 1 | 0 | 1 | 0 | 0 |
| 08 | 001000 | 0 | 0 | 0 | 1 | 0 | 0 | 0 | 0 | 0 | 0 | 0 | 0 | 1 | 0 | 0 | 0 |
| 09 | 001001 | 0 | 0 | 0 | 1 | 0 | 1 | 0 | 0 | 0 | 0 | 1 | 0 | 1 | 0 | 0 | 0 |
| 10 | 001010 | 0 | 0 | 1 | 1 | 0 | 0 | 0 | 0 | 0 | 0 | 0 | 0 | 1 | 1 | 0 | 0 |
| 11 | 001011 | 0 | 0 | 1 | 1 | 0 | 1 | 0 | 0 | 0 | 0 | 1 | 0 | 1 | 1 | 0 | 0 |
| 12 | 001100 | 0 | 0 | 0 | 1 | 1 | 0 | 0 | 0 | 0 | 0 | 0 | 1 | 1 | 0 | 0 | 0 |
| 13 | 001101 | 0 | 0 | 0 | 1 | 1 | 1 | 0 | 0 | 0 | 0 | 1 | 1 | 1 | 0 | 0 | 0 |
| 14 | 001110 | 0 | 0 | 1 | 1 | 1 | 0 | 0 | 0 | 0 | 0 | 0 | 1 | 1 | 1 | 0 | 0 |
| 15 | 001111 | 0 | 0 | 1 | 1 | 1 | 1 | 0 | 0 | 0 | 0 | 1 | 1 | 1 | 1 | 0 | 0 |
| 16 | 010000 | 1 | 0 | 0 | 1 | 0 | 0 | 0 | 0 | 0 | 0 | 0 | 0 | 1 | 0 | 1 | 0 |
| 17 | 010001 | 1 | 0 | 0 | 1 | 0 | 1 | 0 | 0 | 0 | 0 | 1 | 0 | 1 | 0 | 1 | 0 |
| 18 | 010010 | 1 | 0 | 1 | 1 | 0 | 0 | 0 | 0 | 0 | 0 | 0 | 0 | 1 | 1 | 1 | 0 |
| 19 | 010011 | 1 | 0 | 1 | 1 | 0 | 1 | 0 | 0 | 0 | 0 | 1 | 0 | 1 | 1 | 1 | 0 |
| 20 | 010100 | 1 | 0 | 0 | 1 | 1 | 0 | 0 | 0 | 0 | 0 | 0 | 1 | 1 | 0 | 1 | 0 |
| 21 | 010101 | 1 | 0 | 0 | 1 | 1 | 1 | 0 | 0 | 0 | 0 | 1 | 1 | 1 | 0 | 1 | 0 |
| 22 | 010110 | 1 | 0 | 1 | 1 | 1 | 0 | 0 | 0 | 0 | 0 | 0 | 1 | 1 | 1 | 1 | 0 |
| 23 | 010111 | 1 | 0 | 1 | 1 | 1 | 1 | 0 | 0 | 0 | 0 | 1 | 1 | 1 | 1 | 1 | 0 |
| 24 | 011000 | 1 | 0 | 0 | 1 | 0 | 0 | 0 | 1 | 0 | 1 | 0 | 0 | 1 | 0 | 1 | 0 |
| 25 | 011001 | 1 | 0 | 0 | 1 | 0 | 1 | 0 | 1 | 0 | 1 | 1 | 0 | 1 | 0 | 1 | 0 |
| 26 | 011010 | 1 | 0 | 1 | 1 | 0 | 0 | 0 | 1 | 0 | 1 | 0 | 0 | 1 | 1 | 1 | 0 |
| 27 | 011011 | 1 | 0 | 1 | 1 | 0 | 1 | 0 | 1 | 0 | 1 | 1 | 0 | 1 | 1 | 1 | 0 |
| 28 | 011100 | 1 | 0 | 0 | 1 | 1 | 0 | 0 | 1 | 0 | 1 | 0 | 1 | 1 | 0 | 1 | 0 |
| 29 | 011101 | 1 | 0 | 0 | 1 | 1 | 1 | 0 | 1 | 0 | 1 | 1 | 1 | 1 | 0 | 1 | 0 |
| 30 | 011110 | 1 | 0 | 1 | 1 | 1 | 0 | 0 | 1 | 0 | 1 | 0 | 1 | 1 | 1 | 1 | 0 |
| 31 | 011111 | 1 | 0 | 1 | 1 | 1 | 1 | 0 | 1 | 0 | 1 | 1 | 1 | 1 | 1 | 1 | 0 |

FIG.18

| HALF TONE LEVEL | INPUT PIXEL DATA | 1ST CONVERSION TABLE | | | | | | | | 2ND CONVERSION TABLE | | | | | | | |
|---|---|---|---|---|---|---|---|---|---|---|---|---|---|---|---|---|---|
| | | CONVERSION PIXEL DATA A | | | | | | | | CONVERSION PIXEL DATA B | | | | | | | |
| | 654321 | 8 | 7 | 6 | 5 | 4 | 3 | 2 | 1 | 8 | 7 | 6 | 5 | 4 | 3 | 2 | 1 |
| 32 | 100000 | 1 | 1 | 0 | 1 | 0 | 0 | 0 | 0 | 0 | 0 | 0 | 0 | 1 | 0 | 1 | 1 |
| 33 | 100001 | 1 | 1 | 0 | 1 | 0 | 1 | 0 | 0 | 0 | 0 | 1 | 0 | 1 | 0 | 1 | 1 |
| 34 | 100010 | 1 | 1 | 1 | 1 | 0 | 0 | 0 | 0 | 0 | 0 | 0 | 0 | 1 | 1 | 1 | 1 |
| 35 | 100011 | 1 | 1 | 1 | 1 | 0 | 1 | 0 | 0 | 0 | 0 | 1 | 0 | 1 | 1 | 1 | 1 |
| 36 | 100100 | 1 | 1 | 0 | 1 | 1 | 0 | 0 | 0 | 0 | 0 | 0 | 1 | 1 | 0 | 1 | 1 |
| 37 | 100101 | 1 | 1 | 0 | 1 | 1 | 1 | 0 | 0 | 0 | 0 | 1 | 1 | 1 | 0 | 1 | 1 |
| 38 | 100110 | 1 | 1 | 1 | 1 | 1 | 0 | 0 | 0 | 0 | 0 | 0 | 1 | 1 | 1 | 1 | 1 |
| 39 | 100111 | 1 | 1 | 1 | 1 | 1 | 1 | 0 | 0 | 0 | 0 | 1 | 1 | 1 | 1 | 1 | 1 |
| 40 | 101000 | 1 | 1 | 0 | 1 | 0 | 0 | 0 | 1 | 0 | 1 | 0 | 0 | 1 | 0 | 1 | 1 |
| 41 | 101001 | 1 | 1 | 0 | 1 | 0 | 1 | 0 | 1 | 0 | 1 | 1 | 0 | 1 | 0 | 1 | 1 |
| 42 | 101010 | 1 | 1 | 1 | 1 | 0 | 0 | 0 | 1 | 0 | 1 | 0 | 0 | 1 | 1 | 1 | 1 |
| 43 | 101011 | 1 | 1 | 1 | 1 | 0 | 1 | 0 | 1 | 0 | 1 | 1 | 0 | 1 | 1 | 1 | 1 |
| 44 | 101100 | 1 | 1 | 0 | 1 | 1 | 0 | 0 | 1 | 0 | 1 | 0 | 1 | 1 | 0 | 1 | 1 |
| 45 | 101101 | 1 | 1 | 0 | 1 | 1 | 1 | 0 | 1 | 0 | 1 | 1 | 1 | 1 | 0 | 1 | 1 |
| 46 | 101110 | 1 | 1 | 1 | 1 | 1 | 0 | 0 | 1 | 0 | 1 | 0 | 1 | 1 | 1 | 1 | 1 |
| 47 | 101111 | 1 | 1 | 1 | 1 | 1 | 1 | 0 | 1 | 0 | 1 | 1 | 1 | 1 | 1 | 1 | 1 |
| 48 | 110000 | 1 | 1 | 0 | 1 | 0 | 0 | 1 | 0 | 1 | 1 | 0 | 0 | 1 | 0 | 1 | 1 |
| 49 | 110001 | 1 | 1 | 0 | 1 | 0 | 1 | 1 | 0 | 1 | 0 | 1 | 0 | 1 | 0 | 1 | 1 |
| 50 | 110010 | 1 | 1 | 1 | 1 | 0 | 0 | 1 | 0 | 1 | 0 | 0 | 0 | 1 | 1 | 1 | 1 |
| 51 | 110011 | 1 | 1 | 1 | 1 | 0 | 1 | 1 | 0 | 1 | 0 | 1 | 0 | 1 | 1 | 1 | 1 |
| 52 | 110100 | 1 | 1 | 0 | 1 | 1 | 0 | 1 | 0 | 1 | 0 | 0 | 1 | 1 | 0 | 1 | 1 |
| 53 | 110101 | 1 | 1 | 0 | 1 | 1 | 1 | 1 | 0 | 1 | 0 | 1 | 1 | 1 | 0 | 1 | 1 |
| 54 | 110110 | 1 | 1 | 1 | 1 | 1 | 0 | 1 | 0 | 1 | 0 | 0 | 1 | 1 | 1 | 1 | 1 |
| 55 | 110111 | 1 | 1 | 1 | 1 | 1 | 1 | 1 | 0 | 1 | 0 | 1 | 1 | 1 | 1 | 1 | 1 |
| 56 | 111000 | 1 | 1 | 0 | 1 | 0 | 0 | 1 | 1 | 1 | 1 | 0 | 0 | 1 | 0 | 1 | 1 |
| 57 | 111001 | 1 | 1 | 0 | 1 | 0 | 1 | 1 | 1 | 1 | 1 | 1 | 0 | 1 | 0 | 1 | 1 |
| 58 | 111010 | 1 | 1 | 1 | 1 | 0 | 0 | 1 | 1 | 1 | 1 | 0 | 0 | 1 | 1 | 1 | 1 |
| 59 | 111011 | 1 | 1 | 1 | 1 | 0 | 1 | 1 | 1 | 1 | 1 | 1 | 0 | 1 | 1 | 1 | 1 |
| 60 | 111100 | 1 | 1 | 0 | 1 | 1 | 0 | 1 | 1 | 1 | 1 | 0 | 1 | 1 | 0 | 1 | 1 |
| 61 | 111101 | 1 | 1 | 0 | 1 | 1 | 1 | 1 | 1 | 1 | 1 | 1 | 1 | 1 | 0 | 1 | 1 |
| 62 | 111110 | 1 | 1 | 1 | 1 | 1 | 0 | 1 | 1 | 1 | 1 | 0 | 1 | 1 | 1 | 1 | 1 |
| 63 | 111111 | 1 | 1 | 1 | 1 | 1 | 1 | 1 | 1 | 1 | 1 | 1 | 1 | 1 | 1 | 1 | 1 |

FIG.32A nTH FIELD

| | | | |
|---|---|---|---|
| A | B | A | B |
| C | D | C | D |
| A | B | A | B |
| C | D | C | D |

FIG.32B (n+1)TH FIELD

| | | | |
|---|---|---|---|
| A | B | C | D |
| D | A | B | C |
| C | D | A | B |
| B | C | D | A |

FIG.32C (n+2)TH FIELD

| | | | |
|---|---|---|---|
| A | B | C | D |
| C | D | A | B |
| A | B | C | D |
| C | D | A | B |

DIVIDING PERIOD
FIG.35B COLUMN ELECTRODE D1~m
FIG.35C ROW ELECTRODE X1~n
FIG.35D ROW ELECTRODE Y1
FIG.35E ROW ELECTRODE Y2
FIG.35F ROW ELECTRODE Y3
FIG.35G ROW ELECTRODE Yn

DP1
DP2
DP3
DPn
APOD
APEV
IPx
RPx
RPY
IPY
SP
WP
EP
ta
RESET (R)
ADDRESS (AD)
1ST SUSTAIN DISCHAGE (I1)
ALL ERASE
SELECTIVE WRITING
2ND SUSTAIN DISCHARGE (I2)
ALL ERASE

FIG. 38

| STATE | DISCHARGE CELL $G_{11}$ | DISCHARGE CELL $G_{12}$ | |
|---|---|---|---|
| 1 | NON-LIGHT EMISSION | NON-LIGHT EMISSION | → NON-LIGHT EMISSION |
| 2 | NON-LIGHT EMISSION | LIGHT EMISSION (LIGHT EMITTING PERIOD "2") | → LUMINANCE CORRESPONDING TO LIGHT EMITTING PERIOD "1" |
| 3 | LIGHT EMISSION (LIGHT EMITTING PERIOD "4") | NON-LIGHT EMISSION | → LUMINANCE CORRESPONDING TO LIGHT EMITTING PERIOD "2" |
| 4 | LIGHT EMISSION (LIGHT EMITTING PERIOD "4") | LIGHT EMISSION (LIGHT EMITTING PERIOD "2") | → LUMINANCE CORRESPONDING TO LIGHT EMITTING PERIOD "3" |

FIG.39

| INPUT PIXEL DATA | 1ST CONVERSION TABLE | 2ND CONVERSION TABLE |
|---|---|---|
| | CONVERSION DATA A | CONVERSION DATA B |
| 8 7 6 5 4 3 2 1 | 7 6 5 4 3 2 1 | 7 6 5 4 3 2 1 |
| * * * * * * 0 0 | * * * * * * 0 | * * * * * * 0 |
| * * * * * * 0 1 | * * * * * * 0 | * * * * * * 1 |
| * * * * * * 1 0 | * * * * * * 1 | * * * * * * 0 |
| * * * * * * 1 1 | * * * * * * 1 | * * * * * * 1 |

FIG.44

| INPUT PIXEL DATA | 1ST CONVERSION TABLE | 2ND CONVERSION TABLE | 3RD CONVERSION TABLE | 4TH CONVERSION TABLE |
|---|---|---|---|---|
| | CONVERSION DATA A | CONVERSION DATA B | CONVERSION DATA C | CONVERSION DATA D |
| 8 7 6 5 4 3 2 1 | 5 4 3 2 1 | 5 4 3 2 1 | 5 4 3 2 1 | 5 4 3 2 1 |
| * * * * 0 0 0 0 | * * * * 0 | * * * * 0 | * * * * 0 | * * * * 0 |
| * * * * 0 0 0 1 | * * * * 0 | * * * * 0 | * * * * 0 | * * * * 1 |
| * * * * 0 0 1 0 | * * * * 0 | * * * * 0 | * * * * 1 | * * * * 0 |
| * * * * 0 0 1 1 | * * * * 0 | * * * * 0 | * * * * 1 | * * * * 1 |
| * * * * 0 1 0 0 | * * * * 0 | * * * * 1 | * * * * 0 | * * * * 0 |
| * * * * 0 1 0 1 | * * * * 0 | * * * * 1 | * * * * 0 | * * * * 1 |
| * * * * 0 1 1 0 | * * * * 0 | * * * * 1 | * * * * 1 | * * * * 0 |
| * * * * 0 1 1 1 | * * * * 0 | * * * * 1 | * * * * 1 | * * * * 1 |
| * * * * 1 0 0 0 | * * * * 1 | * * * * 0 | * * * * 0 | * * * * 0 |
| * * * * 1 0 0 1 | * * * * 1 | * * * * 0 | * * * * 0 | * * * * 1 |
| * * * * 1 0 1 0 | * * * * 1 | * * * * 0 | * * * * 1 | * * * * 0 |
| * * * * 1 0 1 1 | * * * * 1 | * * * * 0 | * * * * 1 | * * * * 1 |
| * * * * 1 1 0 0 | * * * * 1 | * * * * 1 | * * * * 0 | * * * * 0 |
| * * * * 1 1 0 1 | * * * * 1 | * * * * 1 | * * * * 0 | * * * * 1 |
| * * * * 1 1 1 0 | * * * * 1 | * * * * 1 | * * * * 1 | * * * * 0 |
| * * * * 1 1 1 1 | * * * * 1 | * * * * 1 | * * * * 1 | * * * * 1 |

FIG. 47

| HALF TONE LEVEL | INPUT PIXEL DATA | 1ST CONVERSION TABLE | | | | | | | | 2ND CONVERSION TABLE | | | | | | | |
|---|---|---|---|---|---|---|---|---|---|---|---|---|---|---|---|---|---|
| | | CONVERSION PIXEL DATA A | | | | | | | | CONVERSION PIXEL DATA B | | | | | | | |
| | 654321 | 8 | 7 | 6 | 5 | 4 | 3 | 2 | 1 | 8 | 7 | 6 | 5 | 4 | 3 | 2 | 1 |
| 00 | 000000 | 0 | 0 | 0 | 0 | 0 | 0 | 0 | 0 | 0 | 0 | 0 | 0 | 0 | 0 | 0 | 0 |
| 01 | 000001 | 0 | 0 | 0 | 0 | 0 | 1 | 0 | 0 | 0 | 0 | 1 | 0 | 0 | 0 | 0 | 0 |
| 02 | 000010 | 0 | 0 | 1 | 0 | 0 | 0 | 0 | 0 | 0 | 0 | 0 | 0 | 0 | 1 | 0 | 0 |
| 03 | 000011 | 0 | 0 | 1 | 0 | 0 | 1 | 0 | 0 | 0 | 0 | 1 | 0 | 0 | 1 | 0 | 0 |
| 04 | 000100 | 0 | 0 | 0 | 0 | 1 | 0 | 0 | 0 | 0 | 0 | 0 | 1 | 0 | 0 | 0 | 0 |
| 05 | 000101 | 0 | 0 | 0 | 0 | 1 | 1 | 0 | 0 | 0 | 0 | 1 | 1 | 0 | 0 | 0 | 0 |
| 06 | 000110 | 0 | 0 | 1 | 0 | 1 | 0 | 0 | 0 | 0 | 0 | 0 | 1 | 0 | 1 | 0 | 0 |
| 07 | 000111 | 0 | 0 | 1 | 0 | 1 | 1 | 0 | 0 | 0 | 0 | 1 | 1 | 0 | 1 | 0 | 0 |
| 08 | 001000 | 0 | 0 | 0 | 1 | 0 | 0 | 0 | 0 | 0 | 0 | 0 | 0 | 1 | 0 | 0 | 0 |
| 09 | 001001 | 0 | 0 | 0 | 1 | 0 | 1 | 0 | 0 | 0 | 0 | 1 | 0 | 1 | 0 | 0 | 0 |
| 10 | 001010 | 0 | 0 | 1 | 1 | 0 | 0 | 0 | 0 | 0 | 0 | 0 | 0 | 1 | 1 | 0 | 0 |
| 11 | 001011 | 0 | 0 | 1 | 1 | 0 | 1 | 0 | 0 | 0 | 0 | 1 | 0 | 1 | 1 | 0 | 0 |
| 12 | 001100 | 0 | 0 | 0 | 1 | 1 | 0 | 0 | 0 | 0 | 0 | 0 | 1 | 1 | 0 | 0 | 0 |
| 13 | 001101 | 0 | 0 | 0 | 1 | 1 | 1 | 0 | 0 | 0 | 0 | 1 | 1 | 1 | 0 | 0 | 0 |
| 14 | 001110 | 0 | 0 | 1 | 1 | 1 | 0 | 0 | 0 | 0 | 0 | 0 | 1 | 1 | 1 | 0 | 0 |
| 15 | 001111 | 0 | 0 | 1 | 1 | 1 | 1 | 0 | 0 | 0 | 0 | 1 | 1 | 1 | 1 | 0 | 0 |
| 16 | 010000 | 1 | 0 | 0 | 1 | 0 | 0 | 0 | 0 | 0 | 0 | 0 | 0 | 1 | 0 | 1 | 0 |
| 17 | 010001 | 1 | 0 | 0 | 1 | 0 | 1 | 0 | 0 | 0 | 0 | 1 | 0 | 1 | 0 | 1 | 0 |
| 18 | 010010 | 1 | 0 | 1 | 1 | 0 | 0 | 0 | 0 | 0 | 0 | 0 | 0 | 1 | 1 | 1 | 0 |
| 19 | 010011 | 1 | 0 | 1 | 1 | 0 | 1 | 0 | 0 | 0 | 0 | 1 | 0 | 1 | 1 | 1 | 0 |
| 20 | 010100 | 1 | 0 | 0 | 1 | 1 | 0 | 0 | 0 | 0 | 0 | 0 | 1 | 1 | 0 | 1 | 0 |
| 21 | 010101 | 1 | 0 | 0 | 1 | 1 | 1 | 0 | 0 | 0 | 0 | 1 | 1 | 1 | 0 | 1 | 0 |
| 22 | 010110 | 1 | 0 | 1 | 1 | 1 | 0 | 0 | 0 | 0 | 0 | 0 | 1 | 1 | 1 | 1 | 0 |
| 23 | 010111 | 1 | 0 | 1 | 1 | 1 | 1 | 0 | 0 | 0 | 0 | 1 | 1 | 1 | 1 | 1 | 0 |
| 24 | 011000 | 1 | 0 | 0 | 1 | 0 | 0 | 0 | 1 | 0 | 1 | 0 | 0 | 1 | 0 | 1 | 0 |
| 25 | 011001 | 1 | 0 | 0 | 1 | 0 | 1 | 0 | 1 | 0 | 1 | 1 | 0 | 1 | 0 | 1 | 0 |
| 26 | 011010 | 1 | 0 | 1 | 1 | 0 | 0 | 0 | 1 | 0 | 1 | 0 | 0 | 1 | 1 | 1 | 0 |
| 27 | 011011 | 1 | 0 | 1 | 1 | 0 | 1 | 0 | 1 | 0 | 1 | 1 | 0 | 1 | 1 | 1 | 0 |
| 28 | 011100 | 1 | 0 | 0 | 1 | 1 | 0 | 0 | 1 | 0 | 1 | 0 | 1 | 1 | 0 | 1 | 0 |
| 29 | 011101 | 1 | 0 | 0 | 1 | 1 | 1 | 0 | 1 | 0 | 1 | 1 | 1 | 1 | 0 | 1 | 0 |
| 30 | 011110 | 1 | 0 | 1 | 1 | 1 | 0 | 0 | 1 | 0 | 1 | 0 | 1 | 1 | 1 | 1 | 0 |
| 31 | 011111 | 1 | 0 | 1 | 1 | 1 | 1 | 0 | 1 | 0 | 1 | 1 | 1 | 1 | 1 | 1 | 0 |

FIG.48

| HALF TONE LEVEL | INPUT PIXEL DATA | 1ST CONVERSION TABLE | | | | | | | | 2ND CONVERSION TABLE | | | | | | | |
|---|---|---|---|---|---|---|---|---|---|---|---|---|---|---|---|---|---|
| | | CONVERSION PIXEL DATA A | | | | | | | | CONVERSION PIXEL DATA B | | | | | | | |
| | 654321 | 8 | 7 | 6 | 5 | 4 | 3 | 2 | 1 | 8 | 7 | 6 | 5 | 4 | 3 | 2 | 1 |
| 32 | 100000 | 0 | 1 | 0 | 1 | 0 | 0 | 0 | 1 | 0 | 1 | 0 | 0 | 1 | 0 | 0 | 1 |
| 33 | 100001 | 0 | 1 | 0 | 1 | 0 | 1 | 0 | 1 | 0 | 1 | 1 | 0 | 1 | 0 | 0 | 1 |
| 34 | 100010 | 0 | 1 | 1 | 1 | 0 | 0 | 0 | 1 | 0 | 1 | 0 | 0 | 1 | 1 | 0 | 1 |
| 35 | 100011 | 0 | 1 | 1 | 1 | 0 | 1 | 0 | 1 | 0 | 1 | 1 | 0 | 1 | 1 | 0 | 1 |
| 36 | 100100 | 0 | 1 | 0 | 1 | 1 | 0 | 0 | 1 | 0 | 1 | 0 | 1 | 1 | 0 | 0 | 1 |
| 37 | 100101 | 0 | 1 | 0 | 1 | 1 | 1 | 0 | 1 | 0 | 1 | 1 | 1 | 1 | 0 | 0 | 1 |
| 38 | 100110 | 0 | 1 | 1 | 1 | 1 | 0 | 0 | 1 | 0 | 1 | 0 | 1 | 1 | 1 | 0 | 1 |
| 39 | 100111 | 0 | 1 | 1 | 1 | 1 | 1 | 0 | 1 | 0 | 1 | 1 | 1 | 1 | 1 | 0 | 1 |
| 40 | 101000 | 0 | 1 | 0 | 1 | 0 | 0 | 1 | 0 | 1 | 0 | 0 | 0 | 1 | 0 | 0 | 1 |
| 41 | 101001 | 0 | 1 | 0 | 1 | 0 | 1 | 1 | 0 | 1 | 0 | 1 | 0 | 1 | 0 | 0 | 1 |
| 42 | 101010 | 0 | 1 | 1 | 1 | 0 | 0 | 1 | 0 | 1 | 0 | 0 | 0 | 1 | 1 | 0 | 1 |
| 43 | 101011 | 0 | 1 | 1 | 1 | 0 | 1 | 1 | 0 | 1 | 0 | 1 | 0 | 1 | 1 | 0 | 1 |
| 44 | 101100 | 0 | 1 | 0 | 1 | 1 | 0 | 1 | 0 | 1 | 0 | 0 | 1 | 1 | 0 | 0 | 1 |
| 45 | 101101 | 0 | 1 | 0 | 1 | 1 | 1 | 1 | 0 | 1 | 0 | 1 | 1 | 1 | 0 | 0 | 1 |
| 46 | 101110 | 0 | 1 | 1 | 1 | 1 | 0 | 1 | 0 | 1 | 0 | 0 | 1 | 1 | 1 | 0 | 1 |
| 47 | 101111 | 0 | 1 | 1 | 1 | 1 | 1 | 1 | 0 | 1 | 0 | 1 | 1 | 1 | 1 | 0 | 1 |
| 48 | 110000 | | 1 | 0 | 1 | 0 | 0 | 1 | 0 | 1 | 0 | 0 | 0 | 1 | 0 | 1 | 1 |
| 49 | 110001 | 1 | 1 | 0 | 1 | 0 | 1 | 1 | 0 | 1 | 0 | 1 | 0 | 1 | 0 | 1 | 1 |
| 50 | 110010 | 1 | 1 | 1 | 1 | 0 | 0 | 1 | 0 | 1 | 0 | 0 | 0 | 1 | 1 | 1 | 1 |
| 51 | 110011 | 1 | 1 | 1 | 1 | 0 | 1 | 1 | 0 | 1 | 0 | 1 | 0 | 1 | 1 | 1 | 1 |
| 52 | 110100 | 1 | 1 | 0 | 1 | 1 | 0 | 1 | 0 | 1 | 0 | 0 | 1 | 1 | 0 | 1 | 1 |
| 53 | 110101 | 1 | 1 | 0 | 1 | 1 | 1 | 1 | 0 | 1 | 0 | 1 | 1 | 1 | 0 | 1 | 1 |
| 54 | 110110 | 1 | 1 | 1 | 1 | 1 | 0 | 1 | 0 | 1 | 0 | 0 | 1 | 1 | 1 | 1 | 1 |
| 55 | 110111 | 1 | 1 | 1 | 1 | 1 | 1 | 1 | 0 | 1 | 0 | 1 | 1 | 1 | 1 | 1 | 1 |
| 56 | 111000 | 1 | 1 | 0 | 1 | 0 | 0 | 1 | 1 | 1 | 1 | 0 | 0 | 1 | 0 | 1 | 1 |
| 57 | 111001 | 1 | 1 | 0 | 1 | 0 | 1 | 1 | 1 | 1 | 1 | 1 | 0 | 1 | 0 | 1 | 1 |
| 58 | 111010 | 1 | 1 | 1 | 1 | 0 | 0 | 1 | 1 | 1 | 1 | 0 | 0 | 1 | 1 | 1 | 1 |
| 59 | 111011 | 1 | 1 | 1 | 1 | 0 | 1 | 1 | 1 | 1 | 1 | 1 | 0 | 1 | 1 | 1 | 1 |
| 60 | 111100 | 1 | 1 | 0 | 1 | 1 | 0 | 1 | 1 | 1 | 1 | 0 | 1 | 1 | 0 | 1 | 1 |
| 61 | 111101 | 1 | 1 | 0 | 1 | 1 | 1 | 1 | 1 | 1 | 1 | 1 | 1 | 1 | 0 | 1 | 1 |
| 62 | 111110 | 1 | 1 | 1 | 1 | 1 | 0 | 1 | 1 | 1 | 1 | 0 | 1 | 1 | 1 | 1 | 1 |
| 63 | 111111 | 1 | 1 | 1 | 1 | 1 | 1 | 1 | 1 | 1 | 1 | 1 | 1 | 1 | 1 | 1 | 1 |

FIG.50

| HALF TONE LEVEL | 1ST CONVERSION TABLE | | | | | | | | 2ND CONVERSION TABLE | | | | | | | |
|---|---|---|---|---|---|---|---|---|---|---|---|---|---|---|---|---|
| | CONVERSION PIXEL DATA A | | | | | | | | CONVERSION PIXEL DATA B | | | | | | | |
| | 8 | 7 | 6 | 5 | 4 | 3 | 2 | 1 | 8 | 7 | 6 | 5 | 4 | 3 | 2 | 1 |
| 0~3 | 0 | 0 | 0 | 0 | 0 | 0 | 0 | 0 | 0 | 0 | 0 | 0 | 0 | 0 | 0 | 0 |
| 4~7 | 0 | 0 | 0 | 0 | 1 | 0 | 0 | 0 | 0 | 0 | 0 | 1 | 0 | 0 | 0 | 0 |
| 8~11 | 0 | 0 | 0 | 1 | 0 | 0 | 0 | 0 | 0 | 0 | 0 | 0 | 1 | 0 | 0 | 0 |
| 12~15 | 0 | 0 | 0 | 1 | 1 | 0 | 0 | 0 | 0 | 0 | 0 | 1 | 1 | 0 | 0 | 0 |
| 16~19 | 0 | 0 | 0 | 0 | 0 | 1 | 0 | 0 | 0 | 0 | 1 | 0 | 0 | 0 | 0 | 0 |
| 20~23 | 0 | 0 | 0 | 0 | 1 | 1 | 0 | 0 | 0 | 0 | 1 | 1 | 0 | 0 | 0 | 0 |
| 24~27 | 0 | 0 | 0 | 1 | 0 | 1 | 0 | 0 | 0 | 0 | 1 | 0 | 1 | 0 | 0 | 0 |
| 28~31 | 0 | 0 | 0 | 1 | 1 | 1 | 0 | 0 | 0 | 0 | 1 | 1 | 1 | 0 | 0 | 0 |
| 32~35 | 0 | 0 | 0 | 0 | 0 | 0 | 1 | 0 | 1 | 0 | 0 | 0 | 0 | 0 | 0 | 0 |
| 36~39 | 0 | 0 | 0 | 0 | 1 | 0 | 1 | 0 | 1 | 0 | 0 | 1 | 0 | 0 | 0 | 0 |
| 40~43 | 0 | 0 | 0 | 1 | 0 | 0 | 1 | 0 | 1 | 0 | 0 | 0 | 1 | 0 | 0 | 0 |
| 44~47 | 0 | 0 | 0 | 1 | 1 | 0 | 1 | 0 | 1 | 0 | 0 | 1 | 1 | 0 | 0 | 0 |
| 48~51 | 0 | 0 | 0 | 0 | 0 | 1 | 1 | 0 | 1 | 0 | 1 | 0 | 0 | 0 | 0 | 0 |
| 52~55 | 0 | 0 | 0 | 0 | 1 | 1 | 1 | 0 | 1 | 0 | 1 | 1 | 0 | 0 | 0 | 0 |
| 56~59 | 0 | 0 | 0 | 1 | 0 | 1 | 1 | 0 | 1 | 0 | 1 | 0 | 1 | 0 | 0 | 0 |
| 60~63 | 0 | 0 | 0 | 1 | 1 | 1 | 1 | 0 | 1 | 0 | 1 | 1 | 1 | 0 | 0 | 0 |
| 64~67 | 0 | 0 | 1 | 0 | 0 | 0 | 1 | 0 | 1 | 0 | 0 | 0 | 0 | 1 | 0 | 0 |
| 68~71 | 0 | 0 | 1 | 0 | 1 | 0 | 1 | 0 | 1 | 0 | 0 | 1 | 0 | 1 | 0 | 0 |
| 72~75 | 0 | 0 | 1 | 1 | 0 | 0 | 1 | 0 | 1 | 0 | 0 | 0 | 1 | 1 | 0 | 0 |
| 76~79 | 0 | 0 | 1 | 1 | 1 | 0 | 1 | 0 | 1 | 0 | 0 | 1 | 1 | 1 | 0 | 0 |
| 80~83 | 0 | 0 | 1 | 0 | 0 | 1 | 1 | 0 | 1 | 0 | 1 | 0 | 0 | 1 | 0 | 0 |
| 84~87 | 0 | 0 | 1 | 0 | 1 | 1 | 1 | 0 | 1 | 0 | 1 | 1 | 0 | 1 | 0 | 0 |
| 88~91 | 0 | 0 | 1 | 1 | 0 | 1 | 1 | 0 | 1 | 0 | 1 | 0 | 1 | 1 | 0 | 0 |
| 92~95 | 0 | 0 | 1 | 1 | 1 | 1 | 1 | 0 | 1 | 0 | 1 | 1 | 1 | 1 | 0 | 0 |
| 96~99 | 0 | 0 | 0 | 0 | 0 | 0 | 1 | 1 | 1 | 1 | 0 | 0 | 0 | 0 | 0 | 0 |
| 100~103 | 0 | 0 | 0 | 0 | 1 | 0 | 1 | 1 | 1 | 1 | 0 | 1 | 0 | 0 | 0 | 0 |
| 104~107 | 0 | 0 | 0 | 1 | 0 | 0 | 1 | 1 | 1 | 1 | 0 | 0 | 1 | 0 | 0 | 0 |
| 108~111 | 0 | 0 | 0 | 1 | 1 | 0 | 1 | 1 | 1 | 1 | 0 | 1 | 1 | 0 | 0 | 0 |
| 112~115 | 0 | 0 | 0 | 0 | 0 | 1 | 1 | 1 | 1 | 1 | 1 | 0 | 0 | 0 | 0 | 0 |
| 116~119 | 0 | 0 | 0 | 0 | 1 | 1 | 1 | 1 | 1 | 1 | 1 | 1 | 0 | 0 | 0 | 0 |
| 120~123 | 0 | 0 | 0 | 1 | 0 | 1 | 1 | 1 | 1 | 1 | 1 | 0 | 1 | 0 | 0 | 0 |
| 124~127 | 0 | 0 | 0 | 1 | 1 | 1 | 1 | 1 | 1 | 1 | 1 | 1 | 1 | 0 | 0 | 0 |

FIG. 51

| HALF TONE LEVEL | 1ST CONVERSION TABLE | | | | | | | | 2ND CONVERSION TABLE | | | | | | | |
|---|---|---|---|---|---|---|---|---|---|---|---|---|---|---|---|---|
| | CONVERSION PIXEL DATA A | | | | | | | | CONVERSION PIXEL DATA B | | | | | | | |
| | 8 | 7 | 6 | 5 | 4 | 3 | 2 | 1 | 8 | 7 | 6 | 5 | 4 | 3 | 2 | 1 |
| 128~131 | 0 | 0 | 1 | 0 | 0 | 0 | 1 | 1 | 1 | 1 | 0 | 0 | 0 | 1 | 0 | 0 |
| 132~135 | 0 | 0 | 1 | 0 | 1 | 0 | 1 | 1 | 1 | 1 | 0 | 1 | 0 | 1 | 0 | 0 |
| 136~139 | 0 | 0 | 1 | 1 | 0 | 0 | 1 | 1 | 1 | 1 | 0 | 0 | 1 | 1 | 0 | 0 |
| 140~143 | 0 | 0 | 1 | 1 | 1 | 0 | 1 | 1 | 1 | 1 | 0 | 1 | 1 | 1 | 0 | 0 |
| 144~147 | 0 | 0 | 1 | 0 | 0 | 1 | 1 | 1 | 1 | 1 | 1 | 0 | 0 | 1 | 0 | 0 |
| 148~151 | 0 | 0 | 1 | 0 | 1 | 1 | 1 | 1 | 1 | 1 | 1 | 1 | 0 | 1 | 0 | 0 |
| 152~155 | 0 | 0 | 1 | 1 | 0 | 1 | 1 | 1 | 1 | 1 | 1 | 0 | 1 | 1 | 0 | 0 |
| 156~159 | 0 | 0 | 1 | 1 | 1 | 1 | 1 | 1 | 1 | 1 | 1 | 1 | 1 | 1 | 0 | 0 |
| 160~163 | 1 | 0 | 1 | 0 | 0 | 0 | 1 | 1 | 1 | 1 | 0 | 0 | 0 | 1 | 1 | 0 |
| 164~167 | 1 | 0 | 1 | 0 | 1 | 0 | 1 | 1 | 1 | 1 | 0 | 1 | 0 | 1 | 1 | 0 |
| 168~171 | 1 | 0 | 1 | 1 | 0 | 0 | 1 | 1 | 1 | 1 | 0 | 0 | 1 | 1 | 1 | 0 |
| 172~175 | 1 | 0 | 1 | 1 | 1 | 0 | 1 | 1 | 1 | 1 | 0 | 1 | 1 | 1 | 1 | 0 |
| 176~179 | 1 | 0 | 1 | 0 | 0 | 1 | 1 | 1 | 1 | 1 | 1 | 0 | 0 | 1 | 1 | 0 |
| 180~183 | 1 | 0 | 1 | 0 | 1 | 1 | 1 | 1 | 1 | 1 | 1 | 1 | 0 | 1 | 1 | 0 |
| 184~187 | 1 | 0 | 1 | 1 | 0 | 1 | 1 | 1 | 1 | 1 | 1 | 0 | 1 | 1 | 1 | 0 |
| 188~191 | 1 | 0 | 1 | 1 | 1 | 1 | 1 | 1 | 1 | 1 | 1 | 1 | 1 | 1 | 1 | 0 |
| 192~195 | 1 | 1 | 0 | 0 | 0 | 0 | 1 | 1 | 1 | 1 | 0 | 0 | 0 | 0 | 1 | 1 |
| 196~199 | 1 | 1 | 0 | 0 | 1 | 0 | 1 | 1 | 1 | 1 | 0 | 1 | 0 | 0 | 1 | 1 |
| 200~203 | 1 | 1 | 0 | 1 | 0 | 0 | 1 | 1 | 1 | 1 | 0 | 0 | 1 | 0 | 1 | 1 |
| 204~207 | 1 | 1 | 0 | 1 | 1 | 0 | 1 | 1 | 1 | 1 | 0 | 1 | 1 | 0 | 1 | 1 |
| 208~211 | 1 | 1 | 0 | 0 | 0 | 1 | 1 | 1 | 1 | 1 | 1 | 0 | 0 | 0 | 1 | 1 |
| 212~215 | 1 | 1 | 0 | 0 | 1 | 1 | 1 | 1 | 1 | 1 | 1 | 1 | 0 | 0 | 1 | 1 |
| 216~219 | 1 | 1 | 0 | 1 | 0 | 1 | 1 | 1 | 1 | 1 | 1 | 0 | 1 | 0 | 1 | 1 |
| 220~223 | 1 | 1 | 0 | 1 | 1 | 1 | 1 | 1 | 1 | 1 | 1 | 1 | 1 | 0 | 1 | 1 |
| 224~227 | 1 | 1 | 1 | 0 | 0 | 0 | 1 | 1 | 1 | 1 | 0 | 0 | 0 | 1 | 1 | 1 |
| 228~231 | 1 | 1 | 1 | 0 | 1 | 0 | 1 | 1 | 1 | 1 | 0 | 1 | 0 | 1 | 1 | 1 |
| 232~235 | 1 | 1 | 1 | 1 | 0 | 0 | 1 | 1 | 1 | 1 | 0 | 0 | 1 | 1 | 1 | 1 |
| 236~239 | 1 | 1 | 1 | 1 | 1 | 0 | 1 | 1 | 1 | 1 | 0 | 1 | 1 | 1 | 1 | 1 |
| 240~243 | 1 | 1 | 1 | 0 | 0 | 1 | 1 | 1 | 1 | 1 | 1 | 0 | 0 | 1 | 1 | 1 |
| 244~247 | 1 | 1 | 1 | 0 | 1 | 1 | 1 | 1 | 1 | 1 | 1 | 1 | 0 | 1 | 1 | 1 |
| 248~251 | 1 | 1 | 1 | 1 | 0 | 1 | 1 | 1 | 1 | 1 | 1 | 0 | 1 | 1 | 1 | 1 |
| 252~255 | 1 | 1 | 1 | 1 | 1 | 1 | 1 | 1 | 1 | 1 | 1 | 1 | 1 | 1 | 1 | 1 |

FIG.53

| HALF TONE LEVEL | 1ST CONVERSION TABLE | | | | | | | | 2ND CONVERSION TABLE | | | | | | | |
|---|---|---|---|---|---|---|---|---|---|---|---|---|---|---|---|---|
| | CONVERSION PIXEL DATA A | | | | | | | | CONVERSION PIXEL DATA B | | | | | | | |
| | 8 | 7 | 6 | 5 | 4 | 3 | 2 | 1 | 8 | 7 | 6 | 5 | 4 | 3 | 2 | 1 |
| 0~3 | 0 | 0 | 0 | 0 | 0 | 0 | 0 | 0 | 0 | 0 | 0 | 0 | 0 | 0 | 0 | 0 |
| 4~7 | 0 | 0 | 0 | 1 | 0 | 0 | 0 | 0 | 0 | 0 | 0 | 0 | 1 | 0 | 0 | 0 |
| 8~11 | 0 | 0 | 0 | 0 | 1 | 0 | 0 | 0 | 0 | 0 | 0 | 1 | 0 | 0 | 0 | 0 |
| 12~15 | 0 | 0 | 0 | 1 | 1 | 0 | 0 | 0 | 0 | 0 | 0 | 1 | 1 | 0 | 0 | 0 |
| 16~19 | 0 | 0 | 0 | 1 | 0 | 1 | 0 | 0 | 0 | 0 | 1 | 0 | 1 | 0 | 0 | 0 |
| 20~23 | 0 | 0 | 0 | 0 | 1 | 1 | 0 | 0 | 0 | 0 | 1 | 1 | 0 | 0 | 0 | 0 |
| 24~27 | 0 | 0 | 0 | 1 | 1 | 1 | 0 | 0 | 0 | 0 | 1 | 1 | 1 | 0 | 0 | 0 |
| 28~31 | 0 | 0 | 1 | 0 | 1 | 0 | 0 | 0 | 0 | 0 | 0 | 1 | 0 | 1 | 0 | 0 |
| 32~35 | 0 | 0 | 1 | 1 | 1 | 0 | 0 | 0 | 0 | 0 | 0 | 1 | 1 | 1 | 0 | 0 |
| 36~39 | 0 | 0 | 1 | 1 | 0 | 1 | 0 | 0 | 0 | 0 | 1 | 0 | 1 | 1 | 0 | 0 |
| 40~43 | 0 | 0 | 1 | 0 | 1 | 1 | 0 | 0 | 0 | 0 | 1 | 1 | 0 | 1 | 0 | 0 |
| 44~47 | 0 | 0 | 1 | 1 | 1 | 1 | 0 | 0 | 0 | 0 | 1 | 1 | 1 | 1 | 0 | 0 |
| 48~51 | 0 | 1 | 0 | 1 | 0 | 1 | 0 | 0 | 0 | 0 | 1 | 0 | 1 | 0 | 1 | 0 |
| 52~55 | 0 | 1 | 0 | 0 | 1 | 1 | 0 | 0 | 0 | 0 | 1 | 1 | 0 | 0 | 1 | 0 |
| 56~59 | 0 | 1 | 0 | 1 | 1 | 1 | 0 | 0 | 0 | 0 | 1 | 1 | 1 | 0 | 1 | 0 |
| 60~63 | 0 | 1 | 1 | 0 | 1 | 0 | 0 | 0 | 0 | 0 | 0 | 1 | 0 | 1 | 1 | 0 |
| 64~67 | 0 | 1 | 1 | 1 | 1 | 0 | 0 | 0 | 0 | 0 | 1 | 0 | 0 | 1 | 1 | 0 |
| 68~71 | 0 | 1 | 1 | 1 | 0 | 1 | 0 | 0 | 0 | 0 | 1 | 0 | 1 | 1 | 1 | 0 |
| 72~75 | 0 | 1 | 1 | 0 | 1 | 1 | 0 | 0 | 0 | 0 | 1 | 1 | 0 | 1 | 1 | 0 |
| 76~79 | 0 | 1 | 1 | 1 | 1 | 1 | 0 | 0 | 0 | 0 | 1 | 1 | 1 | 1 | 1 | 0 |
| 80~83 | 0 | 0 | 1 | 1 | 0 | 1 | 1 | 0 | 0 | 1 | 1 | 0 | 1 | 1 | 0 | 0 |
| 84~87 | 0 | 0 | 1 | 0 | 1 | 1 | 1 | 0 | 0 | 1 | 1 | 1 | 0 | 1 | 0 | 0 |
| 88~91 | 0 | 0 | 1 | 1 | 1 | 1 | 1 | 0 | 0 | 1 | 1 | 1 | 1 | 1 | 0 | 0 |
| 92~95 | 0 | 1 | 0 | 1 | 0 | 1 | 1 | 0 | 0 | 1 | 1 | 0 | 1 | 0 | 1 | 0 |
| 96~99 | 0 | 1 | 0 | 0 | 1 | 1 | 1 | 0 | 0 | 1 | 1 | 1 | 0 | 0 | 1 | 0 |
| 100~103 | 0 | 1 | 0 | 1 | 1 | 1 | 1 | 0 | 0 | 1 | 1 | 1 | 1 | 0 | 1 | 0 |
| 104~107 | 0 | 1 | 1 | 0 | 1 | 0 | 1 | 0 | 0 | 1 | 0 | 1 | 0 | 1 | 1 | 0 |
| 108~111 | 0 | 1 | 1 | 1 | 1 | 0 | 1 | 0 | 0 | 1 | 0 | 1 | 1 | 1 | 1 | 0 |
| 112~115 | 0 | 1 | 1 | 1 | 0 | 1 | 1 | 0 | 0 | 1 | 1 | 0 | 1 | 1 | 1 | 0 |
| 116~119 | 0 | 1 | 1 | 0 | 1 | 1 | 1 | 0 | 0 | 1 | 1 | 1 | 0 | 1 | 1 | 0 |
| 120~123 | 0 | 1 | 1 | 1 | 1 | 1 | 1 | 0 | 0 | 1 | 1 | 1 | 1 | 1 | 1 | 0 |
| 124~127 | 0 | 1 | 1 | 1 | 1 | 0 | 0 | 1 | 1 | 1 | 0 | 1 | 1 | 1 | 1 | 0 |

FIG.54

| HALF TONE LEVEL | 1ST CONVERSION TABLE | | | | | | | | 2ND CONVERSION TABLE | | | | | | | |
|---|---|---|---|---|---|---|---|---|---|---|---|---|---|---|---|---|
| | CONVERSION PIXEL DATA A | | | | | | | | CONVERSION PIXEL DATA B | | | | | | | |
| | 8 | 7 | 6 | 5 | 4 | 3 | 2 | 1 | 8 | 7 | 6 | 5 | 4 | 3 | 2 | 1 |
| 128~131 | 0 | 1 | 1 | 1 | 0 | 1 | 0 | 1 | 1 | 0 | 1 | 0 | 1 | 1 | 1 | 0 |
| 132~135 | 0 | 1 | 1 | 0 | 1 | 1 | 0 | 1 | 1 | 0 | 1 | 1 | 0 | 1 | 1 | 0 |
| 136~139 | 0 | 1 | 1 | 1 | 1 | 1 | 0 | 1 | 1 | 0 | 1 | 1 | 1 | 1 | 1 | 0 |
| 140~143 | 0 | 0 | 1 | 1 | 0 | 1 | 1 | 1 | 1 | 1 | 1 | 0 | 1 | 1 | 0 | 0 |
| 144~147 | 0 | 0 | 1 | 0 | 1 | 1 | 1 | 1 | 1 | 1 | 1 | 1 | 0 | 1 | 0 | 0 |
| 148~151 | 0 | 0 | 1 | 1 | 1 | 1 | 1 | 1 | 1 | 1 | 1 | 1 | 1 | 1 | 0 | 0 |
| 152~155 | 0 | 1 | 0 | 1 | 0 | 1 | 1 | 1 | 1 | 1 | 1 | 0 | 1 | 0 | 1 | 0 |
| 156~159 | 0 | 1 | 0 | 0 | 1 | 1 | 1 | 1 | 1 | 1 | 1 | 1 | 0 | 0 | 1 | 0 |
| 160~163 | 0 | 1 | 0 | 1 | 1 | 1 | 1 | 1 | 1 | 1 | 1 | 1 | 1 | 0 | 1 | 0 |
| 164~167 | 0 | 1 | 1 | 0 | 1 | 0 | 1 | 1 | 1 | 1 | 0 | 1 | 0 | 1 | 1 | 0 |
| 168~171 | 0 | 1 | 1 | 1 | 1 | 0 | 1 | 1 | 1 | 1 | 0 | 1 | 1 | 1 | 1 | 0 |
| 172~175 | 0 | 1 | 1 | 1 | 0 | 1 | 1 | 1 | 1 | 1 | 1 | 0 | 1 | 1 | 1 | 0 |
| 176~179 | 0 | 1 | 1 | 0 | 1 | 1 | 1 | 1 | 1 | 1 | 1 | 1 | 0 | 1 | 1 | 0 |
| 180~183 | 0 | 1 | 1 | 1 | 1 | 1 | 1 | 1 | 1 | 1 | 1 | 1 | 1 | 1 | 1 | 0 |
| 184~187 | 1 | 1 | 1 | 1 | 0 | 1 | 1 | 0 | 0 | 1 | 1 | 0 | 1 | 1 | 1 | 1 |
| 188~191 | 1 | 1 | 1 | 0 | 1 | 1 | 1 | 0 | 0 | 1 | 1 | 1 | 0 | 1 | 1 | 1 |
| 192~195 | 1 | 1 | 1 | 1 | 1 | 1 | 1 | 0 | 0 | 1 | 1 | 1 | 1 | 1 | 1 | 1 |
| 196~199 | 1 | 1 | 1 | 1 | 1 | 0 | 0 | 1 | 1 | 0 | 0 | 1 | 1 | 1 | 1 | 1 |
| 200~203 | 1 | 1 | 1 | 1 | 0 | 1 | 0 | 1 | 1 | 0 | 1 | 0 | 1 | 1 | 1 | 1 |
| 204~207 | 1 | 1 | 1 | 0 | 1 | 1 | 0 | 1 | 1 | 0 | 1 | 1 | 0 | 1 | 1 | 1 |
| 208~211 | 1 | 1 | 1 | 1 | 1 | 1 | 0 | 1 | 1 | 0 | 1 | 1 | 1 | 1 | 1 | 1 |
| 212~215 | 1 | 0 | 1 | 1 | 0 | 1 | 1 | 1 | 1 | 1 | 1 | 0 | 1 | 1 | 0 | 1 |
| 216~219 | 1 | 0 | 1 | 0 | 1 | 1 | 1 | 1 | 1 | 1 | 1 | 1 | 0 | 1 | 0 | 1 |
| 220~223 | 1 | 0 | 1 | 1 | 1 | 1 | 1 | 1 | 1 | 1 | 1 | 1 | 1 | 1 | 0 | 1 |
| 224~227 | 1 | 1 | 0 | 1 | 0 | 1 | 1 | 1 | 1 | 1 | 1 | 0 | 1 | 0 | 1 | 1 |
| 228~231 | 1 | 1 | 0 | 0 | 1 | 1 | 1 | 1 | 1 | 1 | 1 | 1 | 0 | 0 | 1 | 1 |
| 232~235 | 1 | 1 | 0 | 1 | 1 | 1 | 1 | 1 | 1 | 1 | 1 | 1 | 1 | 0 | 1 | 1 |
| 236~239 | 1 | 1 | 1 | 0 | 1 | 0 | 1 | 1 | 1 | 1 | 0 | 1 | 0 | 1 | 1 | 1 |
| 240~243 | 1 | 1 | 1 | 1 | 1 | 0 | 1 | 1 | 1 | 1 | 0 | 1 | 1 | 1 | 1 | 1 |
| 244~247 | 1 | 1 | 1 | 1 | 0 | 1 | 1 | 1 | 1 | 1 | 1 | 0 | 1 | 1 | 1 | 1 |
| 248~251 | 1 | 1 | 1 | 0 | 1 | 1 | 1 | 1 | 1 | 1 | 1 | 1 | 0 | 1 | 1 | 1 |
| 252~255 | 1 | 1 | 1 | 1 | 1 | 1 | 1 | 1 | 1 | 1 | 1 | 1 | 1 | 1 | 1 | 1 |

HALF TONE DISPLAY METHOD OF DISPLAY PANEL

BACKGROUND OF THE INVENTION

1. Field of the Invention

The invention relates to a half tone display method of a display panel of a matrix display system such as plasma display panel (hereinafter, referred to as a PDP), liquid crystal display panel (LCD), or the like.

2. Description of Related Art

As one of display panels of the matrix display system, a PDP of an AC (alternating current discharge) type is known.

The AC type PDP has: a plurality of column electrodes (address electrodes); and a plurality of row electrode pairs which are arranged so as to perpendicularly cross the column electrodes and in which one scanning line is formed by one pair. Each row electrode pair and column electrode are coated with a dielectric material layer for a discharge space and have a structure such that a discharge cell corresponding to one pixel is formed by a crossing point of each row electrode pair and column electrode.

As one of methods of gradation displaying the display panel of the matrix display system, there is known a method (what is called a subframe method) whereby a display period of time of one frame (one field) is divided into N subframes (subfields) which are lit up for only the time corresponding to a weight of each bit digit of pixel data of N bits and a display is performed.

According to the subframe method, for example, in the case where the pixel data consists of six bits, the display period of one frame is divided into six subframes SF0, SF1, . . . , and SF5. In this instance, in the subframes SF0 to SF5, for example, sustain discharge light emissions of 1 time, 2 times, 4 times, 8 times, 16 times, and 32 times are sequentially executed in this order. By executing one cycle of the light emission by the six subframes, a 64-gradation display for an image of one frame (one field) can be performed. Each subframe is constituted by: a resetting period of once initializing all of the discharge cells; an address period of selecting light-up cells and light-off cells by performing an address scan (data writing) based on the image data; and a sustain discharge period of sustaining a discharge light emitting state for only the light-up cells by supplying a discharge sustain pulse. The sustain discharge period of time is determined by the number of times of the sustain discharge light emission as mentioned above.

In the case that selective writing address method is employed as the address scanning scheme, at first all of the discharge cells are once reset-discharged and wall charges are formed in the resetting period and, after that, all of the cells are driven to the state of discharge light emission and initialization is performed by erasing the wall charges. Subsequently, in the address period of time, only the relevant discharge cells are selectively excited to cause the discharge light emission in accordance with the image data and the wall charges are formed. In this case, the discharge cells in which the wall charges are formed are selected as light-up cells and the discharge cells in which no wall charge is formed are selected as light-off cells.

In the case of using a selective erasing address method, at first all of the discharge cells are once reset-discharged in the resetting period of time and wall charges are formed and initialized. Subsequently, in the address period of time, the wall charges which were once formed are selectively erased and discharged in accordance with the image data, thereby erasing the wall charges. The discharge cells in which the wall charges were erased are selected as the light off cells and the discharge cells in which the wall charges remain as they are are selected as the light up cells.

According to the gradation display method, the light emitting order of the subframes SF0 to SF5 in one frame (one field) is fixed to a descending order from the longest light emitting period of time (the number of times of light emission) or an ascending order from the shortest light emitting period.

OBJECTS AND SUMMARY OF THE INVENTION

The invention is made to solve the above problems and it is an object of the invention to provide a half tone display method of a display panel which can prevent the generation of a flicker or a pseudo outline and can improve a contrast and a display picture quality.

According to the invention, there is provided a half tone display method of a display panel in which when light emission driving a display panel having a plurality of row electrodes arranged in the horizonal direction in correspondence with display lines and a plurality of column electrodes which are arranged in the vertical direction which crosses the row electrodes and form discharge cells at crossing points, a unit display period is divided into a plurality of divided periods and light emitting periods of the discharge cells which are executed in the respective divided periods are made different from each other, thereby performing a half tone display, wherein a plurality of light emitting modes in which the orders of the light emitting periods which are allocated to the divided periods are made different from each other are switched and executed every discharge cell or every discharge cell block in which a plurality of adjacent discharge cells constitute a set.

BRIEF DESCRIPTION OF THE DRAWINGS

FIG. 3 is a diagram showing an example of first and second conversion tables in the data converting circuit 3;

FIG. 4 is a diagram showing an example of the first and second conversion tables in the data converting circuit 3;

FIG. 17 is a diagram showing an example of first and second conversion tables in the data converting circuit 3;

FIG. 18 is a diagram showing an example of the first and second conversion tables in the data converting circuit 3;

FIGS. 32A to 32C are diagrams showing a transition of the correspondence between each discharge cell on the PDP screen and the light emitting modes A to D every field;

FIGS. 35A to 35H are diagrams showing another example of supply timings of drive pulses in one divided period based on the half tone display method of the invention;

FIG. 38 is a diagram showing the relation between the light emitting state and a luminance of each of the discharge cells $G_{11}$ and $G_{12}$;

FIG. 39 is a diagram showing first and second conversion tables to execute the light emission driving by the driving format shown in FIG. 37;

FIG. 44 is a diagram showing the first to fourth conversion tables which are used in a first data converting circuit 441, a second data converting circuit 442, a third data converting circuit 443, and a fourth data converting circuit 444 in the data converting circuit 3 shown in FIG. 43;

FIG. 47 is a diagram showing another example of the first and second conversion tables in the data converting circuit 3;

FIG. 48 is a diagram showing another example of the first and second conversion tables in the data converting circuit 3;

FIG. 50 is a diagram showing the first and second conversion tables to execute the light emission driving by the driving format shown in FIG. 49;

FIG. 51 is a diagram showing the first and second conversion tables to execute the light emission driving by the driving format shown in FIG. 49;

FIG. 53 is a diagram showing the first and second conversion tables to execute the light emission driving by the driving format shown in FIG. 52;

FIG. 54 is a diagram showing the first and second conversion tables to execute the light emission driving by the driving format shown in FIG. 52.

DETAILED DESCRIPTION OF THE PREFERRED EMBODIMENTS

An embodiment of the invention will now be described hereinbelow with reference to the drawings.

Figure 1:
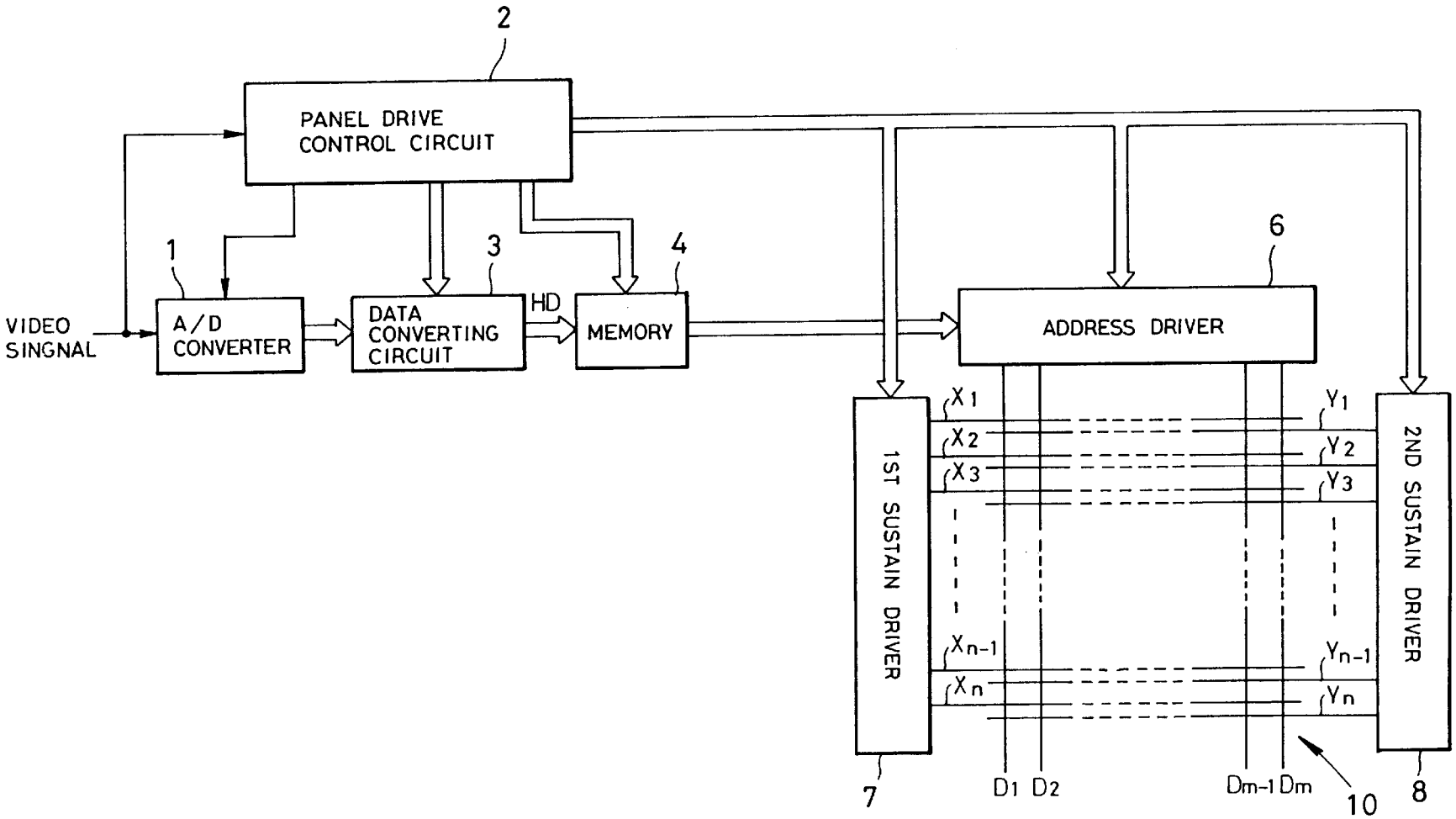
FIG. 1 is a diagram schematically showing the structure of a plasma display apparatus for driving a plasma display panel on the basis of a half tone display method according to the invention.

FIG. 1 is a diagram schematically showing the structure of a plasma display apparatus for driving a plasma display panel (hereinbelow, referred to as a PDP) as a self light emission display on the basis of a half tone display method according to the invention.

In FIG. 1, an A/D converter 1 samples a supplied analog video signal in response to a clock signal which is supplied from a panel drive control circuit 2, converts into pixel data of N bits every pixel, and supplies the pixel data to a data converting circuit 3.

Figure 2:
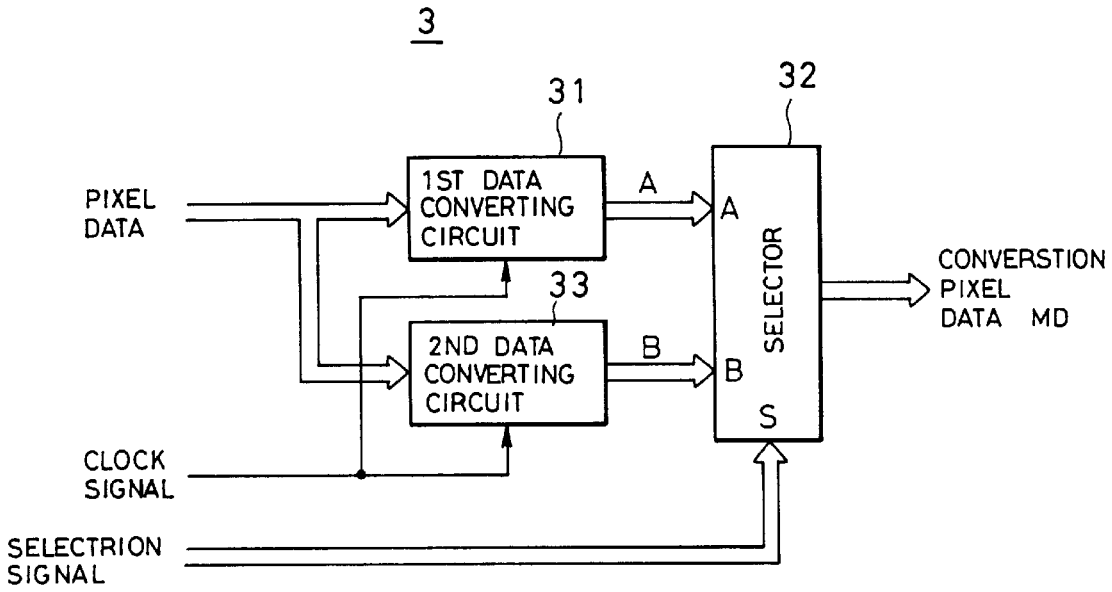
FIG. 2 is a diagram showing an example of an internal construction of a data converting circuit 3.

FIG. 2 is a diagram showing an example of an internal construction of the data converting circuit 3 which is applied to a case where the number of bits of the pixel data is equal to 6 bits.

In FIG. 2, a first data converting circuit 31 converts the 6-bit pixel data (bit 6 to bit 1) which is sequentially supplied from the A/D converter 1 into conversion pixel data A of 6 bits (bit 6 to bit 1) in accordance with a first conversion table as shown in FIGS. 3 and 4 and supplies the data A to a selector 32. A second data converting circuit 33 converts the pixel data into conversion pixel data B of 6 bits (bit 6 to bit 1) in accordance with a second conversion table as shown in FIGS. 3 and 4 and supplies the data B to the selector 32. The selector 32 selects the conversion pixel data according to a selection signal supplied from the panel drive control circuit 2 from the conversion pixel data A and B and generates the selected data as conversion pixel data HD. For example, each time the pixel data is generated from the A/D converter 1, a selection signal to alternately switch the selecting state is supplied from the panel drive control circuit 2.

Figure 5:
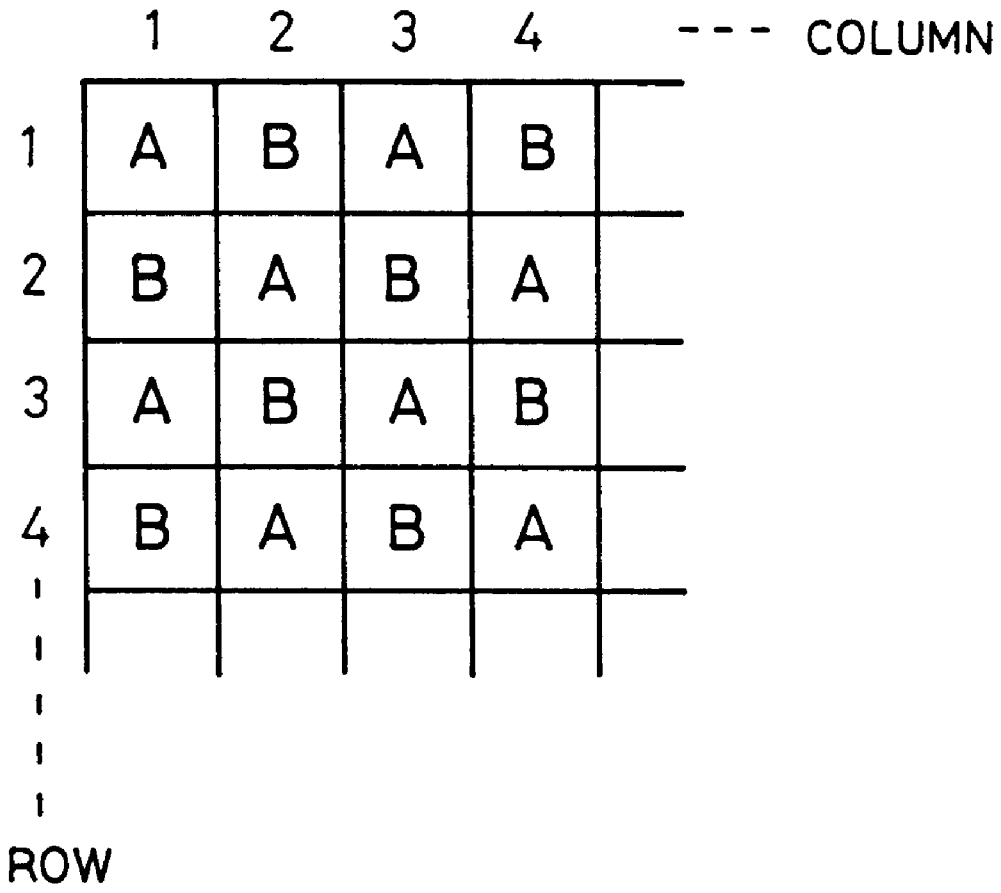
FIG. 5 is a diagram showing the correspondence among each discharge cell on a PDP screen and light emitting modes A and B.

FIG. 5 is a diagram showing to which one of the conversion pixel data A and B the pixel data corresponding to each pixel on the screen has been converted in accordance with the selection switching operation.

In FIG. 5, the data converting circuit 3 first converts the pixel data corresponding to the pixel of the first row and the first column of the screen into the conversion pixel data A on the basis of the first conversion table and generates the data A as conversion pixel data HD. The data converting circuit 3, subsequently, converts the pixel data corresponding to the pixel of the first row and the second column of the screen into the conversion pixel data B on the basis of the second conversion table and generates the data B as conversion pixel data HD. The data converting circuit 3 similarly sequentially converts the pixel data corresponding to the first row by alternately using the first and second conversion tables. The data converting circuit 3 subsequently converts the pixel data corresponding to the pixels of the second row and the first column into the conversion pixel data B on the basis of the second conversion table and generates the data B as conversion pixel data HD. The data converting circuit 3 further converts the pixel data corresponding to the pixels of the second row and the second column into the conversion pixel data A on the basis of the first conversion table and generates the data A as conversion pixel data HD. The data converting circuit 3 likewise sequentially converts each pixel data corresponding to the second row by alternately using the second and first conversion tables.

A memory 4 shown in FIG. 1 sequentially writes the conversion pixel data HD in accordance with writing signals which are supplied from the panel drive control circuit 2.

Each time the writing operation of conversion pixel data $HD_{11}$ to $HD_{nm}$ of one screen (n rows, m columns) in a PDP 10 is finished, the memory 4 sequentially reads out the data bits of the bit digit corresponding to the divided period in accordance with the display order of the divided periods in response to a read control signal which is supplied from the panel drive control circuit 2. When pixel data bit groups comprising data bits of the same bit digit of a pixel data bit group of one screen (n rows, m columns) corresponding to each divided period (conversion pixel data $HD_{11}$ to $HD_{nm}$ of one screen) are supplied to an address driver 6, the memory 4 sequentially supplies them to the address driver 6 every row of the screen.

The address driver 6 generates pixel data pulses $DP_1$ to $DP_m$ each having a voltage corresponding to a bit logic value of each of the pixel data bit groups of one row supplied from the memory 4 and supplies them to column electrodes $D_1$ to $D_m$ of the PDP 10, respectively. The address driver 6 further generates address pulses $AP_{EV}$ and $AP_{OD}$ (which will be explained later) and supplies them to the column electrodes $D_1$ to $D_m$ of the PDP 10, respectively.

In addition to the clock signal, conversion control signal, writing signal, and reading signal as mentioned above, the panel drive control circuit 2 generates a pixel data timing signal, a reset timing signal, a scan timing signal, a sustain timing signal, and an erasing timing signal synchronously with horizontal and vertical sync signals in the video signal, respectively.

In response to various timing signals supplied from the panel drive control circuit 2, a first sustain driver 7 generates a reset pulse to initialize a residual charge amount, a scanning pulse to write the pixel data, a sustain pulse to maintain a discharge light emitting state, and an erasing pulse to stop the discharge light emission and supplies them to row electrodes $X_1$ to $X_n$ of the PDP 10. In response to various timing signals supplied from the panel drive control circuit 2, a second sustain driver 8 generates a reset pulse to initialize a residual charge amount, a scanning pulse to write the pixel data, a sustain pulse to maintain a discharge light emitting state, and an erasing pulse to stop the discharge light emission and supplies them to row electrodes $Y_1$ to $Y_n$ of the PDP 10.

The PDP 10 forms the row electrodes corresponding to one row of the screen by a pair of row electrode X and row electrode Y. For example, the row electrode pair of the first row in the PDP 10 is the row electrodes $X_1$ and $Y_1$ and the row electrode pair of the n-th row is the row electrodes $X_n$ and $Y_n$. In the PDP 10, one discharge cell is formed in a crossing portion of the row electrode pair and each column electrode.

When the scanning pulse Is supplied to any one of the row electrode pairs $(X_1, Y_1)$ to $(X_n, Y_n)$ while the pixel data pulse DP is supplied to each of the column electrodes of the PDP 10, the wall charges corresponding to the pulse voltage of each of the pixel data pulses $DP_1$ to $DP_m$ are formed in each discharge cell of the crossing portion of the row electrode pair and each of the column electrodes $D_1$ to $D_m$. After that, when the sustain pulses are supplied to the row electrode pairs $(X_1, Y_1)$ to $(X_n, Y_n)$, only the discharge cells in which the wall charges are formed start to light up and maintain the light emitting state for only the time corresponding to the number of sustain pulses. On the sense of sight, the luminance is recognized by the light emission sustain period of time during which the light emitting state is maintained.

The driving operation of the PDP 10 which is executed by the plasma display apparatus as shown in FIG. 1 will now be described.

An example of the light emission driving such that the one frame (field) period which is required for image display is divided into subframes SF0 to SF5 for discharge light emitting the discharge cells for different light emitting periods of time and a half tone display of 64 gradations is executed will now be described.

In this instance, now assuming that the light emitting period in the subframe SF0 is equal to "1", the period of time of the light emission which is executed in each subframe is as follows.

SF0:1
SF1:2
SF2:4
SF3:8
SF4:16
SF5:32

Figure 6:
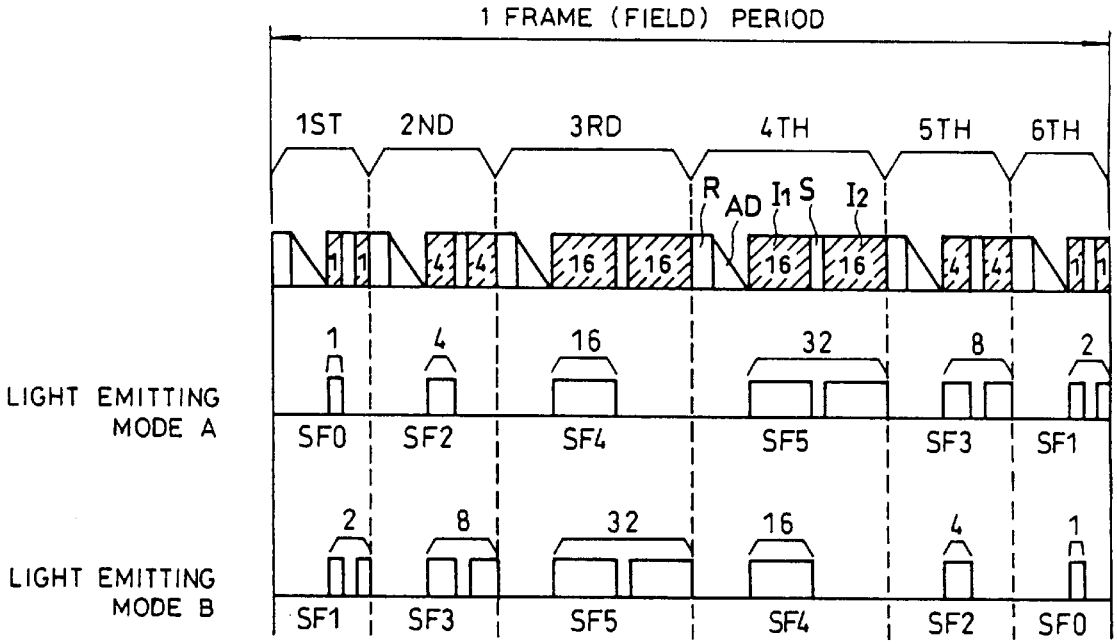
FIG. 6 is a diagram showing an example of a light emission driving format based on the half tone display method of the invention.
Figures 7A, 7B, 7C, 7D, 7E, 7F, 7G, 7H:
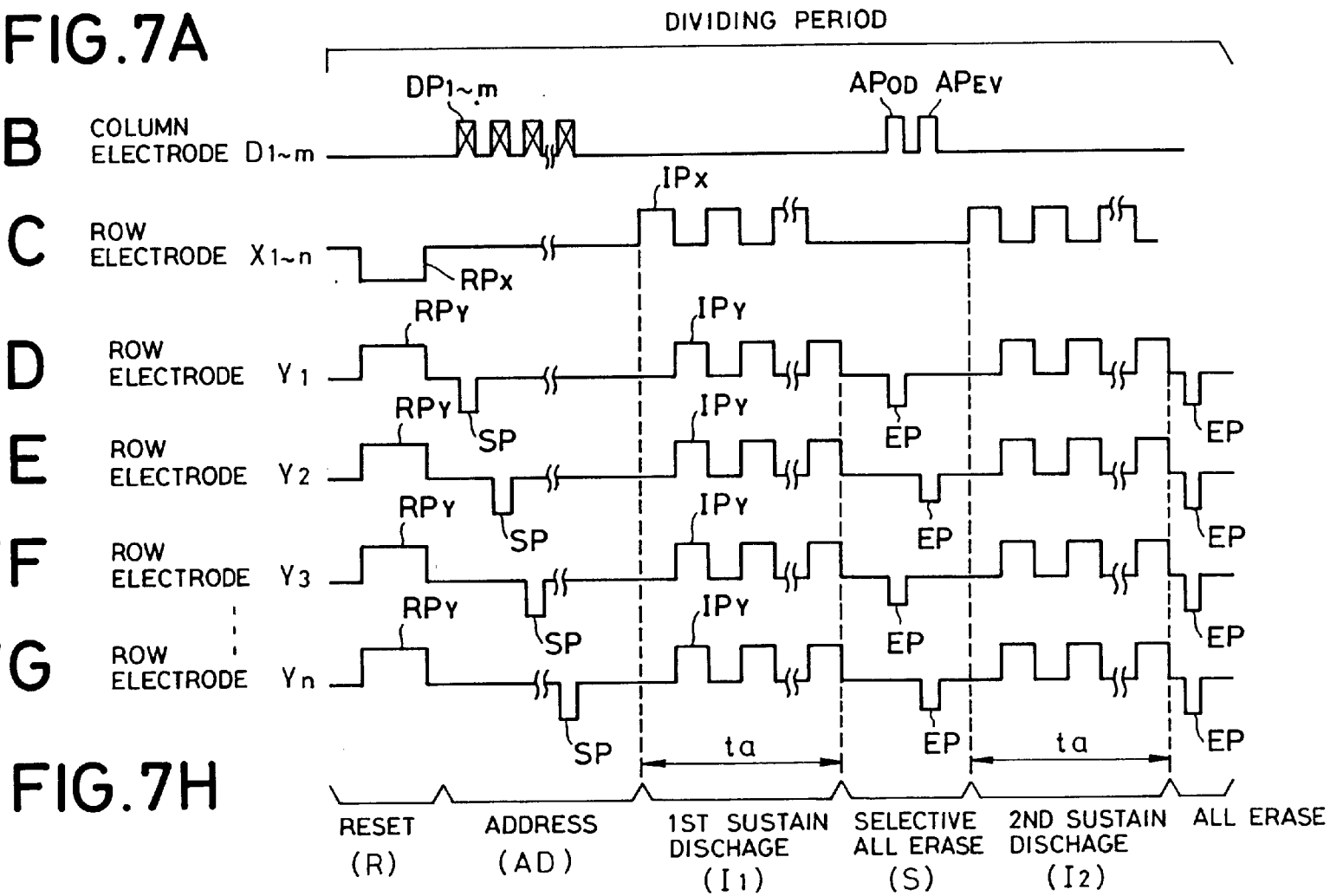
FIGS. 7A to 7H are diagrams showing supply timings of drive pulses in one divided period based on the half tone display method of the invention.
Figures 8A, 8B, 8C, 8D, 8E, 8F, 8G, 8H:
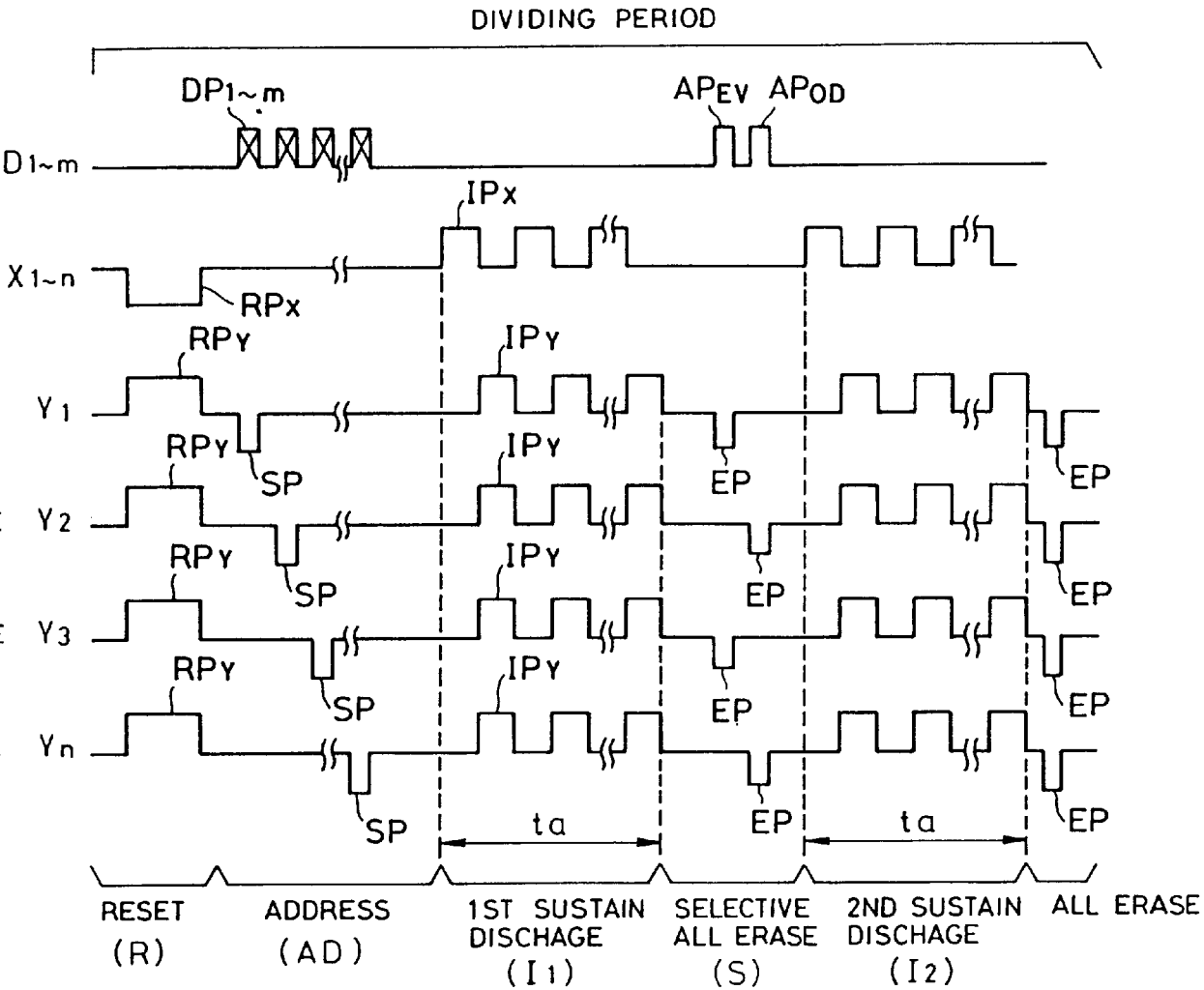
FIGS. 8A to 8H are diagrams showing supply timings of drive pulses in one divided period based on the half tone display method of the invention.

FIG. 6 is a diagram showing an example of a light emission driving format indicative of the light emission driving state by each of the subframes SF0 to SF5.

In the light emission driving format shown in FIG. 6, the one frame (field) period is divided into six divided periods comprising the first to sixth divided periods. In each divided period, further, each of a resetting operation R, an address operation AD, a first sustain discharging operation $I_1$, a selective erasing operation S, and a second sustain discharging operation $I_2$, which will be explained later, is executed.

FIGS. 7A to 7H are diagrams showing supply timings of various drive pulses which are supplied to the electrodes of the PDP 10 in the divided periods of time of the former half portion in one frame (field) period, namely, in each of the first to third divided periods in FIG. 6.

In FIGS. 7A to 7H, first, the first sustain driver 7 and second sustain driver 8 simultaneously supply reset pulses $RP_X$ and $RP_Y$ to the row electrodes X and Y of the PDP 10, form wall charges into the discharge cells in the PDP 10, and perform an initialization (resetting operation R).

The address driver 6 supplies the data pulses $DP_1$ to $DP_m$ corresponding to each row to the column electrodes $D_1$ to $D_m$. For example, the data pulses $DP_1$ to $DP_m$ corresponding to the first row are supplied to the column electrodes $D_1$ to $D_m$. Subsequently, the data pulses $DP_1$ to $DP_m$ corresponding to the second row are supplied to the column electrodes $D_1$ to $D_m$. Further, the data pulses $DP_1$ to $DP_m$ corresponding to the third row are supplied to the column electrodes $D_1$ to $D_m$. The second sustain driver 8 sequentially supplies the scanning pulse SP to the row electrodes $Y_1$ to $Y_n$ at the same timings as the supply timings of the data pulses DP. In this instance, the wall charges formed in the discharge cells of the crossing point of the "row" to which the scanning pulse SP was supplied and the "column" to which the pixel data pulse of a high voltage was supplied are selectively erased (address operation AD). By the address operation, a light-up discharge cell which is discharge excited in a sustain discharging operation, which will be explained later, and a light-off discharge cell in which the discharge light emission is not performed are obtained.

Subsequently, the first sustain driver 7 and second sustain driver 8 alternately supply sustain pulses $IP_X$ and $IP_Y$ to the row electrodes X and Y. In this instance, each time the sustain pulses $IP_X$ and $IP_Y$ are alternately supplied, the discharge cell in which the wall charges were formed, namely, the light-up discharge cell executes the light emission discharge by the address operation and maintains the light emission discharging state (first sustain discharging operation $I_1$).

A discharge sustain period $t_a$ in the first sustain discharging operation differs in dependence on each divided period. That is, The discharge sustain period $t_a$ in the first divided period=1 (equation 1)

The discharge sustain period $t_a$ in the second divided period=4 (equation 2)

The discharge sustain period $t_a$ in the third divided period=16 (equation 3)

Subsequently, the address driver 6 supplies the address pulse $AP_{OD}$ to each of the odd number designated column electrodes in the column electrodes $D_1$ to $D_m$. At the same timings as the supply timings of the address pulse $AP_{OD}$, the second sustain driver 8 supplies an erasing pulse EP to the odd number designated row electrodes $Y_1, Y_3, Y_5, Y_7, \ldots$. In accordance with this operation, the wall charges of all of the discharge cells existing in the crossing portions of the odd number designated "column electrodes" and the odd number designated "row electrode pairs" are extinguished. The address driver 6 supplies the address pulse $AP_{EV}$ to each of the even number designated column electrodes in the column electrodes $D_1$ to $D_m$. At the same timings as the supply timings of the address pulse $AP_{EV}$, the second sustain driver 8 supplies the erasing pulse EP to the even number designated row electrodes $Y_2, Y_4, Y_6, Y_8, \ldots$. In accordance with this operation, the wall charges of all of the discharge cells existing in the crossing portions of the even number designated "column electrodes" and the even number designated "row electrode pairs" are extinguished (selective all erasing operation S).

That is, the wall charges formed in all of the discharge cells existing in the odd columns and odd rows and all of the discharge cells existing in the even columns and even rows are extinguished and those discharge cells become the light-off discharge cells. That is, by executing the selective all erasing operation, the discharge cells shown by "A" in FIG. 5 become the light-off discharge cells. In this instance, the wall charges remain in each of the discharge cells shown by "B" in FIG. 5.

The first sustain driver 7 and second sustain driver 8 subsequently alternately supply the sustain pulses $IP_X$ and $IP_Y$ to the row electrodes X and Y of the PDP 10. In this instance, each time the sustain pulses $IP_X$ and $IP_Y$ are alternately supplied, the light-up discharge cell in which the wall charges remain performs the light emission discharge and maintains the light emission discharging state (second sustain discharging operation $I_2$). The discharge sustain period in the second sustain discharging operation is the same as the discharge sustain period $t_a$ in the first sustain discharging operation.

That is, by executing the second sustain discharging operation, each of the discharge cells shown by "B" in FIG. 5 subsequently executes the light emission discharge for the period of time of the discharge sustain period $t_a$. That is, in the first to third divided periods, the light emitting period in each of the discharge cells shown by "B" in FIG. 5 is twice as long as the light emitting period of each of the discharge cells shown by "A" in FIG. 5.

When the second sustain discharging operation is finished, the second sustain driver 8 supplies the erasing pulse EP to all of the row electrodes $Y_1$ to $Y_n$. In accordance with this operation, the wall charges in all of the discharge cells existing in the crossing portions of the "column electrodes" and the even number designated "row electrode pairs" are extinguished and those discharge cells become the light-off discharge cells (all erasing operation).

In each of the first to third divided periods, therefore, each of the discharge cells shown by "A" in FIG. 5 is light emission driven by the light emitting pattern shown in the light emitting mode A in FIG. 6 and each of the discharge cells shown by "B" in FIG. 5 is light emission driven by the light emitting pattern shown in the light emitting mode B in FIG. 6.

In the divided periods of the latter half portion in one frame, namely, in each of the fourth to sixth divided periods, various drive pulses are supplied to the electrodes of the PDP 10 as shown in FIGS. 8A to 8H.

In FIGS. 8A to 8H, first, the first sustain driver 7 and second sustain driver 8 simultaneously supply the reset pulses $RP_X$ and $RP_Y$ to the row electrodes X and Y of the PDP 10, form the wall charges in each discharge cell in the PDP 10, and perform the initialization (resetting operation R).

Subsequently, the address driver 6 supplies the data pulses $DP_1$ to $DP_m$ corresponding to each row to the column electrodes $D_1$ to $D_m$. For example, the data pulses $DP_1$ to $DP_m$ corresponding to the first row are supplied to the column electrodes $D_1$ to $D_m$. Subsequently, the data pulses $DP_1$ to $DP_m$ corresponding to the second row are supplied to the column electrodes $D_1$ to $D_m$. Further, the data pulses $DP_1$ to $DP_m$ corresponding to the third row are supplied to the column electrodes $D_1$ to $D_m$. The second sustain driver 8 sequentially supplies the scanning pulse SP to the row electrodes $Y_1$ to $Y_n$ at the same timings as the supply timings of the data pulses DP. In this instance, the wall charges formed in the discharge cells of the crossing points of the "row" to which the scanning pulse SP was supplied and the "column" to which the pixel data pulse of a high voltage was supplied are selectively erased (address operation AD). By the address operation, a light-up discharge cell which is discharge excited in the sustain discharging operation, which will be explained later, and a light-off discharge cell in which the discharge light emission is not performed are obtained.

Subsequently, the first sustain driver 7 and second sustain driver 8 alternately supply the sustain pulses $IP_X$ and $IP_Y$ to the row electrodes X and Y. In this instance, each time the sustain pulses $IP_X$ and $IP_Y$ are alternately supplied, the discharge cell in which the wall charges were formed, namely, the light-up discharge cell executes the light emission discharge by the address operation and maintains the light emission discharging state (first sustain discharging operation $I_1$).

The discharge sustain period $t_a$ in the first sustain discharging operation differs in dependence on each divided period.

That is,

The discharge sustain period $t_a$ in the fourth divided period=16 (equation 4)

The discharge sustain period $t_a$ in the fifth divided period=4 (equation 5)

The discharge sustain period $t_a$ in the sixth divided period=1 (equation 6)

Subsequently, the address driver 6 supplies the address pulse $AP_{EV}$ to each of the even number designated column electrodes in the column electrodes $DP_1$ to $D_m$. At the same timings as the supply timings of the address pulse $AP_{EV}$, the second sustain driver 8 supplies the erasing pulse EP to the odd number designated row electrodes $Y_1, Y_3, Y_5, Y_7, \ldots$. In accordance with this operation, the wall charges of all of the discharge cells existing in the crossing portions of the even number designated "column electrodes" and the odd number designated "row electrode pairs" are extinguished. The address driver 6 supplies the address pulse $AP_{OD}$ to each of the odd number designated column electrodes in the column electrodes $D_1$ to $D_m$. At the same timings as the supply timings of the address pulse $AP_{OD}$, the second sustain driver 8 supplies the erasing pulse EP to the even number designated row electrodes $Y_2, Y_4, Y_6, Y_8, \ldots$. In accordance with this operation, the wall charges of all of the discharge cells existing in the crossing portions of the odd number designated "column electrodes" and the even number designated "row electrode pairs" are extinguished (selective all erasing operation S).

That is, the wall charges formed in all of the discharge cells existing in the odd columns and even rows and all of the discharge cells existing in the even columns and odd rows are extinguished and those discharge cells become the light-off discharge cells. That is, by executing the selective all erasing operation, all of the discharge cells shown by "B" in FIG. 5 become the light-off discharge cells. In this instance, the wall charges remain in each of the discharge cells shown by "A" in FIG. 5.

The first sustain driver 7 and second sustain driver 8 subsequently alternately supply the sustain pulses $IP_X$ and $IP_Y$ to the row electrodes X and Y of the PDP 10. In this instance, each time the sustain pulses $IP_X$ and $IP_Y$ are alternately supplied, the discharge cell in which the wall charges remain performs the light emission discharge and maintains the light emission discharging state (second sustain discharging operation $I_2$). The discharge sustain period in the second sustain discharging operation is the same as the discharge sustain period $t_a$ in the first sustain discharging operation.

That is, by executing the second sustain discharging operation, each of the discharge cells shown by "A" in FIG. 5 subsequently executes the light emission discharge for the period of time of the discharge sustain period $t_a$. That is, in the fourth to sixth divided periods, the light emitting period in each of the discharge cells shown by "A" in FIG. 5 is twice as long as the light emitting period of each of the discharge cells shown by "B" in FIG. 5.

When the second sustain discharging operation is finished, the second sustain driver 8 supplies the erasing pulse EP to all of the row electrodes $Y_1$ to $Y_n$. In accordance with this operation, the wall charges in all of the discharge cells existing in the crossing portion of the "column electrodes" and the even number designated "row electrode pairs" are extinguished (all erasing operation).

In each of the fourth to sixth divided periods, therefore, each of the discharge cells shown by "A" in FIG. 5 is light emission driven by the light emitting pattern shown in the light emitting mode A in FIG. 6 and each of the discharge cells shown by "B" in FIG. 5 is light emission driven by the light emitting pattern shown in the light emitting mode B in FIG. 6.

In the divided periods (first to third divided periods) of the former half portion in one frame period, by supplying the drive pulses as shown in FIGS. 7A to 7H to the PDP 10, and in the divided periods (fourth to sixth divided periods) of the latter half portion, by supplying the drive pulses as shown in FIGS. 8A to 8H to the PDP 10, the adjacent discharge cells can be light emitted by the different light emitting patterns.

For example, each of the discharge cells shown by "A" in FIG. 5 is light emission driven by the light emitting pattern by the light emitting mode A in FIG. 6. Each of the discharge cells shown by "B" is light emission driven by the light emitting pattern by the light emitting mode B in FIG. 6.

In this instance, in the light emitting pattern by the light emitting mode A, as shown in FIG. 6, the light emitting period which is executed for the first divided period is equal to "1" and it corresponds to the subframe SF0. In the light emitting mode A, the light emitting period which is executed for the second divided period is equal to "4" and it corresponds to the subframe SF2. In the light emitting mode A, the light emitting period which is executed for the third divided period is equal to "16" and it corresponds to the subframe SF4. In the light emitting mode A, the light emitting period which is executed for the fourth divided period is equal to "32" and it corresponds to the subframe SF5. In the light emitting mode A, the light emitting period which is executed for the fifth divided period is equal to "8" and it corresponds to the subframe SF3. In the light emitting mode A, the light emitting period which is executed for the sixth divided period is equal to "2" and it corresponds to the subframe SF1.

A logic value of each bit of the conversion pixel data converted by the first or second conversion table as shown in FIGS. 3 and 4 decides whether the light-up operation is executed in each of the first to sixth divided periods or not.

For example, when the logic value of bit 6 of the conversion pixel data is equal to "0", the light emission in the first divided period shown in FIG. 6 is not executed in any one of the light emitting modes A and B. When the logic value of bit 6 of the conversion pixel data is equal to "1", the light emission of the light emitting period "1" (SF0) is performed in the light emitting mode A and the light emission of the light emitting period "2" (SF1) is executed in the light emitting mode B. when the logic value of bit 5 of the conversion pixel data is equal to "0", the light emission in the second divided period shown in FIG. 6 is not executed in the light emitting modes A and B. When the logic value of bit 5 of the conversion pixel data is equal to "1", the light emission of the light emitting period "4" (SF2) is performed in the light emitting mode A and the light emission of the light emitting period "8" (SF3) is executed in the light emitting mode B. When the logic value of bit 4 of the conversion pixel data is equal to "0", the light emission in the third divided period shown in FIG. 6 is not executed in the light emitting modes A and B. When the logic value of bit 4 of the conversion pixel data is equal to "1", the light emission of the light emitting period "16" (SF4) is performed in the light emitting mode A and the light emission of the light emitting period "32" (SF5) is executed in the light emitting mode B. When the logic value of bit 3 of the conversion pixel data is equal to "0", the light emission in the fourth divided period shown in FIG. 6 is not performed in both of the light emitting modes A and B. When the logic value of bit 3 of the conversion pixel data is equal to "1", the light emission of the light emitting period "32" (SF5) is performed in the light emitting mode A and the light emission of the light emitting period "16" (SF4) is executed in the light emitting mode B. When the logic value of bit 2 of the conversion pixel data is equal to "0", the light emission in the fifth divided period shown in FIG. 6 is not performed in both of the light emitting modes A and B. When the logic value of bit 2 of the conversion pixel data is equal to "1", the light emission of the light emitting period "8" (SF3) is performed in the light emitting mode A and the light emission of the light emitting period "4" (SF2) is executed in the light emitting mode B. When the logic value of bit 1 of the conversion pixel data is equal to "0", the light emission in the sixth divided period shown in FIG. 6 is not performed in both of the light emitting modes A and B. When the logic value of bit 1 of the conversion pixel data is equal to "1", the light emission of the light emitting period "2" (SF1) is performed in the light emitting mode A and the light emission of the light emitting period "1" (SF0) is executed in the light emitting mode B.

In the light emitting mode A or B, the sum of the light emitting periods in the first to sixth divided periods corresponds to the luminance level.

For example, as shown in FIG. 3, when the pixel data "010001" corresponding to the half tone level "17" is converted by the first conversion table, Conversion pixel data "101000" is obtained. When it is converted by the second conversion table, Conversion pixel data "000101" is obtained.

In this instance, the light emission driving based on the light emitting mode A shown in FIG. 6 is performed for the conversion pixel data "101000" converted by the first conversion table. The light emission driving based on the light emitting mode B shown in FIG. 6 is executed for the conversion pixel data "000101" converted by the second conversion table.

The light emitting patterns which are executed in one frame period, therefore, are as follows.

| | 1st | 2nd | 3rd | 4th | 5th | 6th |
|---|---|---|---|---|---|---|
| Light emitting mode A | ON (SFO) | OFF | ON (SF4) | OFF | OFF | OFF |
| Light emitting mode B | OFF | OFF | OFF (SF4) | ON | OFF | ON (SF0) |

That is, although the light-up patterns which are executed for one frame period in both of the light emitting modes A and B are different, the sum of the light emitting periods which are executed for one frame period in each mode is equal to $$SF0+SF4=\text{“17”} \quad \text{(equation 7)}$$

In each of the discharge cells shown by "A" in FIG. 5 and the discharge cells "B" adjacent to the discharge cells "A", therefore, although the light emission corresponding to the same half tone luminance is executed, the light emitting patterns which are executed in one frame period are different.

According to the half tone display method, consequently, since the adjacent discharge cells perform the light emissions by the different light emitting patterns, the pseudo outline is reduced.

As shown in FIG. 6, all of the light emitting patterns in the light emitting mode A are {SF0, SF2, SF4, SF5, SF3, SF1} and all of the light emitting patterns in the light emitting mode B are

{SF1, SF3, SF5, SF4, SF2, SF0}

That is, in the light emitting patterns in the light emitting mode A and the light emitting patterns in the light emitting mode B, the orders of executing the subframes SF are opposite.

Since the orders of the subframes which are executed in one frame period are opposite as for both of the light emitting patterns, the pseudo outline can be more effectively reduced.

Figure 9:
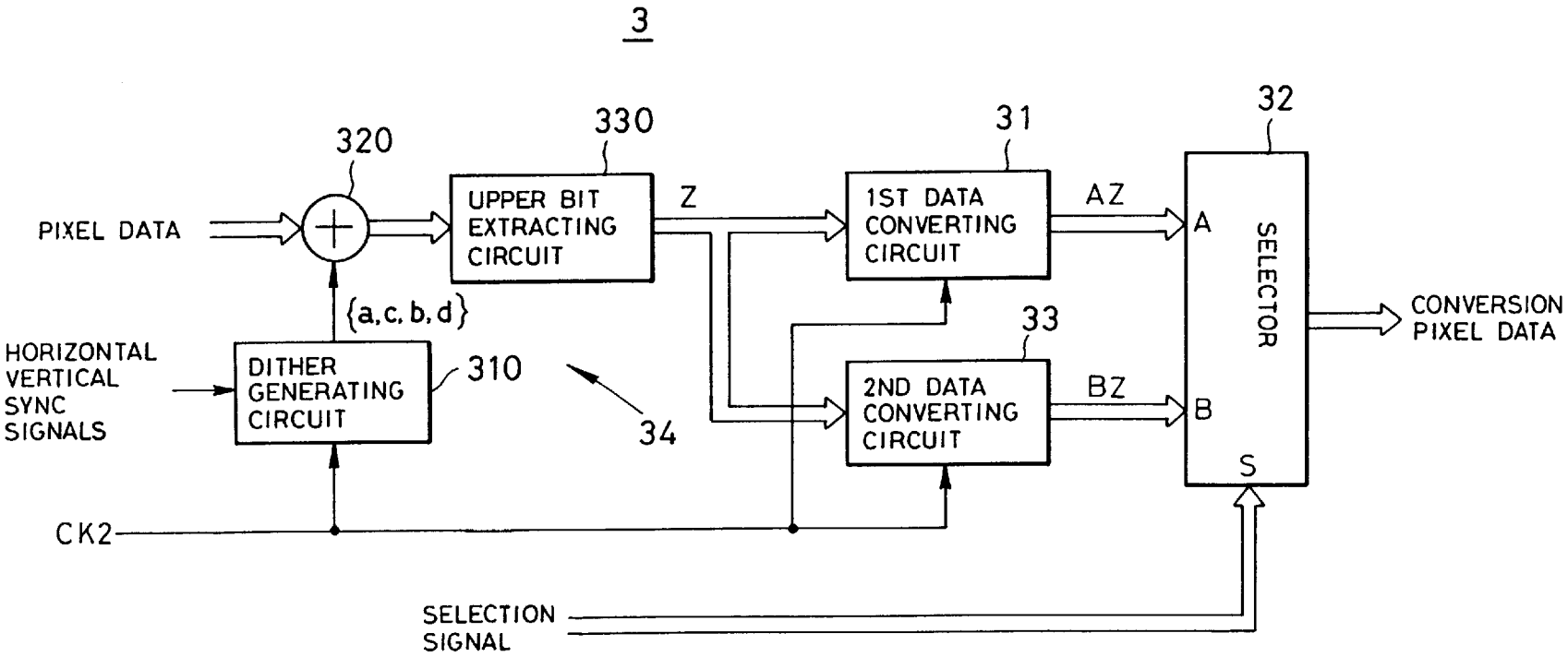
FIG. 9 is a diagram showing another example of an internal construction of the data converting circuit 3.
Figure 10:
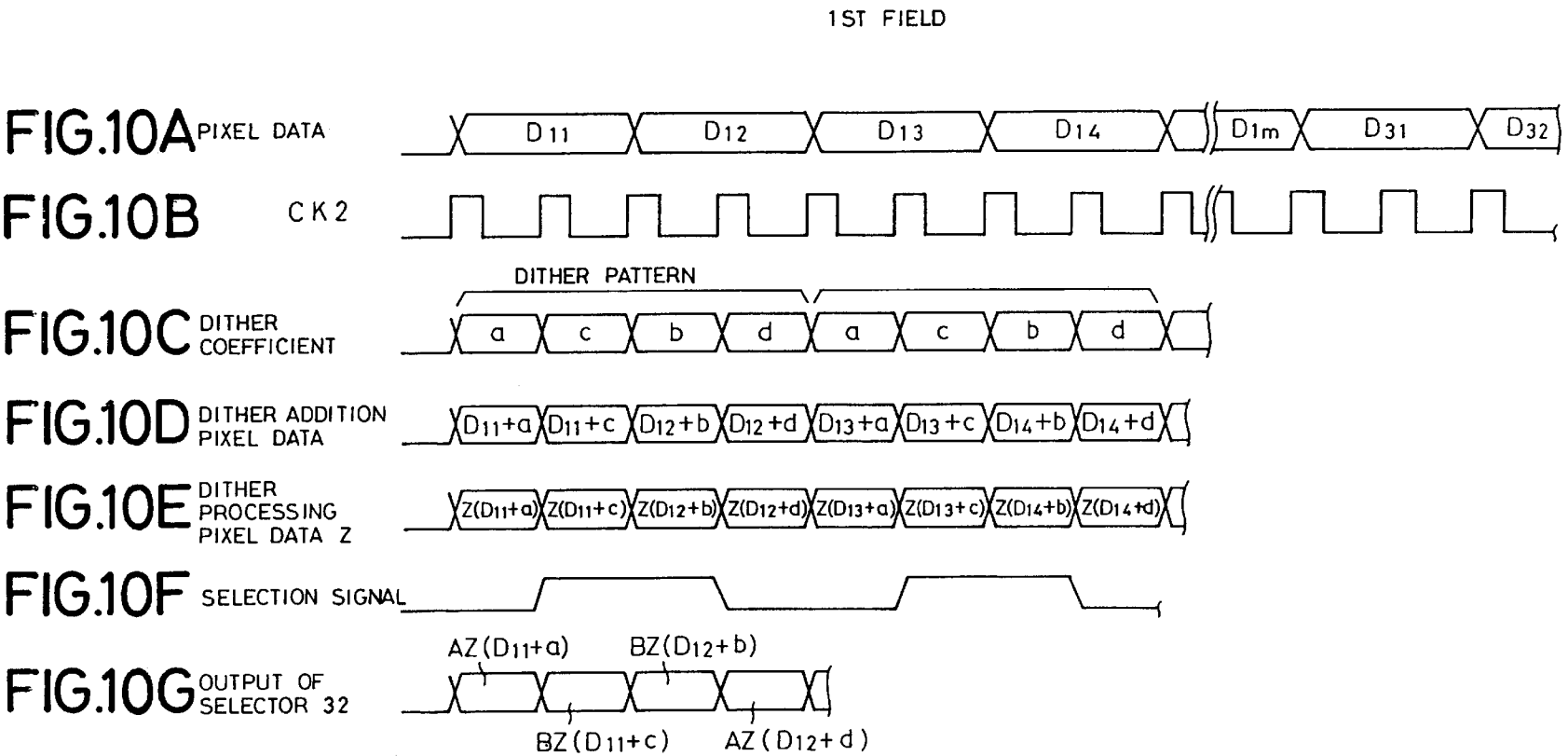
FIGS. 10A to 10G are diagrams showing internal operation waveforms in the first field in a dither processing circuit 34.
Figure 11:
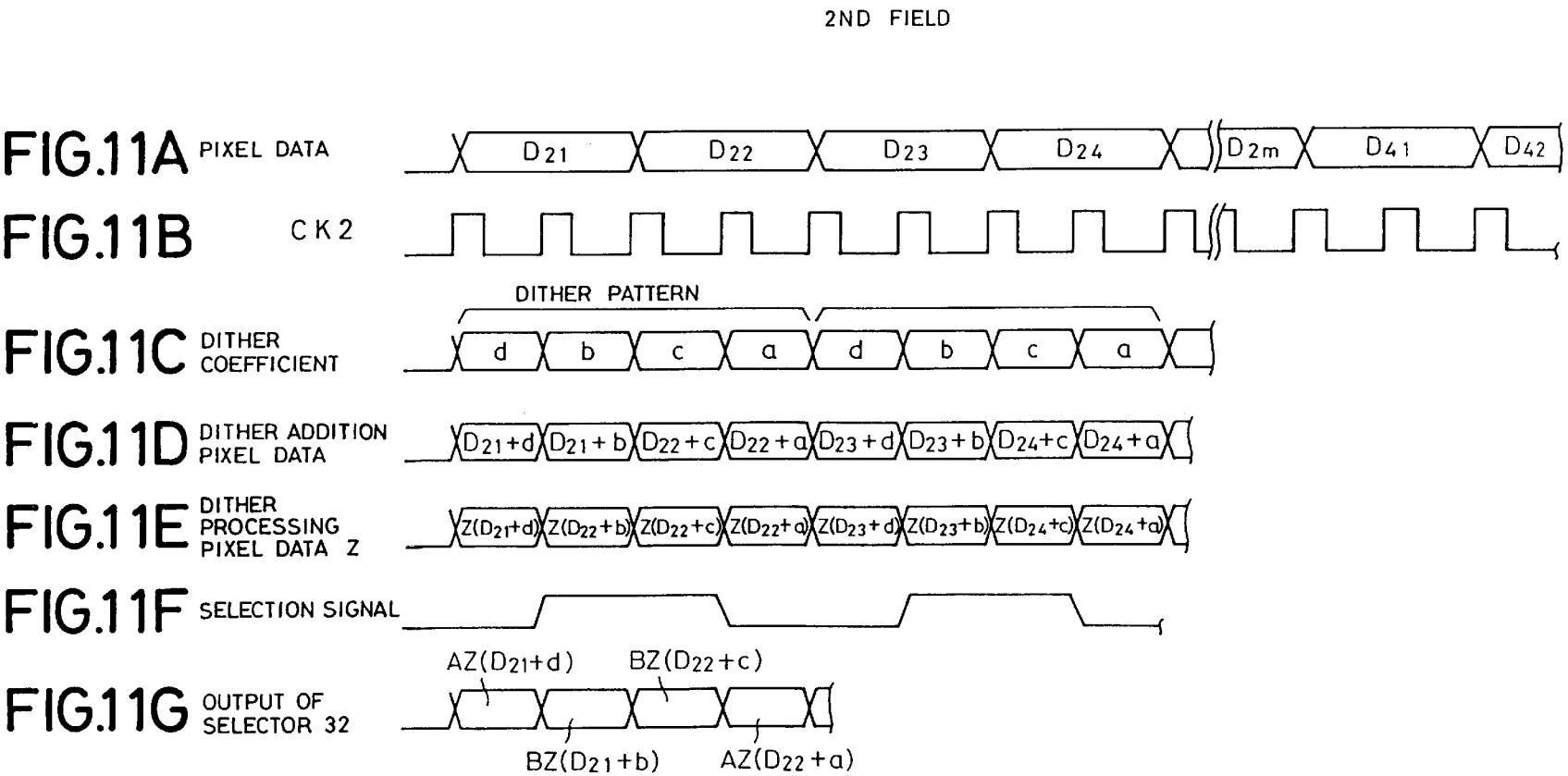
FIGS. 11A to 11G are diagrams showing internal operation waveforms in the second field in the dither processing circuit 34.
Figure 12:
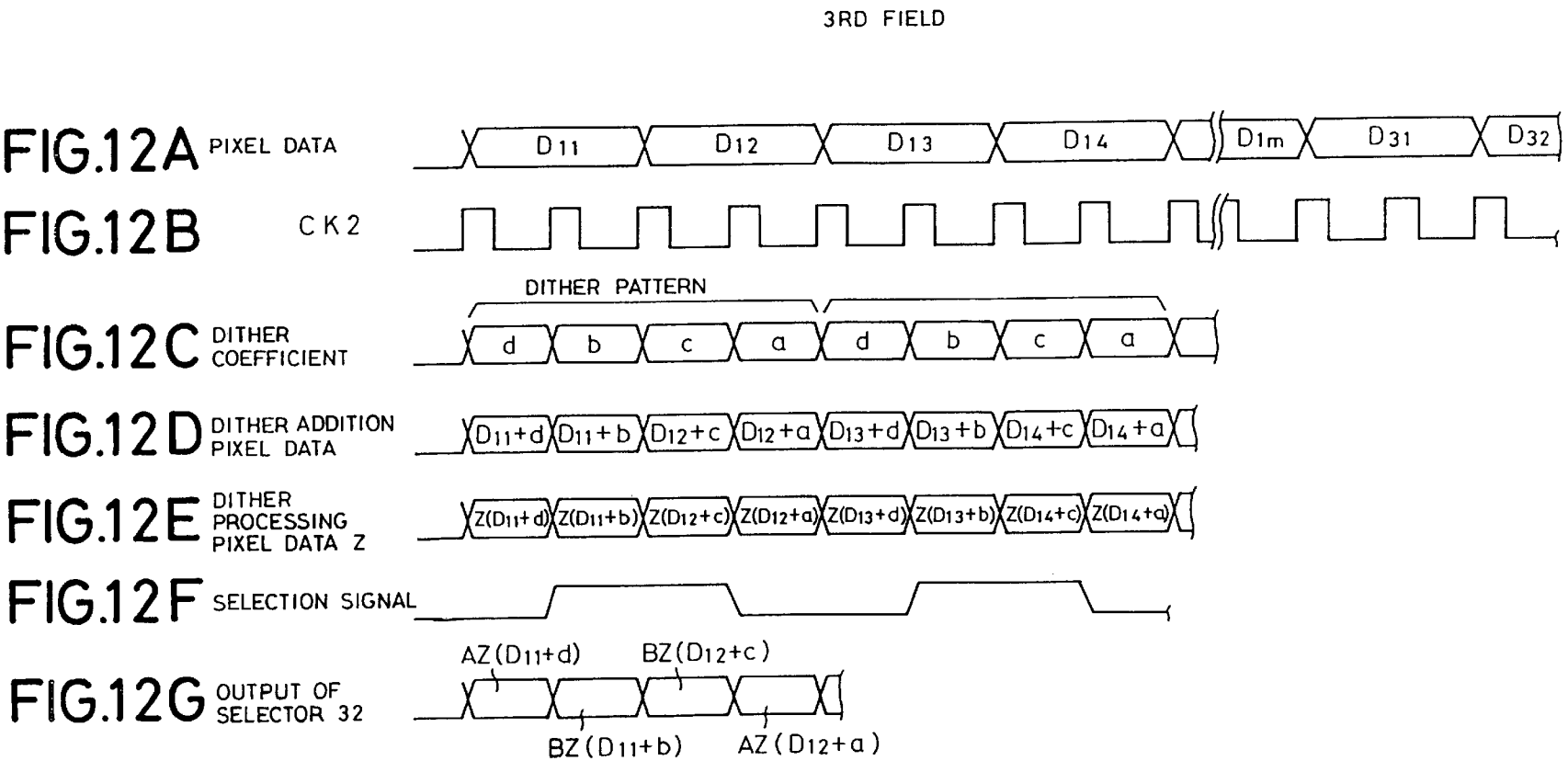
FIGS. 12A to 12G are diagrams showing internal operation waveforms in the third field in the dither processing circuit 34.
Figure 13:
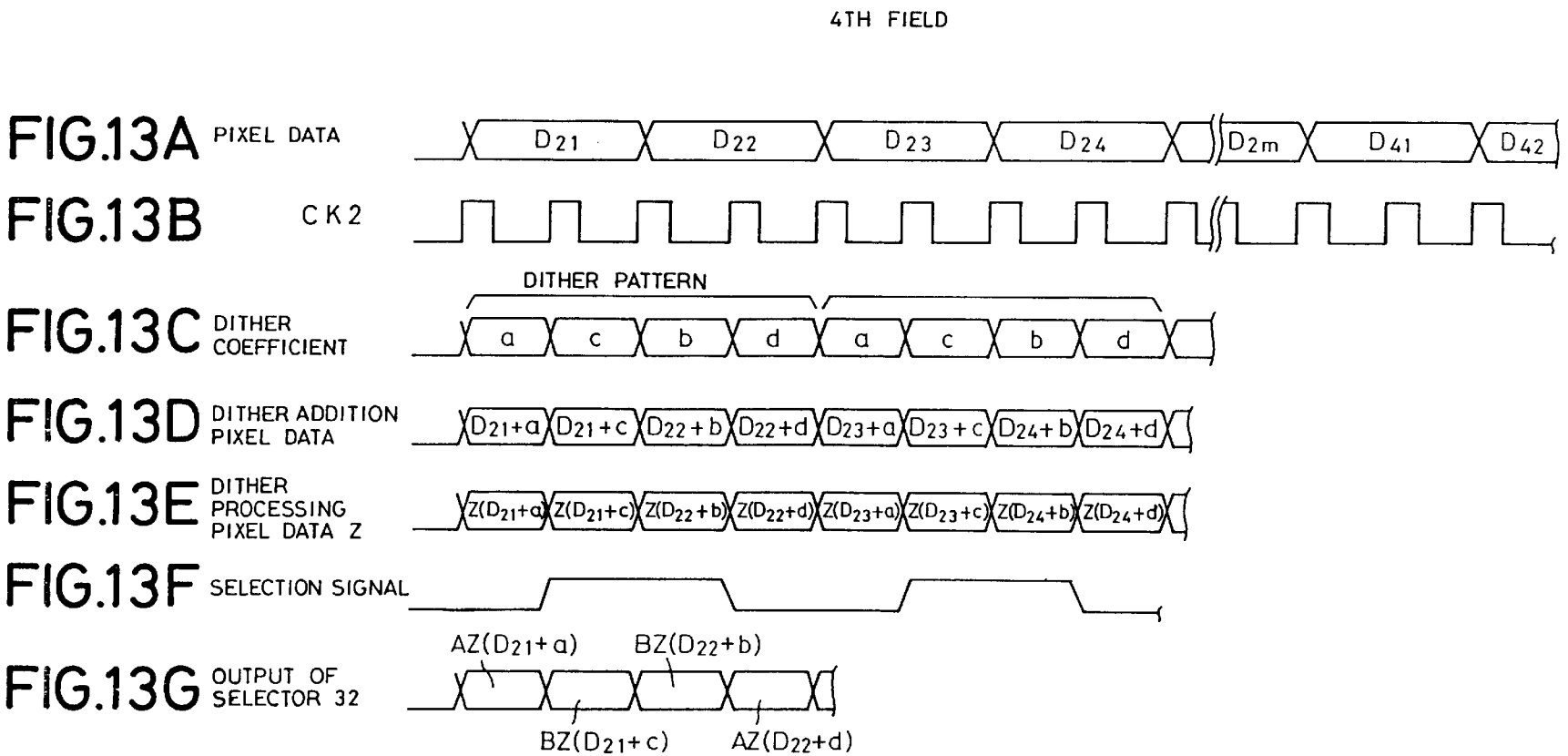
FIGS. 13A to 13G are diagrams showing internal operation waveforms in the fourth field in the dither processing circuit 34.

In the embodiment, although the intermediate luminance gradations according to the number of bits of the pixel data are obtained, by adding a dither processing circuit to it, intermediate luminance gradations larger than the gradations corresponding to the number of bits of the pixel data can be falsely obtained. FIG. 9 is a diagram showing another construction of the data converting circuit 3 realized in consideration of the above point.

In the data converting circuit 3 shown in FIG. 9, a dither processing circuit 34 comprising a dither generating circuit 310, an adder 320, and an upper bit extracting circuit 330 is further added to the construction shown in FIG. 2.

Figure 14:
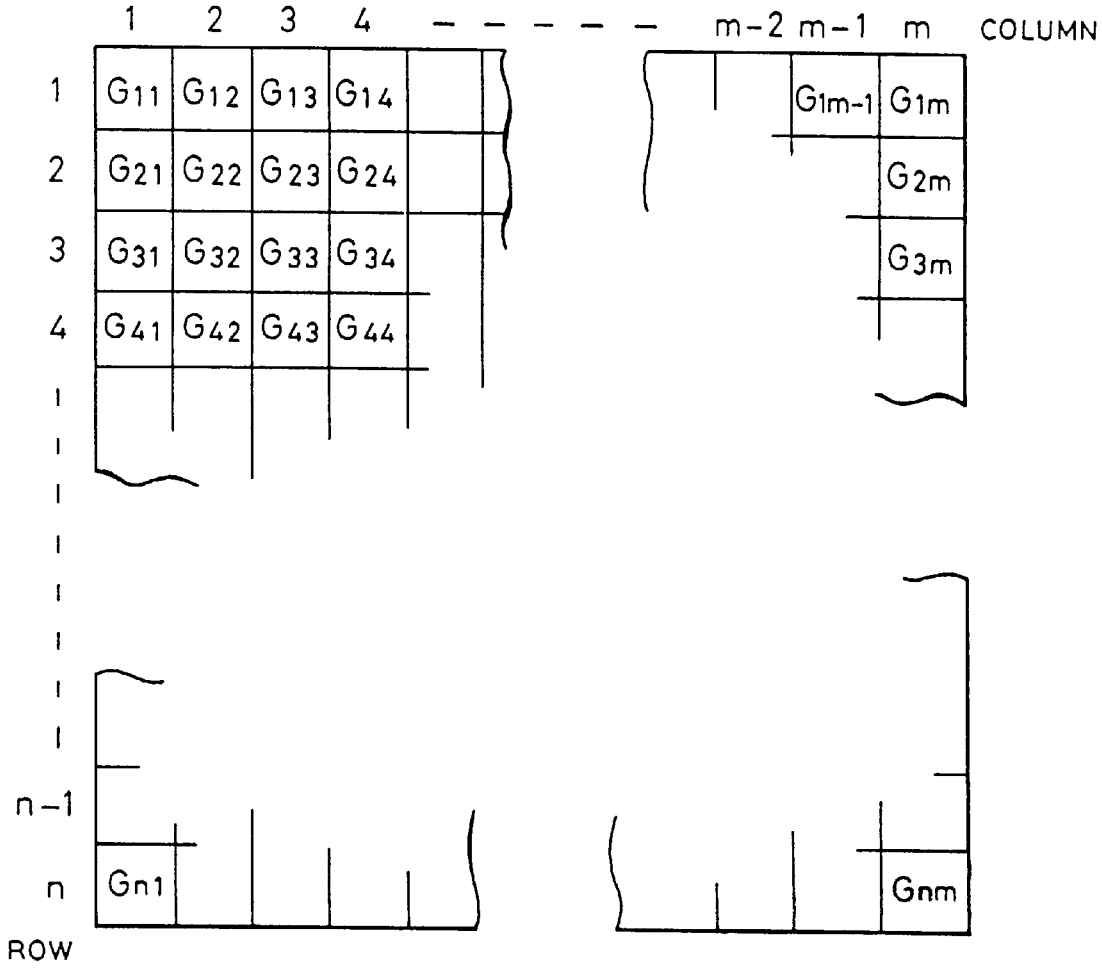
FIG. 14 is a diagram showing an arrangement of discharge cells $G_{11}$ to $G_{nm}$ on the PDP screen.

The internal operation of the data converting circuit 3 shown in FIG. 9 will now be described hereinbelow with reference to FIGS. 10A to 10G to 14. FIGS. 10A to 10G and FIGS. 13A to 13G are diagrams showing internal operation waveforms of the data converting circuit 3 in each of the four continuous field periods of the video signal. FIG. 14 is a diagram showing an arrangement of the discharge cells of the PDP 10.

First, the pixel data generated from the A/D converter 1 in FIG. 1 is sequentially supplied to the adder 320. In this instance, in the case where the video signal is based on the interlace scan, among the discharge cells of the PDP 10, the pixel data corresponding to the discharge cells of the odd number designated rows is first supplied and, after that, the pixel data corresponding to the discharge cells of the even number designated rows is supplied.

For instance, in the first field shown in FIGS. 10A to 10G, after pixel data $D_{11}$ to $D_{1m}$ corresponding to discharge cells $G_{11}$ to $G_{1m}$ of the first row in FIG. 14 were supplied, pixel data $D_{31}$ to $D_{3m}$ corresponding to discharge cells $G_{31}$ to $G_{3m}$ of the third row as the next odd row are supplied. Similarly, pixel data corresponding to the odd rows is sequentially supplied. When pixel data $D_{n1}$ to $D_{nm}$ corresponding to discharge cells $G_{n1}$ to $G_{nm}$ of the final odd row are supplied, the second field as shown in FIGS. 11A to 11G is executed. In the second field, pixel data $D_{21}$ to $D_{2m}$ corresponding to discharge cells $G_{21}$ to $G_{2m}$ of the first even row are supplied. The pixel data corresponding to the even rows is sequentially supplied. When pixel data $D_{(n-1)1}$ to $D_{nm}$ corresponding to the first even row are supplied, the third field as shown in FIGS. 12A to 12G is executed. In the third field, the pixel data corresponding to the odd rows is supplied in a manner similar to the first field. In the fourth field, the pixel data corresponding to the even rows is supplied in a manner similar to the second field.

The dither generating circuit 310 circulatively repetitively generates a dither coefficient a, a dither coefficient c, a dither coefficient b, and a dither coefficient d every clock signal CK2 in the first field as shown in FIGS. 10A to 10G and supplies them to the adder 320. In the next second field and subsequent third field, the dither generating circuit 310 circulatively repetitively generates the dither coefficient d, dither coefficient b, dither coefficient c, and dither coefficient a as shown in FIGS. 11A to 11G and FIGS. 12A to 12G and supplies them to the adder 320. The dither generating circuit 310 circulatively repetitively generates the dither coefficient a, dither coefficient c, dither coefficient b, and dither coefficient d every clock signal CK2 in the fourth field as shown in FIGS. 13A to 13G and supplies them to the adder 320.

The dither generating circuit 310 repetitively executes the operations in the first to fourth fields as mentioned above. That is, when the dither coefficient generating operation in the fourth field is finished, the operation is again returned to the operation of the first field and the foregoing operations are repeated.

The adder 320 successively adds the dither coefficients as mentioned above to the pixel data which is sequentially supplied from the A/D converter 1 as shown in FIGS. 10A to 10G and FIGS. 13A to 13G and supplies resultant dither addition pixel data to the upper bit extracting circuit 330.

That is, two different dither coefficients are added to one pixel data and two dither addition pixel data are newly formed.

The upper bit extracting circuit 330 extracts the data as much as upper M bits in the dither addition pixel data and supplies it as dither processing pixel data Z to each of the first data converting circuit 31 and second data converting circuit 33.

The first data converting circuit 31 converts, for example, the 6-bit dither processing pixel data Z (bit 6 to bit 1) which is sequentially supplied from the upper bit extracting circuit 330 into conversion pixel data AZ of 6 bits (bit 6 to bit 1) in accordance with the first conversion table as shown in FIGS. 3 and 4 and supplies the data AZ to the selector 32. The second data converting circuit 33 converts the dither processing pixel data Z into conversion pixel data BZ of 6 bits (bit 6 to bit 1) in accordance with the second conversion table as shown in FIGS. 3 and 4 and supplies the data BZ to the selector 32.

The selector 32 selects the conversion pixel data according to a selection signal as shown in FIGS. 10A to 10G and FIGS. 13A to 13G supplied from the panel drive control circuit 2 from the conversion pixel data AZ and BZ and generates it.

For example, in the first field as shown in FIGS. 10A to 10G, conversion pixel data $AZ(D_{11}+a)$ obtained by converting dither processing pixel data $Z(D_{11}+a)$ in accordance with the first conversion table is generated from the selector 32 and conversion pixel data $BZ(D_{11}+c)$ obtained by converting dither processing pixel data $Z(D_{11}+c)$ in accordance with the second conversion table is generated from the selector 32. Subsequently, conversion pixel data $BZ(D_{12}+b)$ obtained by converting dither processing pixel data $Z(D_{12}+b)$ in accordance with the second conversion table and conversion pixel data $AZ(D_{12}+d)$ obtained by converting dither processing pixel data $Z(D_{12}+d)$ in accordance with the first conversion table are sequentially generated from the selector 32.

Figure 15A:
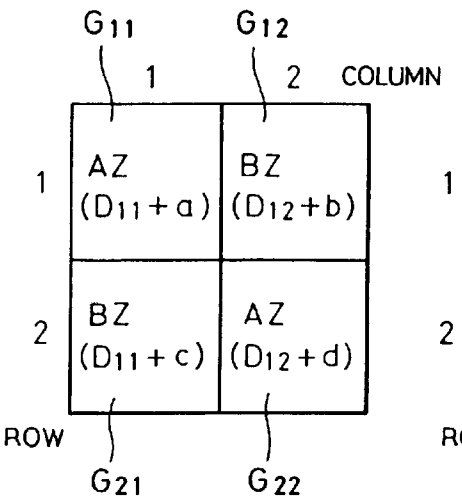
FIGS. 15A to 15D are diagrams showing conversion pixel data corresponding to the discharge cells $G_{11}$ to $G_{22}$.

By the operation of the first field as shown in FIGS. 10A to 10G, for example, as shown in FIG. 15A, the light emission based on the conversion pixel data $AZ(D_{11}+a)$ in the discharge cell $G_{11}$ of the first row and the first column, the light emission based on the conversion pixel data $BZ(D_{12}+b)$ in the discharge cell $G_{12}$ of the first row and the second column, the light emission based on the conversion pixel data $BZ(D_{11}+c)$ in the discharge cell $G_{21}$ of the second row and the first column, and the light emission based on the conversion pixel data $AZ(D_{12}+d)$ in the discharge cell $G_{22}$ of the second row and the second column are executed, respectively.

Figure 15B:
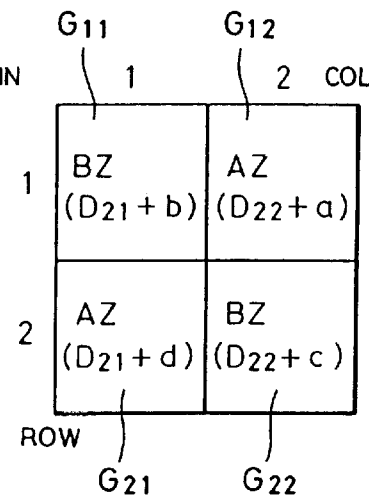
Figure 15C:
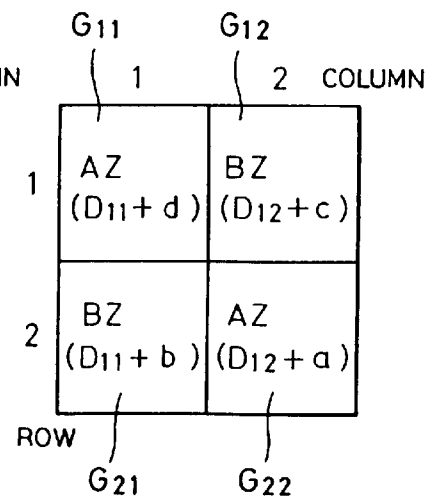
Figure 15D:
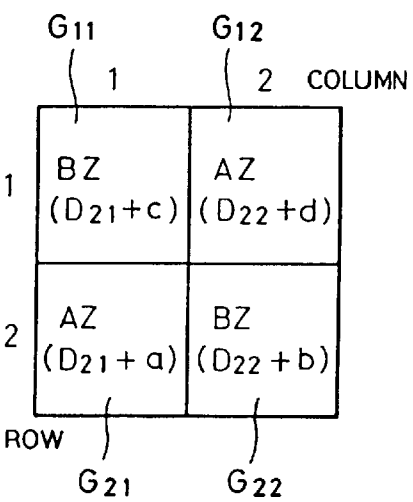

Similarly, by the operation in each of the second to fourth fields as shown in FIGS. 11A to 11G and FIGS. 13A to 13G, the light emission based on each of the conversion pixel data as shown in FIGS. 15B to 15D is executed.

That is, in the dither processing circuit 34 of the data converting circuit 3, as shown in FIGS. 10A to 10G and FIGS. 13A to 13G, two dither processing pixel data corresponding to the even and odd rows is formed from the pixel data corresponding to one discharge cell. In the dither processing circuit 34, further, by changing the dither coefficients to be added to the pixel data corresponding to each discharge cell every field, the reduction of pattern noises of the dither is realized.

In the embodiment shown in FIG. 6, one frame period is divided into six divided periods, the subframes SF1 to SF6 are allocated to the six divided periods, and the light emission driving is executed. The invention, however, is not limited to this construction.

For instance, it is also possible to divide one frame period into eight divided periods and to execute the light emission driving.

Figure 16:
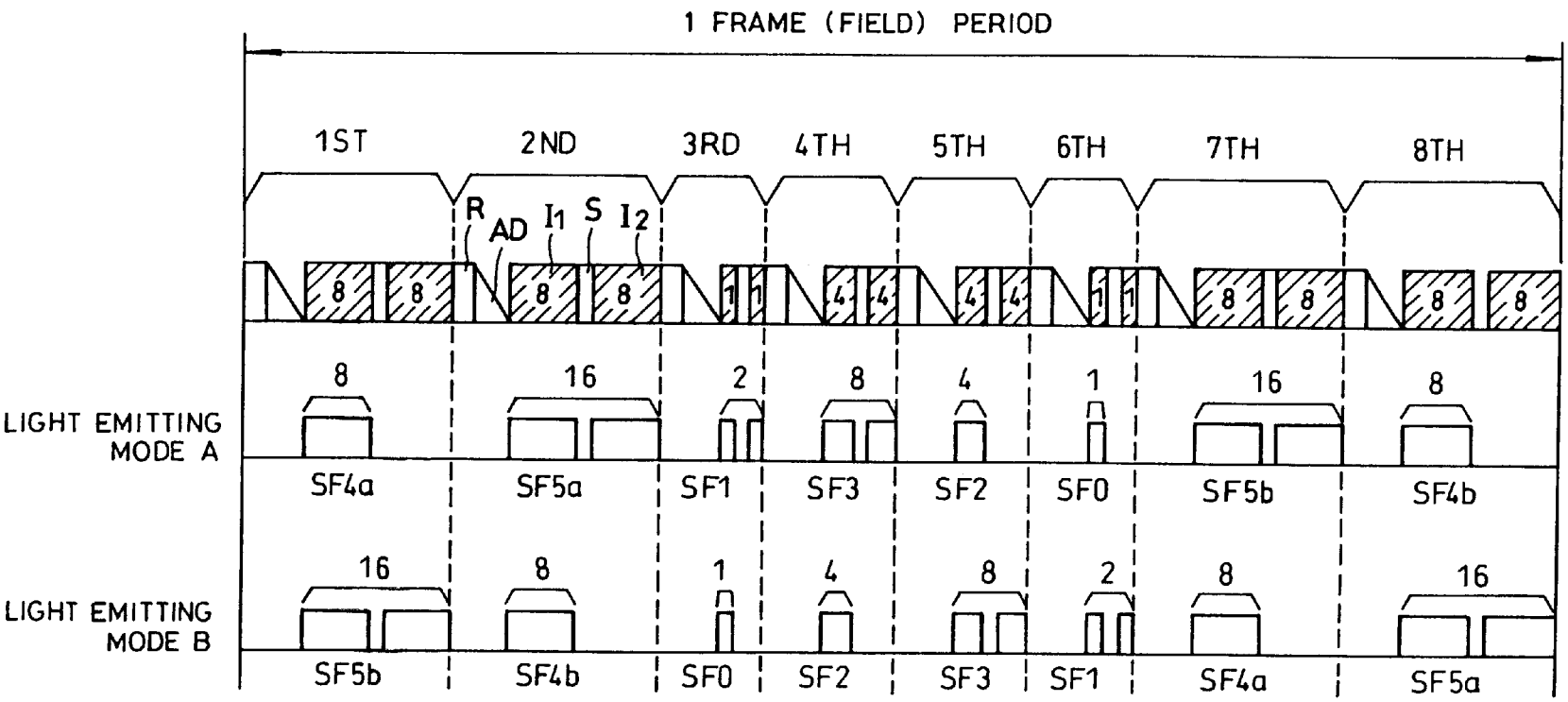
FIG. 16 is a diagram showing an example of a light emission driving format based on the half tone display method of the invention.

FIG. 16 is a diagram showing another example of the light emission driving format made in consideration of the above point.

In the light emission driving format shown in FIG. 16, various drive pulses are supplied to the PDP 10 at timings as shown in FIGS. 7A to 7H in each of the first, fifth, sixth, and eighth divided periods.

The discharge sustain period $t_a$ in each of the first and second sustain discharging operations as shown in FIGS. 7A to 7H to be executed in each of the first, fifth, sixth, and eighth divided periods is as follows.

The discharge sustain period $t_a$ in the first divided period=8 (equation 8)

The discharge sustain period $t_a$ in the fifth divided period=4 (equation 9)

The discharge sustain period $t_a$ in the sixth divided period=1 (equation 10)

The discharge sustain period $t_a$ in the eighth divided period=8 (equation 11)

Various drive pulses are supplied to the PDP 10 at timings as shown in FIGS. 8A to 8H in each of the second, third, fourth, and seventh divided periods.

The discharge sustain period $t_a$ in each of the first and second sustain discharging operations as shown in FIGS. 8A to 8H to be executed in each of the second, third, fourth, and seventh divided periods is as follows.

The discharge sustain period $t_a$ in the second divided period=8 (equation 12)

The discharge sustain period $t_a$ in the third divided period=1 (equation 13)

The discharge sustain period $t_a$ in the fourth divided period=4 (equation 14)

The discharge sustain period $t_a$ in the seventh divided period=8 (equation 15)

Further, the first data converting circuit 31 and second data converting circuit 33 in the data converting circuit 3 are changed to data converting circuits which can obtain the conversion pixel data A and B on the basis of the conversion tables as shown in FIGS. 17 and 18.

That is, in the embodiment shown in FIGS. 16 to 18, each of the subframes SF4 and SF5 among the subframes SF0 to SF6 for performing the light emission driving is divided into two periods at the following light emitting period ratios.

SF0:1
SF1:2
SF2:4
SF3:8
SF4:16
SF5:32

They are distributed and executed in one frame period.

That is, SF4 as a light emitting period "16" is divided into SF4*a* and SF4*b* in which the light emitting period is equal to "8". In the light emission driving in the light emitting mode A, they are distributed to the fourth divided period and the eighth divided period as shown in FIG. 16 and are executed. Further, SF5 as a light emitting period "32" is divided into SF5*a* and SF5*b* in which the light emitting period is equal to "16". In the light emission driving in the light emitting mode A, they are distributed to the second divided period and the seventh divided period as shown in FIG. 16 and are executed.

The conversion of the pixel data as shown in FIGS. 3, 4, 17, and 18 can be applied to not only the output pixel data from the A/D converter 1 as mentioned above or the pixel data after completion of the dither process by the dither processing circuit 34 as shown in FIG. 9 but also the pixel data after completion of another bit number reducing process (for example, error diffusing process).

Figure 19:
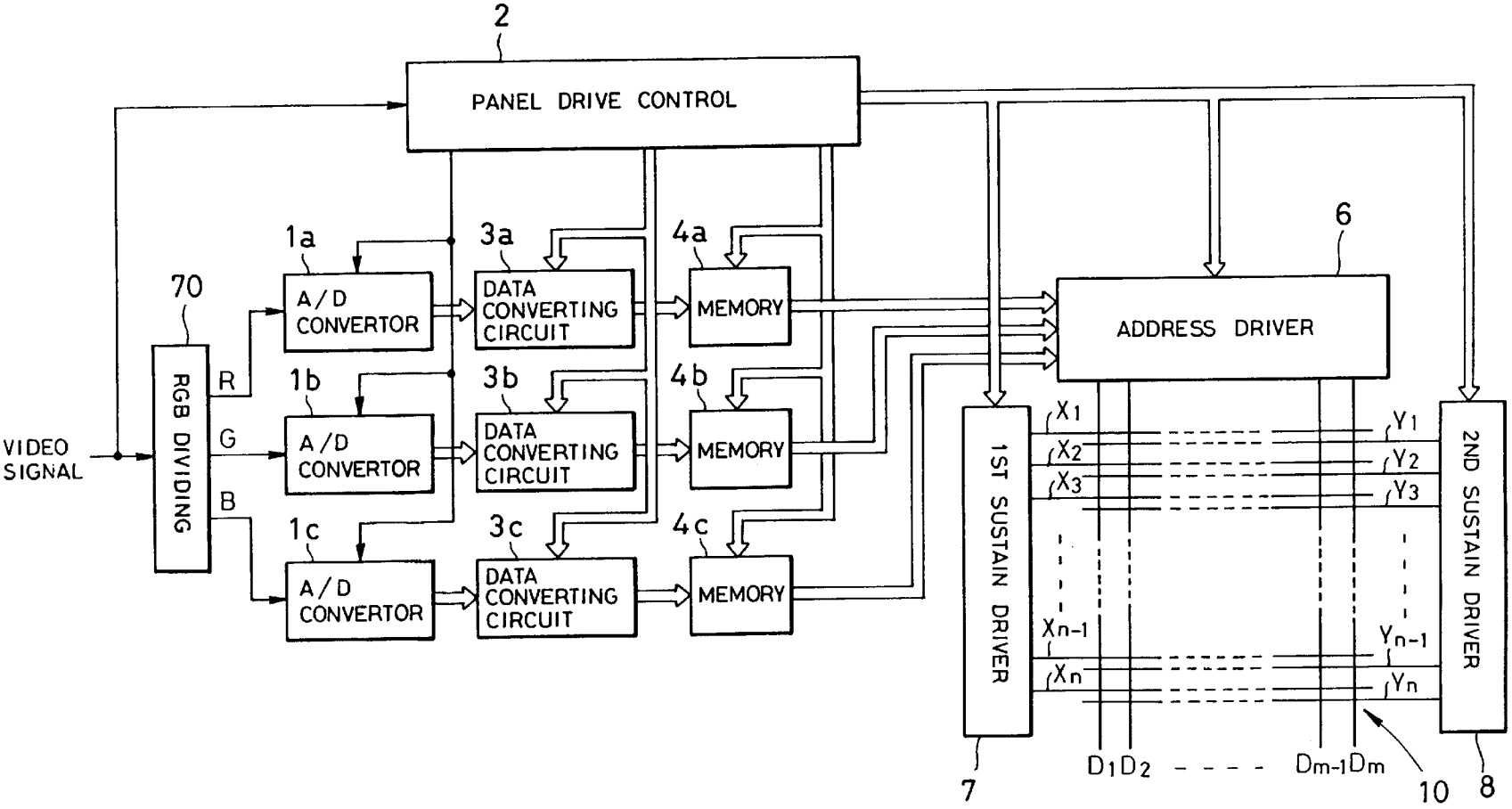
FIG. 19 is a diagram schematically showing the structure of the plasma display apparatus.

In FIG. 1, although the embodiment has been described without considering the R (red) component, G (green) component, and B (blue) component in the video signal, a construction as shown in FIG. 19 is actually used in consideration of those color components.

In FIG. 19, an RGB divided circuit 70 respectively separates and extracts a video signal R corresponding to the R (red) component, a video signal G corresponding to the G (green) component, and a video signal B corresponding to the B (blue) component from the supplied video signal and transfers to A/D converters 1*a* to 1*c*, respectively.

In this instance, each of the A/D converter 1*a*, a data converting circuit 3*a*, and a memory 4*a* is a circuit for performing the pixel data process as mentioned above to the video signal R of the R (red) component. Functions of the circuit blocks are the same as the A/D converter 1, data converting circuit 3, and memory 4 shown in FIG. 1. Each of the A/D converter 1*b*, a data converting circuit 3*b*, and a memory 4*b* is a circuit for performing the pixel data process as mentioned above to the video signal G of the G (green) component. Functions of the circuit blocks are the same as the A/D converter 1, data converting circuit 3, and memory 4 shown in FIG. 1. Similarly, each of the A/D converter 1*c*, a data converting circuit 3*c*, and a memory 4*c* is a circuit for performing the pixel data process as mentioned above to the video signal B of the B (blue) component. Functions of the circuit blocks are the same as the A/D converter 1, data converting circuit 3, and memory 4 shown in FIG. 1.

With the above construction, the conversion pixel data corresponding to the R, G, and B components is supplied to the address driver 6.

Figure 20:
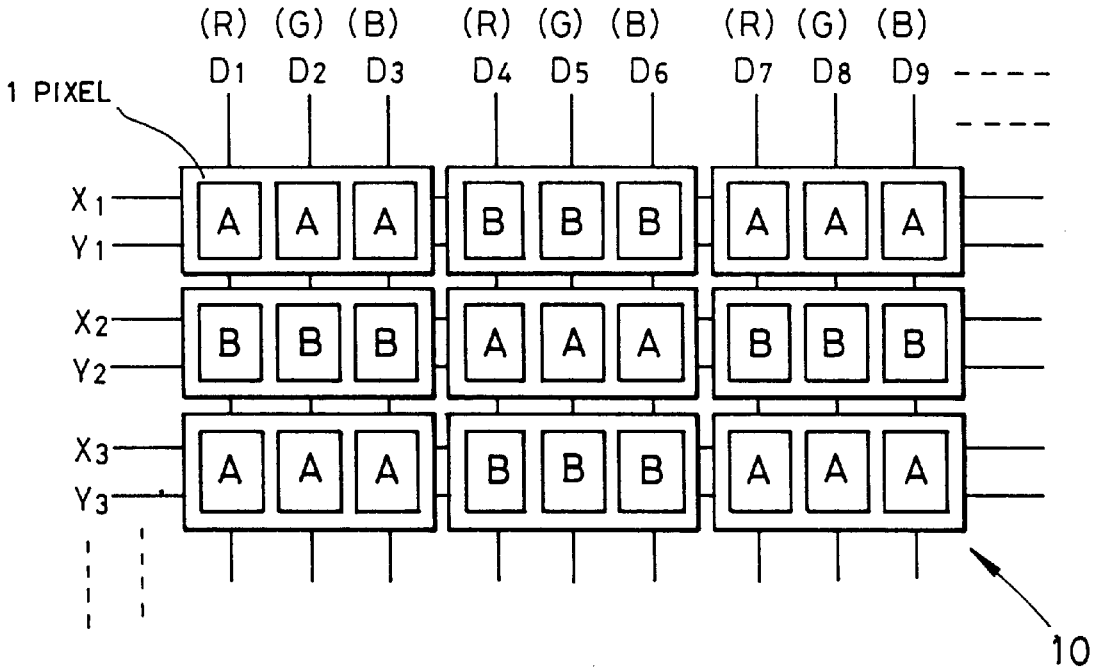
FIG. 20 is a diagram showing the correspondence between each pixel on the PDP screen and the light emitting modes A and B.

In this instance, as shown in FIG. 20, a pixel data pulse corresponding to the conversion pixel data of the R component is supplied to each of the column electrodes $D_1$, $D_4$, $D_7$, . . . , and $D_{(3m-2)}$ of the PDP 10. A pixel data pulse corresponding to the conversion pixel data of the G component is supplied to each of the column electrodes $D_2$, $D_5$, $D_8$, . . . , and $D_{(3m-1)}$. Further, a pixel data pulse corresponding to the conversion pixel data of the B component is supplied to each of the column electrodes $D_3$, $D_6$, $D_9$, . . . , and $D_{(3m)}$. That is, one pixel is formed by three adjacent discharge cells formed in the crossing portions of one column electrode and a pair of row electrode pair. In the embodiment shown in FIG. 20, the light emitting modes A and B are executed in a zigzag manner on a pixel unit basis.

Figure 21:
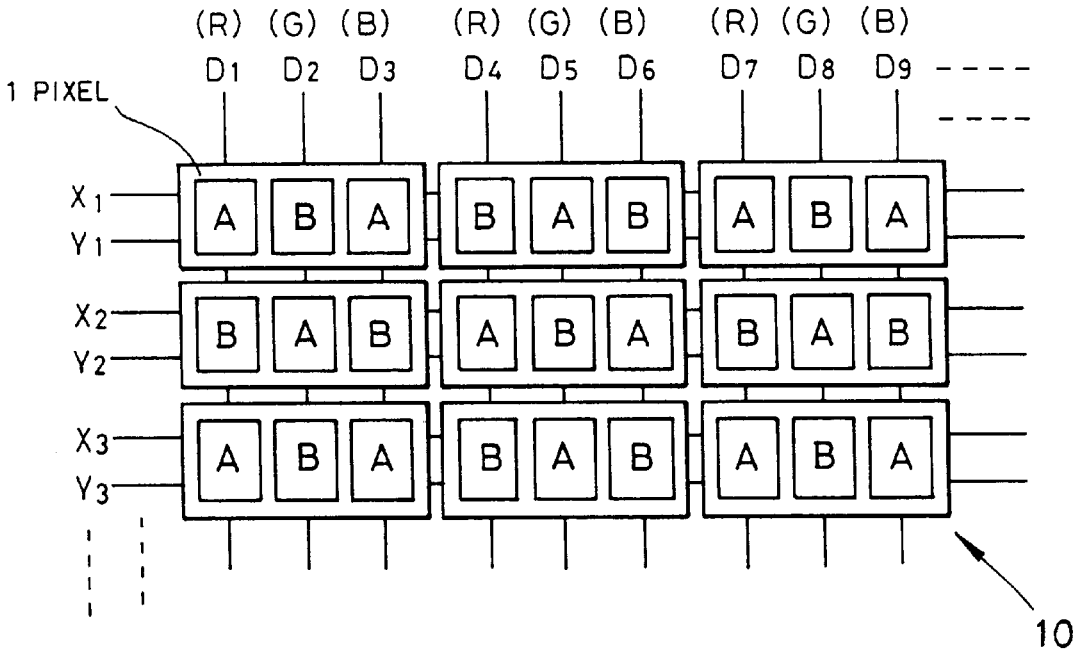
FIG. 21 is a diagram showing the correspondence between each discharge cell on the PDP screen and the light emitting modes A and B.

In this instance, as shown in FIG. 21, the light emitting modes A and B can be also executed in a zigzag manner on a discharge cell unit basis.

Figure 22:
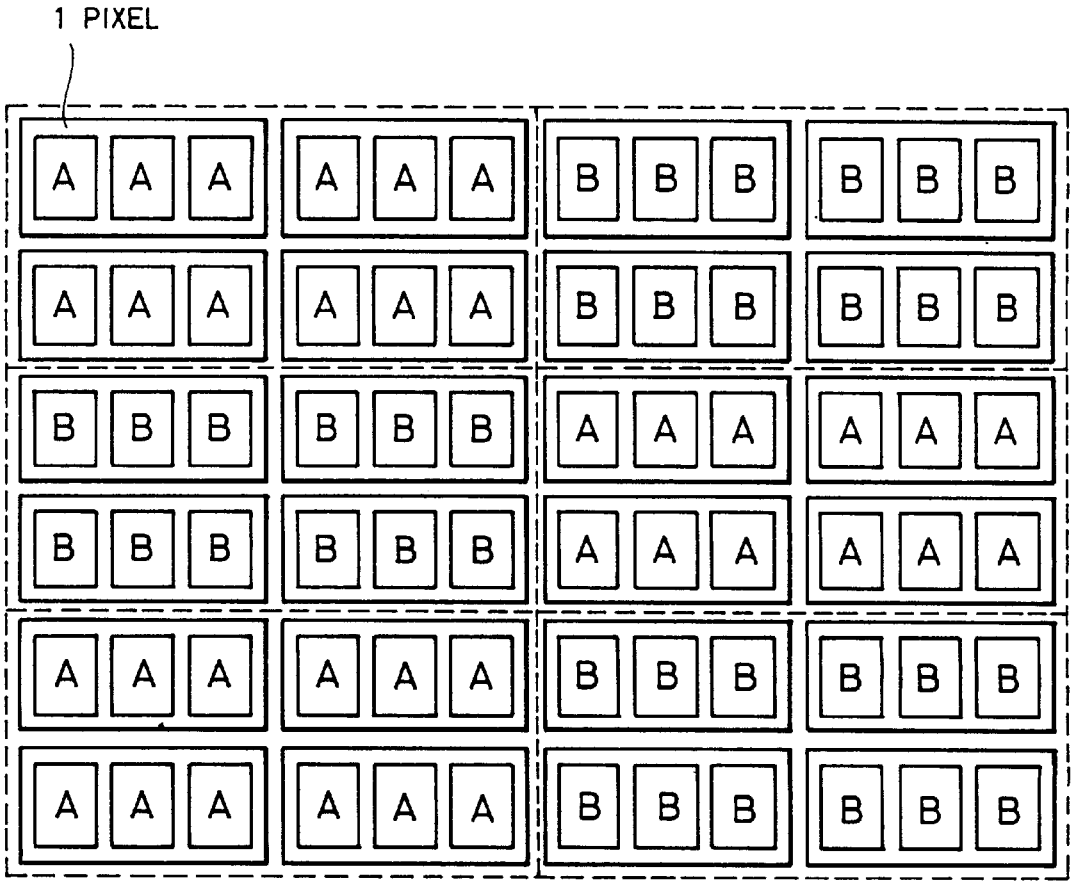
FIG. 22 is a diagram showing the correspondence between pixel blocks on the PDP screen and the light emitting modes A and B.

As shown in FIG. 22, a plurality of pixels are set to one block (block surrounded by a broken line) and the light emitting modes A and B can be also executed in a zigzag manner on a block unit basis.

Figure 23:
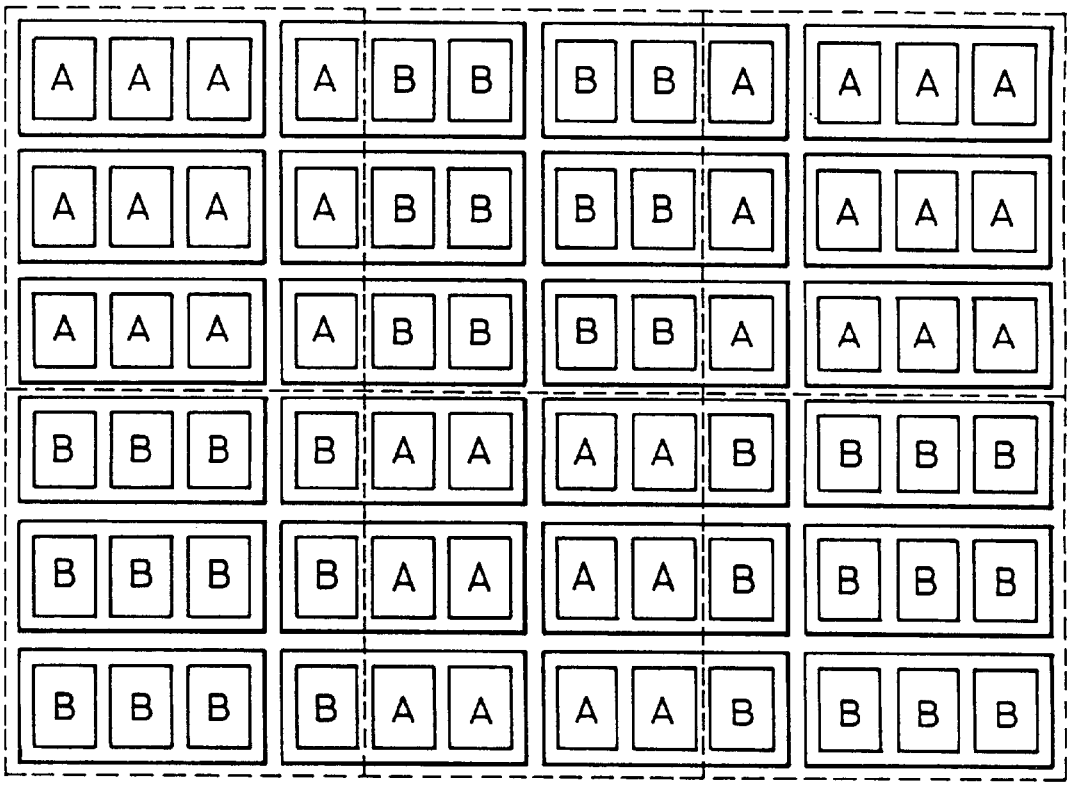
FIG. 23 is a diagram showing the correspondence between discharge cell blocks on the PDP screen and the light emitting modes A and B.

As shown in FIG. 23, a plurality of discharge cells are set to one block (block surrounded by a broken line) and the light emitting modes A and B can be also executed in a zigzag manner on a block unit basis.

Figure 24:
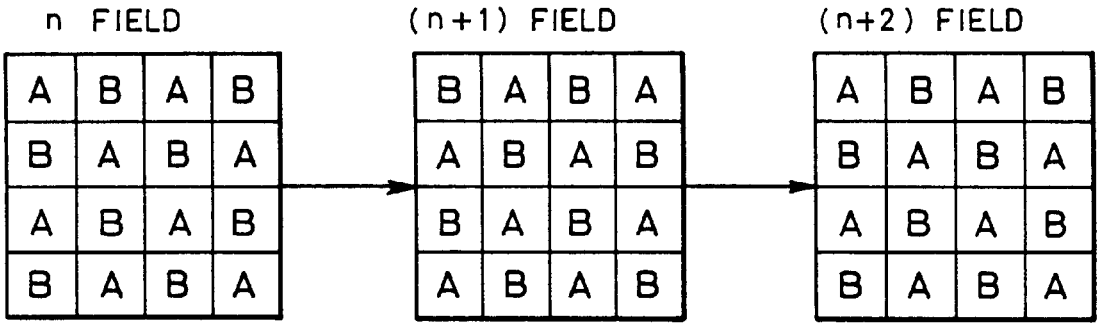
FIG. 24 is a diagram showing a transition of the correspondence between each discharge cell on the PDP screen and the light emitting modes A and B every field.
Figure 25:
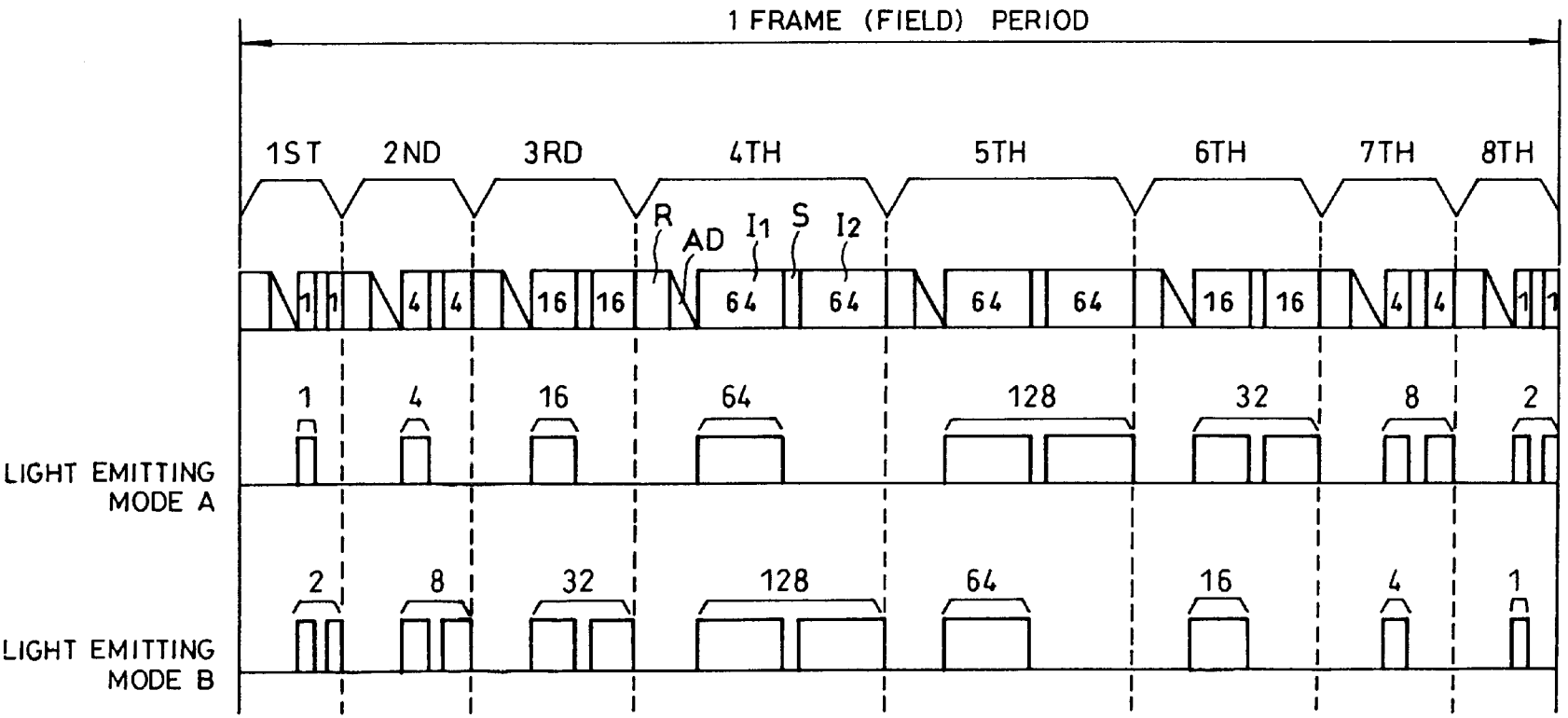
FIG. 25 is a diagram showing an example of a light emission driving format based on the half tone display method of the invention.
Figure 26:
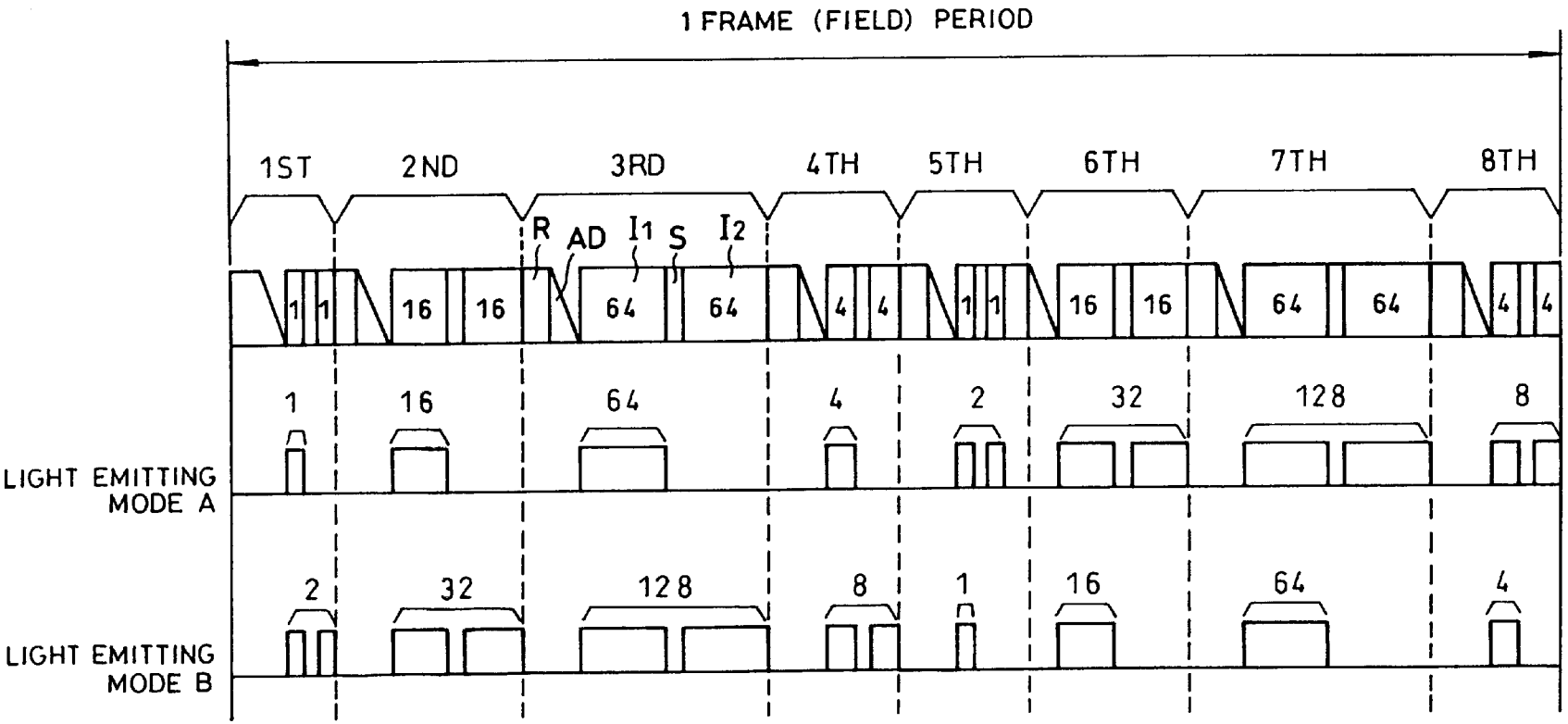
FIG. 26 is a diagram showing an example of the light emission driving format based on the half tone display method of the invention.
Figure 27:
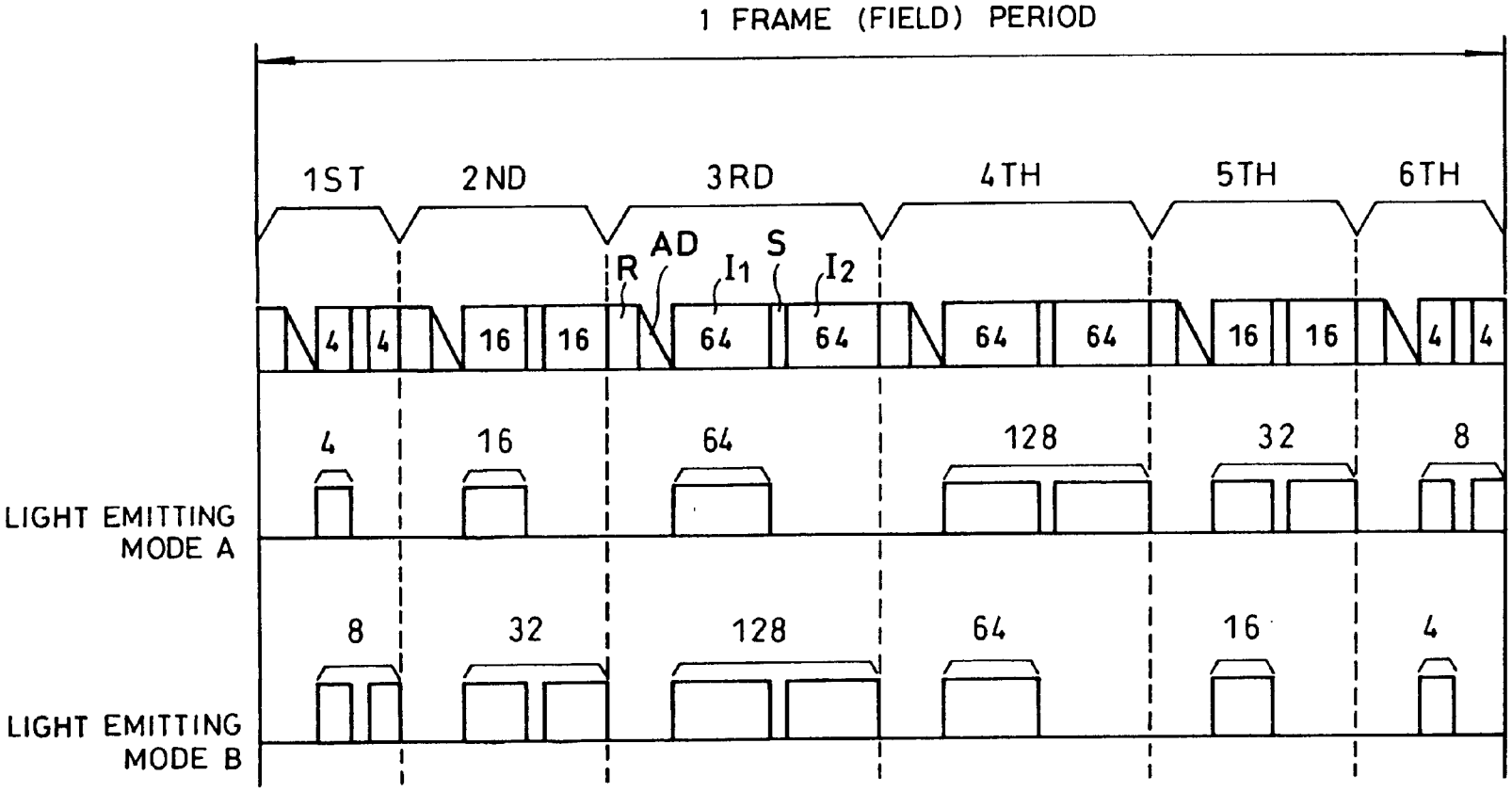
FIG. 27 is a diagram showing an example of the light emission driving format based on the half tone display method of the invention.
Figure 28:
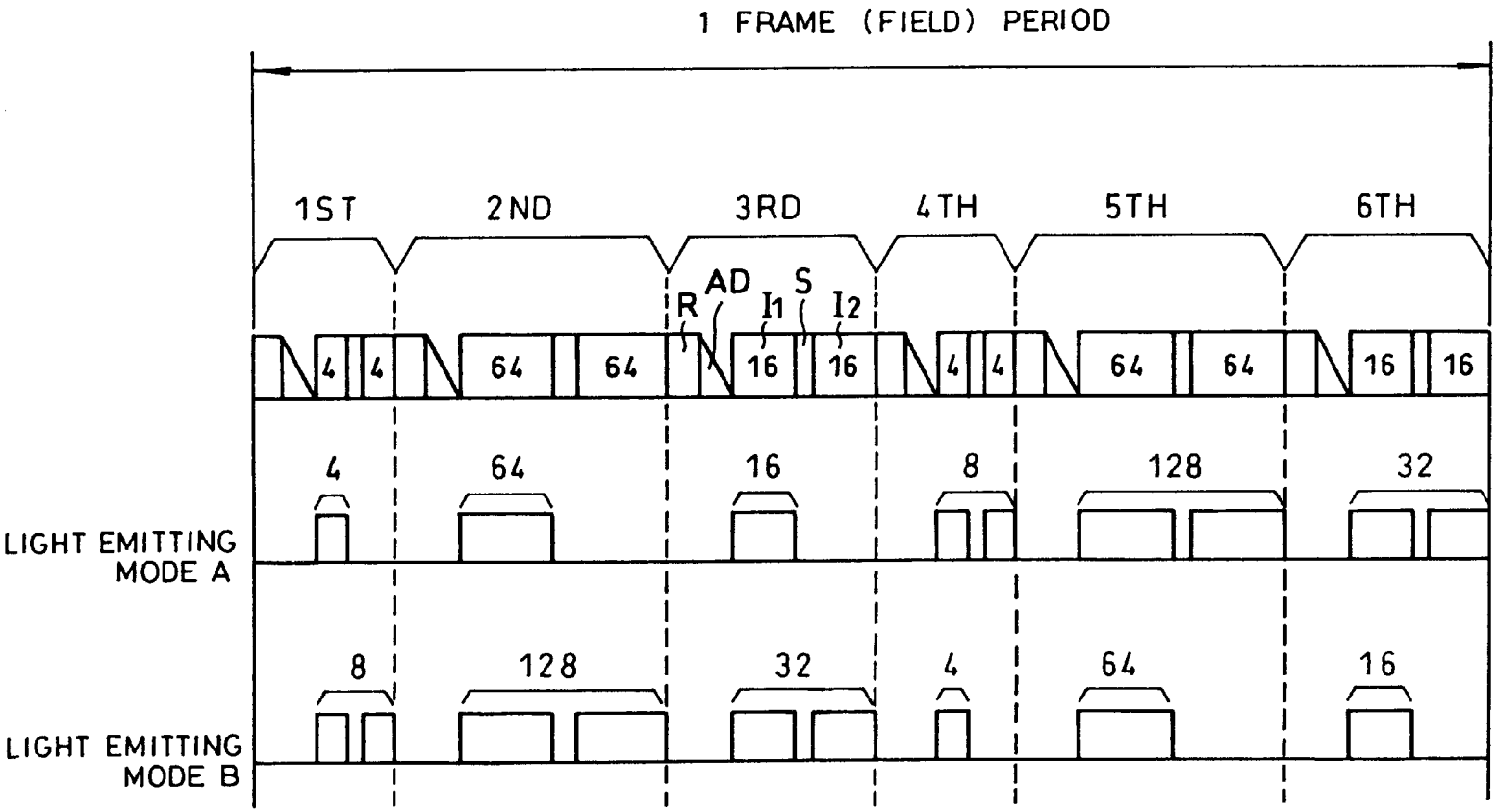
FIG. 28 is a diagram showing an example of the light emission driving format based on the half tone display method of the invention.

As shown in FIG. 24, the light emitting modes A and B can be also alternately executed every field or every frame.

Although the embodiment has been described with respect to the driving formats to execute the half tone display of 64 gradations in FIGS. 6 and 16, it can be also executed with regard to 128 gradations or 256 gradations.

Figure 29:
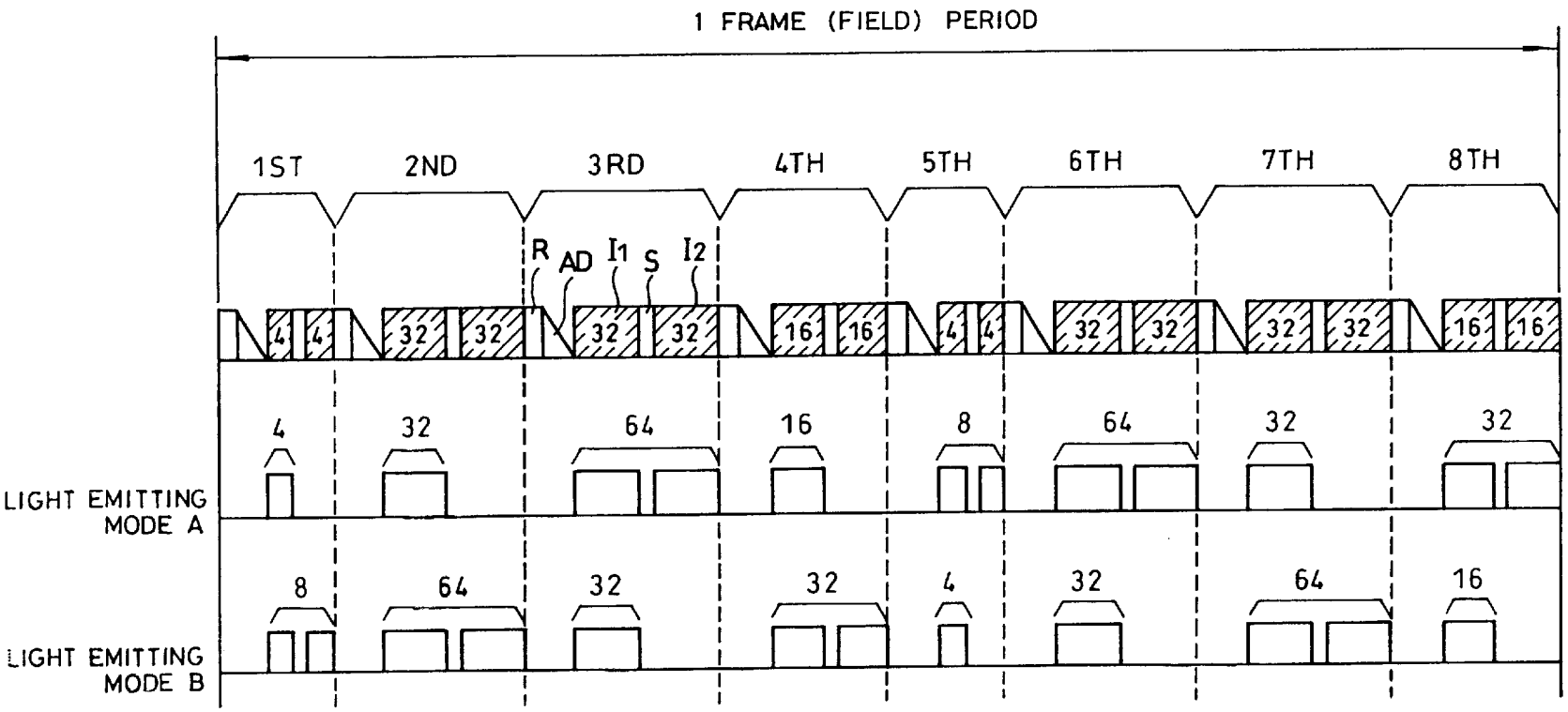
FIG. 29 is a diagram showing an example of the light emission driving format based on the half tone display method of the invention.
Figure 30:
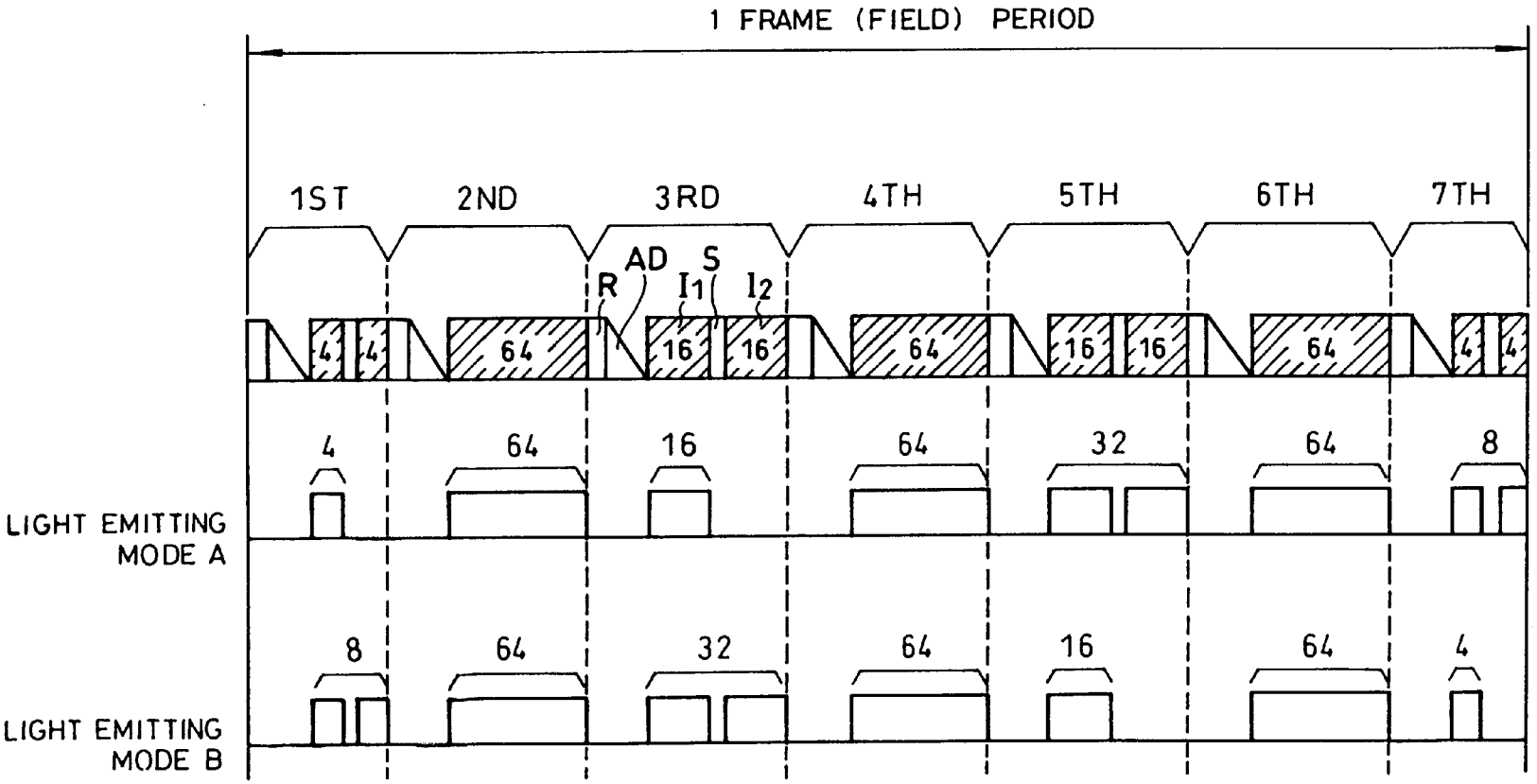
FIG. 30 is a diagram showing an example of the light emission driving format based on the half tone display method of the invention.

Each of FIGS. 25 to 28 is a diagram showing a driving format to execute the half tone display of 256 gradations. Each of FIGS. 29 and 30 is a diagram showing a driving format to execute the half tone display of 128 gradations.

In the driving methods shown in FIGS. 7A to 7H and FIGS. 8A to 8H, two sustain discharge periods are provided in one divided period and two kinds of modes in the case of executing the discharge light emission in both of those periods and in the case of executing the discharge light emission in only one of the periods of time can be selectively executed every discharge cell, thereby realizing two light emitting patterns (light emitting modes A and B).

Figure 31:
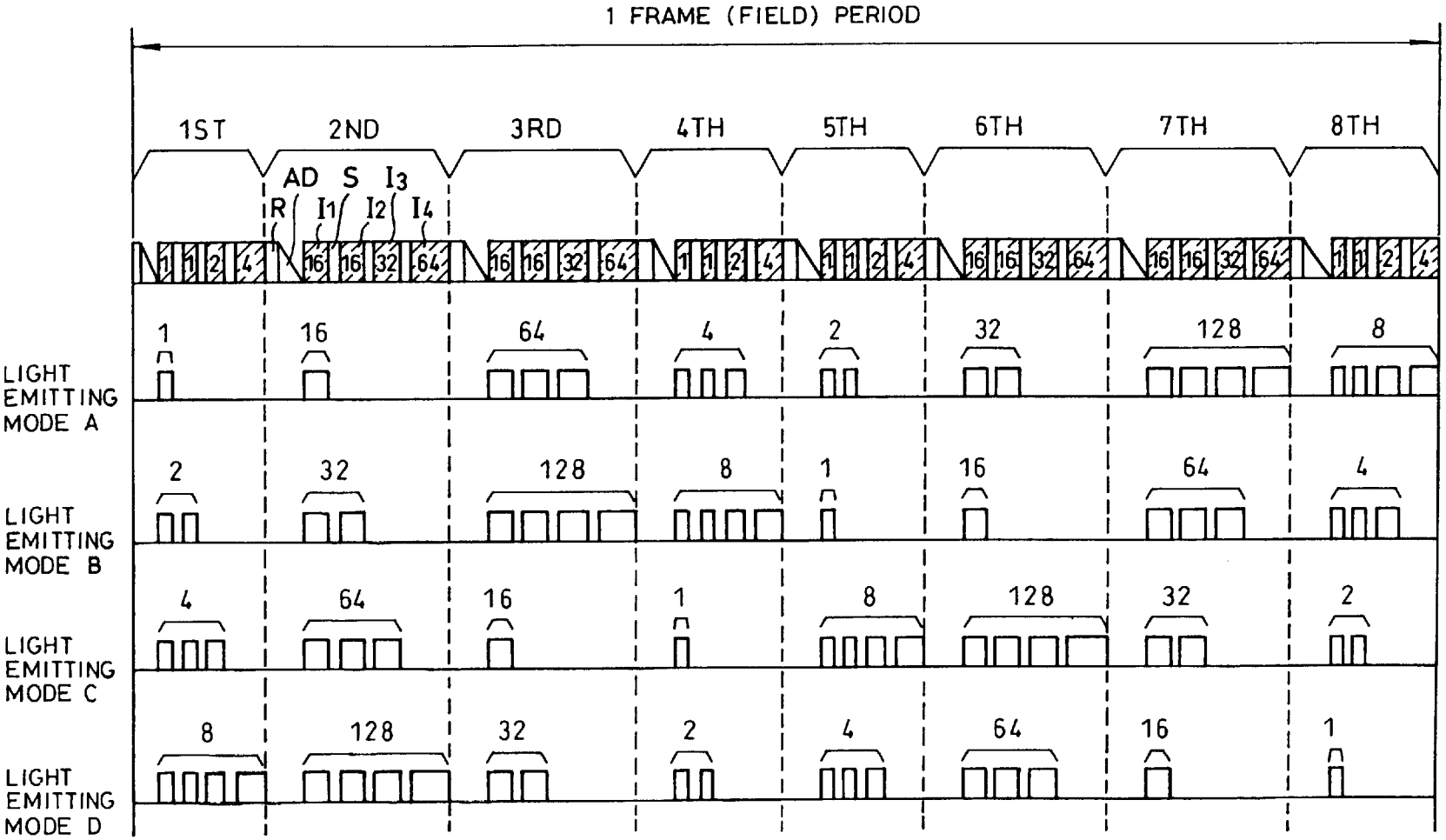
FIG. 31 is a diagram showing an example of the light emission driving format (in the case of four sustain discharge periods) based on the half tone display method of the invention.

Like a light emission driving format shown in FIG. 31, however, four sustain discharge periods (the first sustain discharge period $I_1$ to the fourth sustain discharge period $I_4$) are provided in one divided period and four kinds of light emitting patterns can be also obtained. The first sustain discharge period $I_1$ to the fourth sustain discharge period $I_4$ are not always equal to the same period.

The light emission in the light emitting mode A based on the light emission driving format shown in FIG. 31 has the following light emitting patterns.

First divided period light up in only the first sustain discharge period (light emitting period "1")

Second divided period:light up in only the first sustain discharge period (light emitting period "16")

Third divided period:light up in each of the first to third sustain discharging periods (light emitting period "64")

Fourth divided period:light up in each of the first to third sustain discharging periods (light emitting period "4")

Fifth divided period:light up in each of the first and second sustain discharging periods (light emitting period "2")

Sixth divided period:light up in each of the first and second sustain discharging periods (light emitting period "32")

Seventh divided period:light up in all of the first to fourth sustain discharging periods (light emitting period "128")

Eighth divided period:light up in all of the first to fourth sustain discharging periods (light emitting period "8")

The light emission in the light emitting mode B in FIG. 31 has the following light emitting patterns.

First divided period:light up in each of the first and second sustain discharging periods (light emitting period "2")

Second divided period:light up in each of the first and second sustain discharging periods (light emitting period "32")

Third divided period:light up in all of the first to fourth sustain discharging periods (light emitting period "128")

Fourth divided period:light up in all of the first to fourth sustain discharging periods (light emitting period "8")

Fifth divided period:light up in only the first sustain discharge period (light emitting period "1")

Sixth divided period:light up in only the first sustain discharge period (light emitting period "16")

Seventh divided period:light up in each of the first to third sustain discharging periods (light emitting period "64")

Eighth divided period:light up in each of the first to third sustain discharging periods (light emitting period "4")

The light emission in the light emitting mode C in FIG. 31 has the following light emitting patterns.

First divided period:light up in each of the first to third sustain discharging periods (light emitting period "4")

Second divided period:light up in each of the first to third sustain discharging periods (light emitting period "64")

Third divided period:light up in only the first sustain discharge period (light emitting period "16")

Fourth divided period:light up in only the first sustain discharge period (light emitting period "1")

Fifth divided period:light up in all of the first to fourth sustain discharging periods (light emitting period "8")

Sixth divided period:light up in all of the first to fourth sustain discharging periods (light emitting period "128")

Seventh divided period:light up in each of the first and second sustain discharging periods (light emitting period "32")

Eighth divided period light up in each of the first and second sustain discharging periods (light emitting period "2")

The light emission in the light emitting mode D in FIG. 31 has the following light emitting patterns.

First divided period light up in all of the first to fourth sustain discharging periods (light emitting period "8")

Second divided period:light up in all of the first to fourth sustain discharging periods (light emitting period "128")

Third divided period:light up in each of the first and second sustain discharging periods (light emitting period "32")

Fourth divided period:light up in each of the first and second sustain discharging periods (light emitting period "2")

Fifth divided period:light up in each of the first to third sustain discharging periods (light emitting period "4")

Sixth divided period:light up in each of the first to third sustain discharging periods (light emitting period "64")

Seventh divided period:light up in only the first sustain discharge period (light emitting period "16")

Eighth divided period:light up in only the first sustain discharge period (light emitting period "1")

The four kinds of light emitting patterns in the light emitting modes A to D are selectively executed every pixels, every discharge cell, or every group consisting of a plurality of adjacent discharge cells as shown in, for example, FIG. 32A.

The four kinds of light emitting patterns in the light emitting modes A to D can be also changed every field or every frame as shown in FIG. 32B or FIG. 32C.

In case of constructing one pixel by four adjacent discharge cells, by executing the light emission driving in the light emitting modes A to D, the half tone display of 256 gradations can be performed in two divided periods in one frame period.

Figure 33:
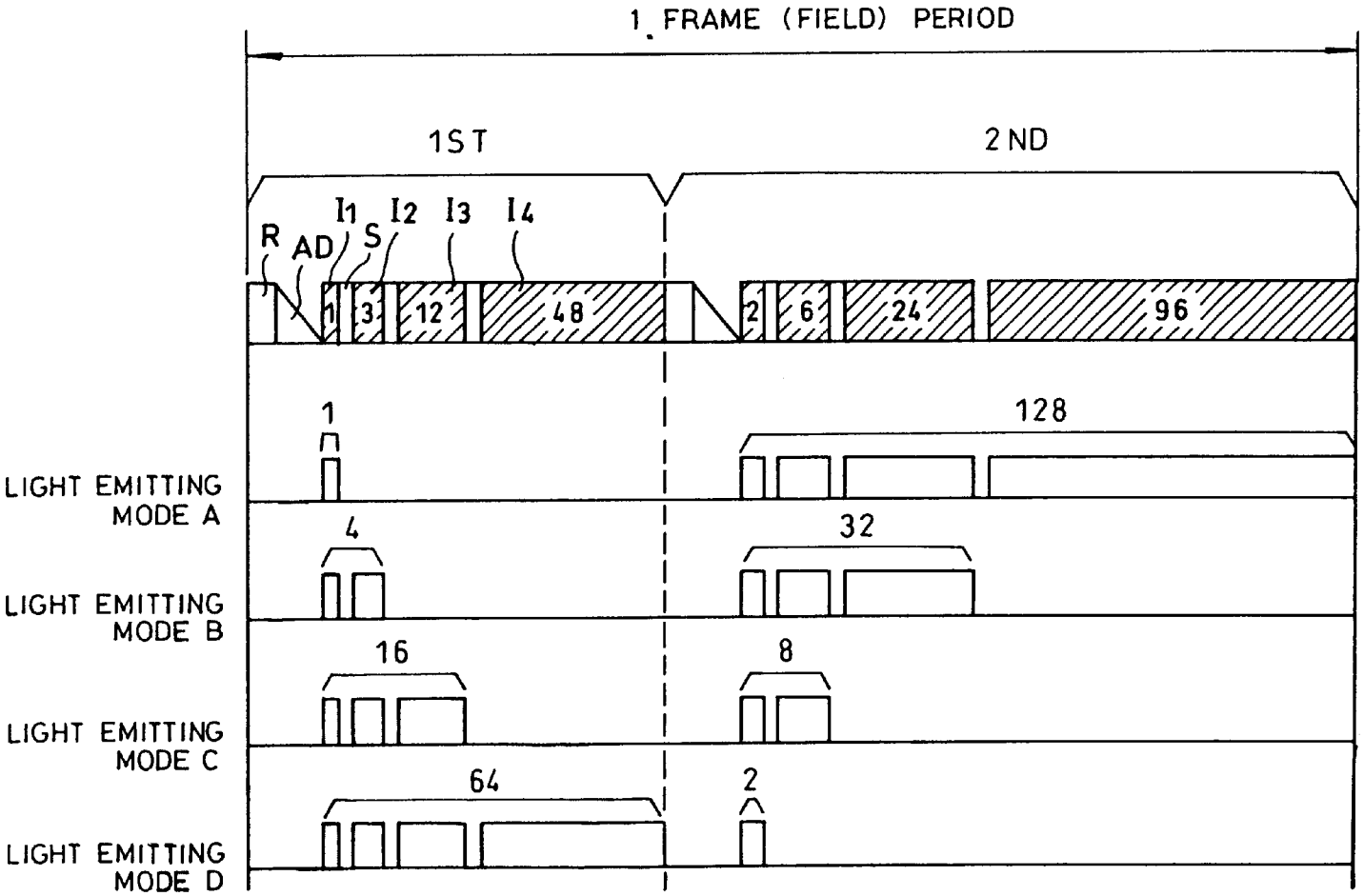
FIG. 33 is a diagram showing an example of the light emission driving format (in case of four sustain discharge periods) based on the half tone display method of the invention.
Figure 34A:
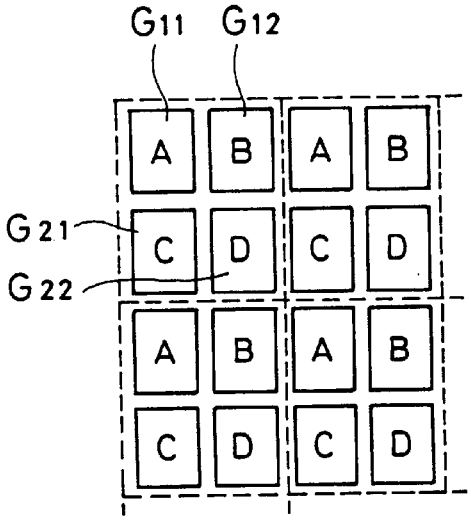
FIGS. 34A and 34B are diagrams showing light emitting periods which are executed by each of the four discharge cells $G_{11}$ to $G_{22}$ constructing one pixel.
Figure 34B:
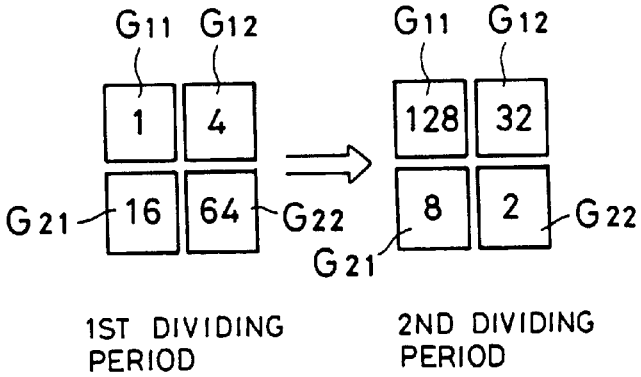
Figures 35A, 35H:
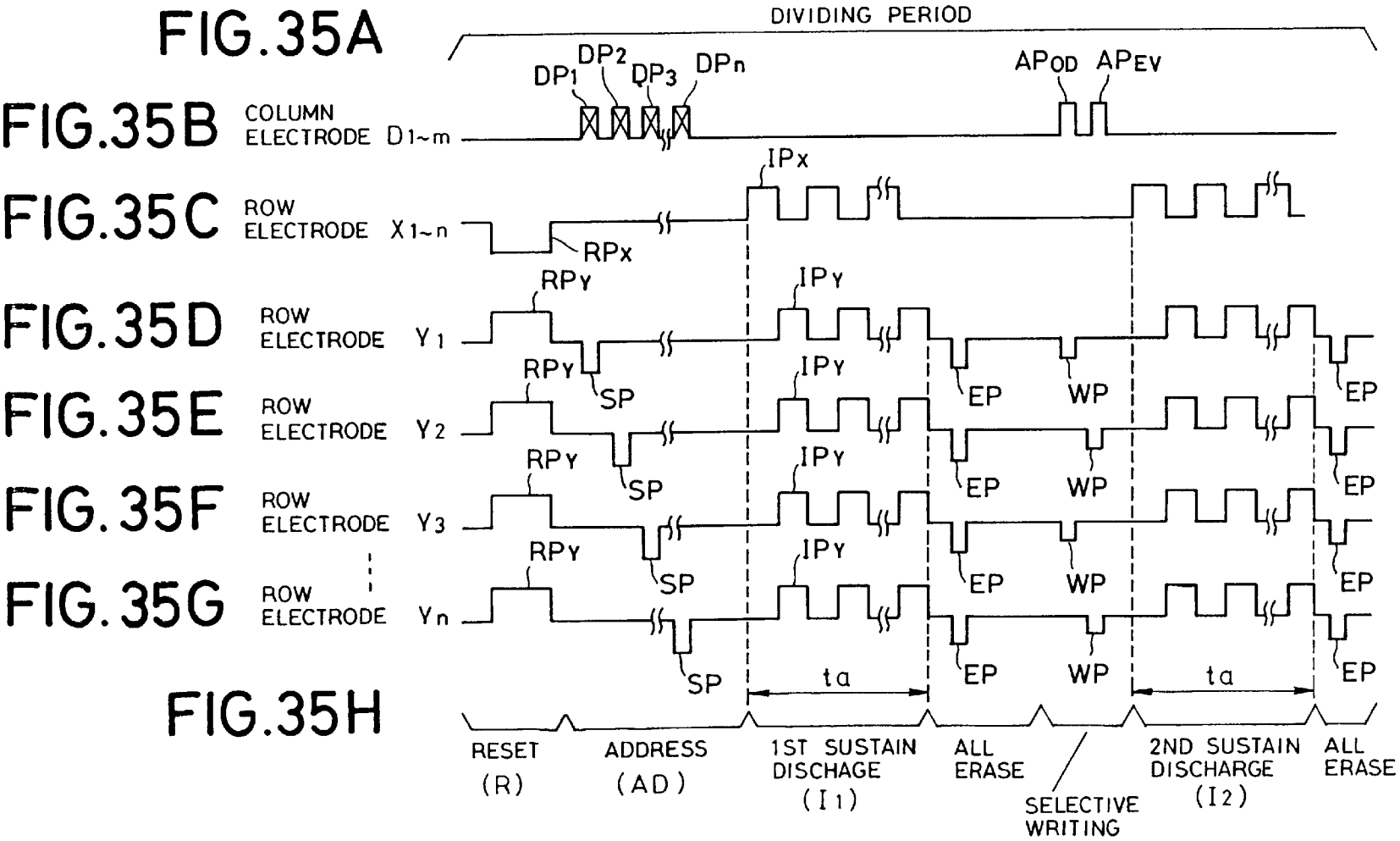

FIG. 33 is a diagram showing an example of a light emission driving format realized in consideration of the above point. FIGS. 34A and 34B are diagrams showing light emitting periods which are embodied in each of the four discharge cells constructing one pixel.

That is, in the case where each of the four discharge cells $G_{11}$, $G_{12}$, $G_{21}$, and $G_{22}$ forming one pixel as shown in FIG. 34A performs the light emission in the light emitting modes A to D in accordance with the light emission driving format shown in FIG. 33, each discharge cell performs the light emission in the light emitting period as shown in FIG. 34B in each of the two divided periods.

In place of the driving methods shown in FIGS. 7A to 7H and FIGS. 8A to 8H, a driving method as shown in FIGS. 35A to 35H can be also used.

In the driving method shown in FIGS. 35A to 35H, although the resetting operation, address operation, and first sustain discharging operation are the same as those shown in FIGS. 7A to 7H and FIGS. 8A to 8H, the operation after the first sustain discharging operation differs.

That is, according to the driving method shown in FIGS. 35A to 35H, when the first sustain discharging operation is finished, the second sustain driver 8 subsequently supplies the erasing pulse EP to all of the row electrodes $Y_1$ to $Y_n$ and the wall charges of all of the discharge cells are once erased (all erasing operation).

Subsequently, the address driver 6 supplies the address pulse $AP_{OD}$ to each of the odd number designated column electrodes among the column electrodes $D_1$ to $D_m$. At the same timings as the supply timings of the address pulse $AP_{OD}$, the second sustain driver 8 supplies a data writing pulse WP to the odd number designated row electrodes $Y_1$, $Y_3$, $Y_5$, $Y_7$, . . . . In accordance with this operation, the wall charges are again formed in all of the discharge cells existing in the crossing portions between the odd number designated "column electrodes" and the odd number designated "row electrode pairs". The address driver 6 subsequently supplies the address pulse $AP_{EV}$ to each of the even number designated column electrodes among the column electrodes $D_1$ to $D_m$. At the same timings as the supply timing of the address pulse $AP_{EV}$, the second sustain driver 8 supplies the data writing pulse WP to the even number designated row electrodes $Y_2$, $Y_4$, $Y_6$, $Y_8$, . . . . In accordance with this operation, the wall charges are again formed in all of the discharge cells existing in the crossing portions between the even number designated "column electrodes" and the even number designated "row electrode pairs" (selective writing operation).

The first sustain driver 7 and second sustain driver 8 subsequently alternately supply the sustain pulses $IP_X$ and $IP_Y$ to the row electrodes X and Y of the PDP 10. In this instance, the discharge cell in which the wall charges remain executes the light emission discharge each time the sustain pulse $IP_X$ and $IP_Y$ are alternately supplied and maintains its light emission discharging state (second sustain discharging operation).

That is, by executing the second sustain discharging operation, only the discharge cell in which the wall charges were formed by the selective writing operation subsequently executes the light emission discharge for only the discharge sustain period $t_a$.

In the half tone display method according to the invention as mentioned above, by enabling the mode in case of providing a plurality of sustain discharge periods in one divided period and executing the discharge light emission in the whole period of time and the mode in case of stopping the light emission in at least one sustain discharge period to be selectively executed every discharge cell (pixel), the pseudo outline can be reduced.

By using the above driving method, a gradation expression such that a plurality of discharge cells are regarded as one block such as dither or diffusion error can be realized.

Figure 36:
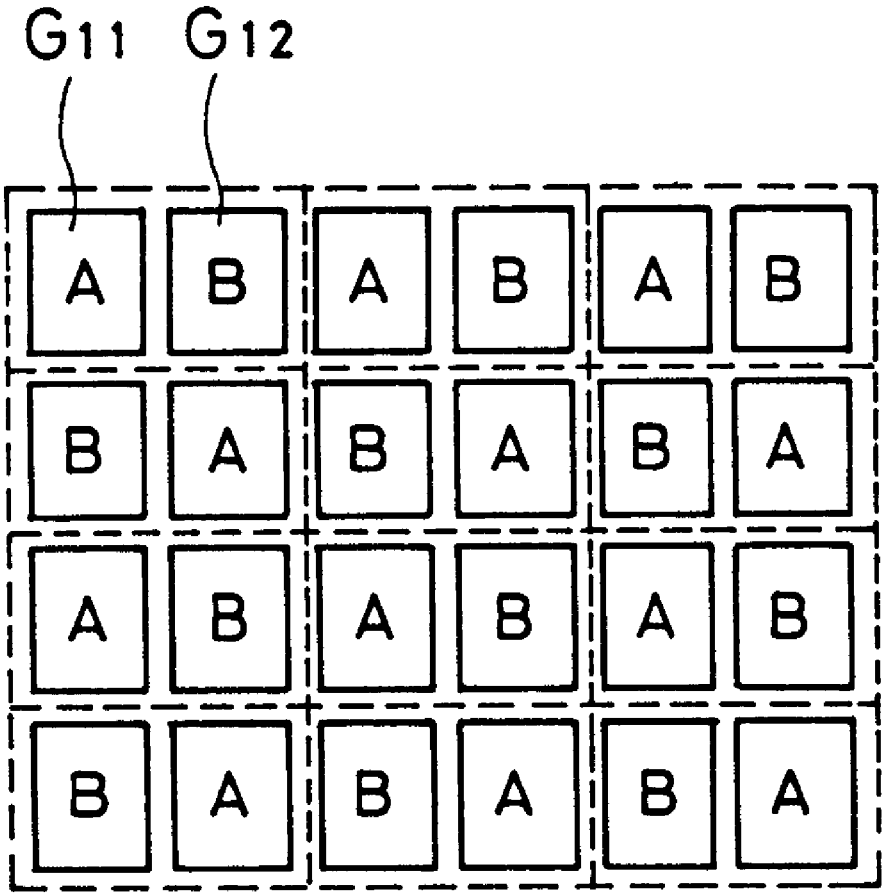
FIG. 36 is a diagram showing the correspondence between a discharge cell pair forming one pixel on the PDP screen and the light emitting modes A and B.
Figure 37:
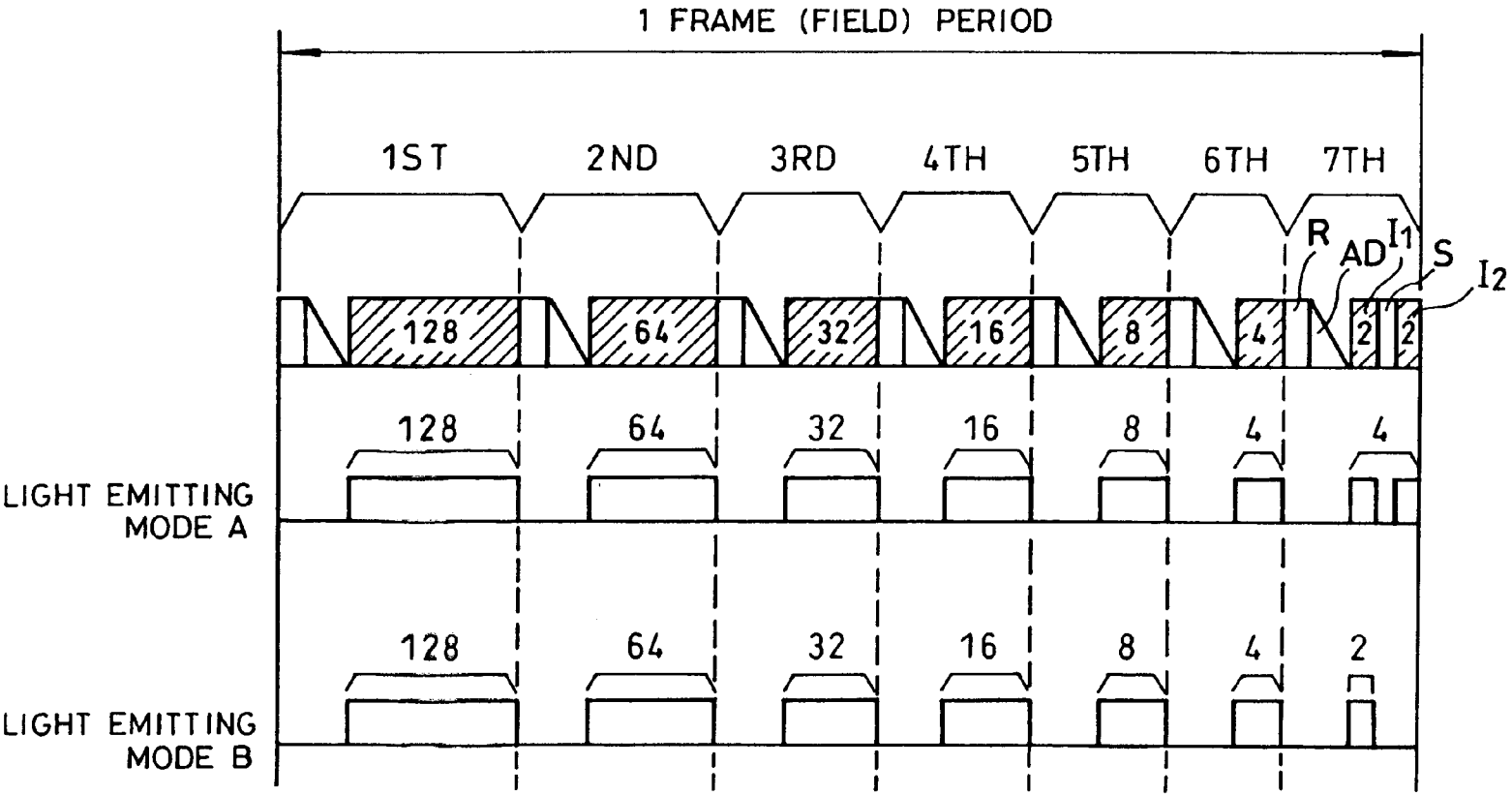
FIG. 37 is a diagram showing a light emission driving format to realize a half tone display by an error diffusion by using a supplying method of drive pulses according to the invention.

For example, two discharge cells (for instance, $G_{11}$ and $G_{12}$) surrounded by a broken line in FIG. 36 are regarded as one block and the light emission driving is executed by a driving format as shown in FIG. 37. In this instance, among the seven divided periods comprising the first to seventh divided periods shown in FIG. 37, the light emission driving in which two sustain discharge periods as shown in FIG. 6 are provided is performed in only the seventh divided period of the smallest weight of the light emitting period. According to the driving, each of the discharge cells $G_{11}$ and $G_{12}$ can have any one of states 1 to 4 as shown in FIG. 38 in the seventh divided period. Now, it is assumed that the luminance level which is visually sensed is an average light emitting period of all of the discharge cells existing in one block, according to the light emission by the state 2 of each of the discharge cells $G_{11}$ and $G_{12}$, the luminance corresponding to the light emitting period "1" is obtained. According to the light emission by the state 4, the luminance corresponding to the light emitting period "3" is derived.

That is, according to the above construction, even if the divided period to execute the light emission of the light emitting period "1" is not provided, the luminance level corresponding to each of the light emitting periods "1" and "3" can be obtained. The half tone display of 256 gradations, therefore, can be realized in the seven divided periods comprising the first to seventh divided periods as mentioned above.

The first and second conversion tables which are used in the first and second data converting circuits 31 and 33 in order to execute the light emission driving by the driving format as shown in FIG. 37 are as shown in FIG. 39. In FIG. 39, it is assumed that bits 8 to 3 of the received pixel data become bits 7 to 2 of the conversion pixel data as they are.

In the embodiment shown in FIGS. 36 to 39, the operation which is used in case of regarding two discharge cells as one block has been described. The invention can be also similarly applied, however, to a case of regarding four discharge cells as one block as shown by a broken line in FIG. 40.

Figure 41:
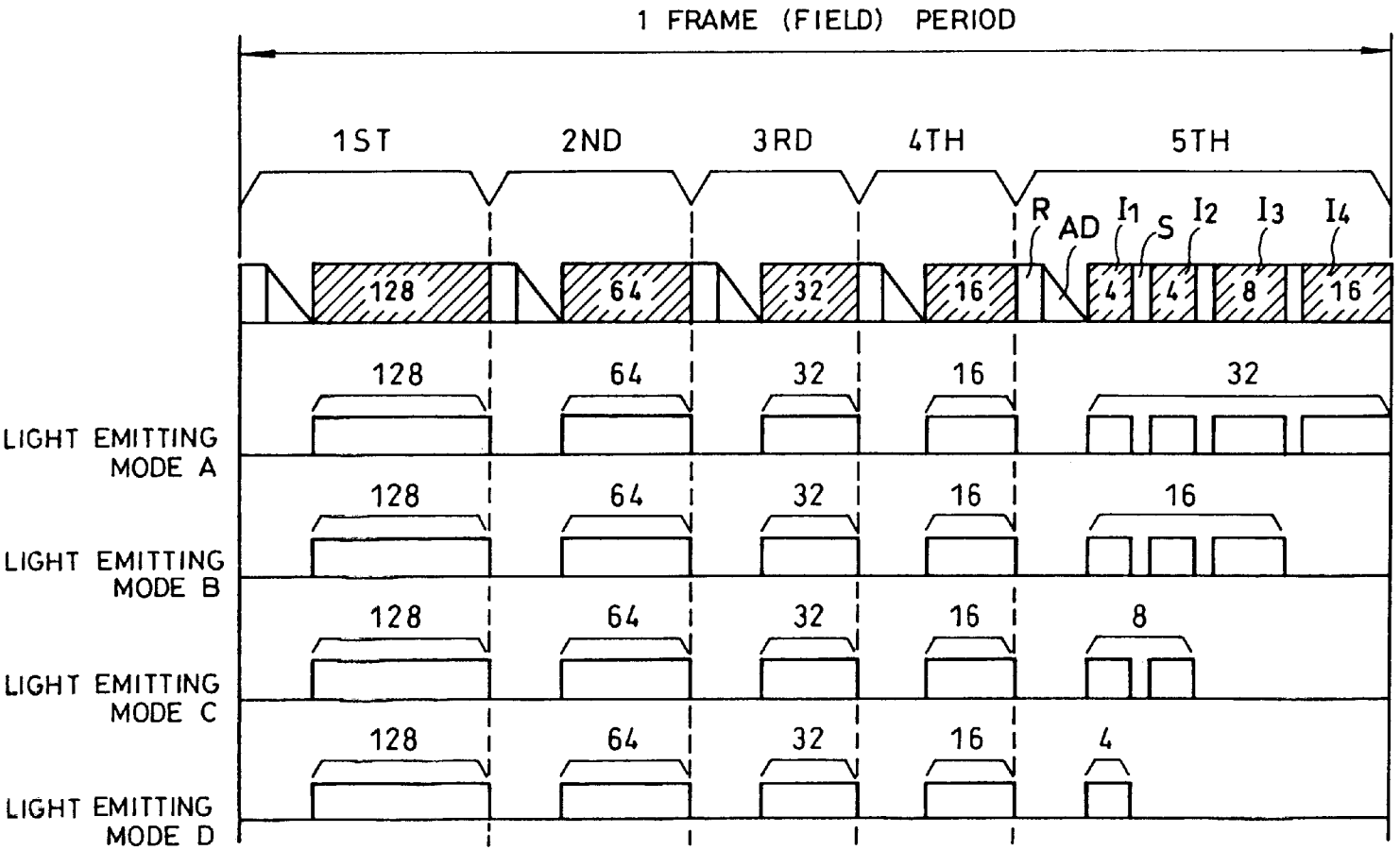
FIG. 41 is a diagram showing a light emission driving format which is applied in case of regarding four discharge cells as one block.
Figures 42A, 42B, 42C, 42D, 42E, 42F, 42G, 42H:
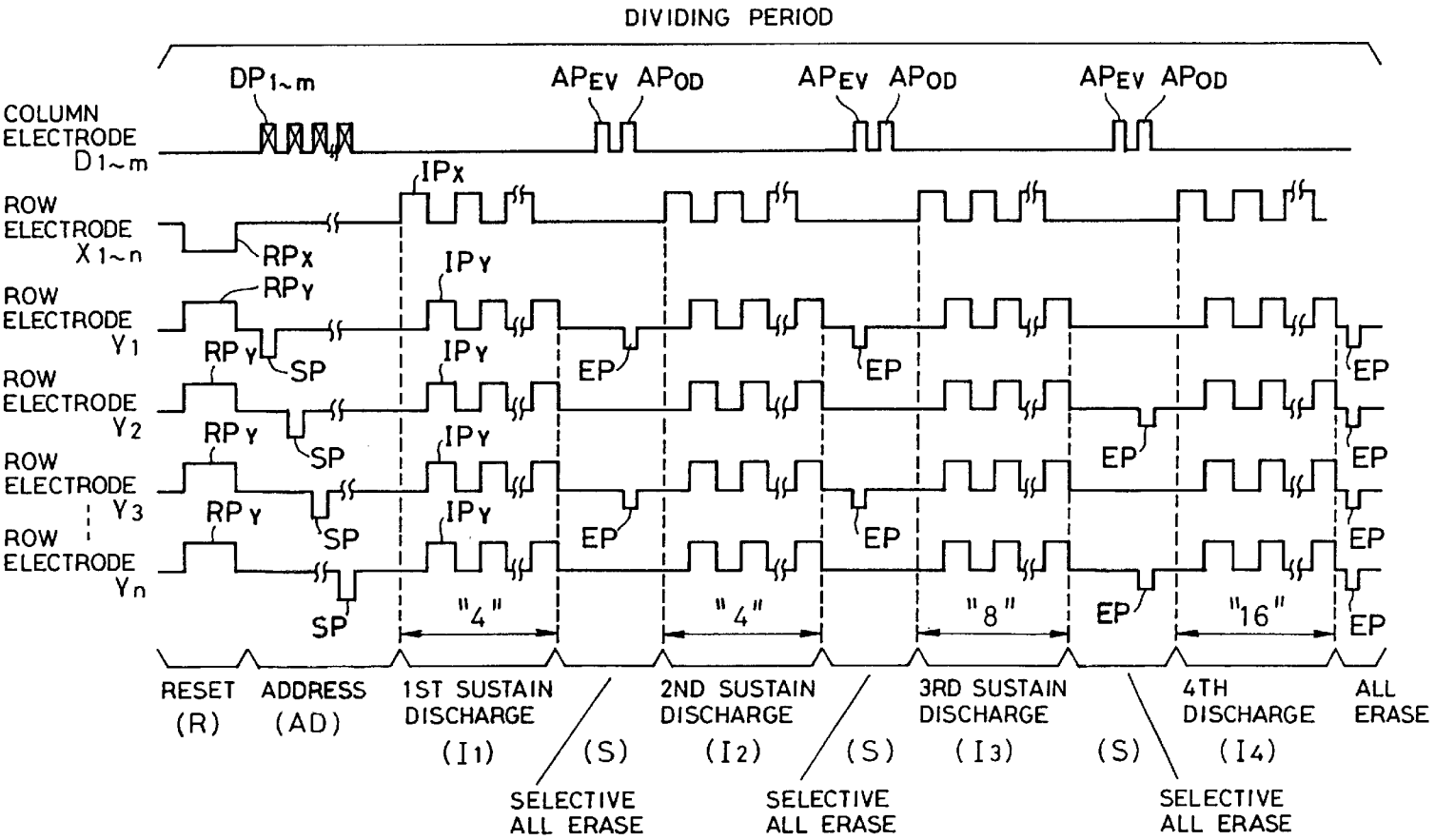
FIGS. 42A to 42H are diagrams showing supply timings of drive pulses in the fifth divided period in the light emission driving format shown in FIG. 41.

FIG. 41 is a diagram showing a light emission driving format which is applied to a case where four discharge cells are regarded as one block as mentioned above.

In FIG. 41, one frame period is divided into five divided periods comprising the first to fifth divided periods and the light emission driving as shown in FIGS. 42A to 42H is executed in only the fifth divided period. That is, the light emission at the light emission luminance levels "1" to "16" corresponding to the average light emitting period of four discharge cells is executed in only the fifth divided period.

The half tone display of 256 gradations, therefore, can be performed in five divided periods comprising the first to fifth divided periods as mentioned above.

Figure 43:
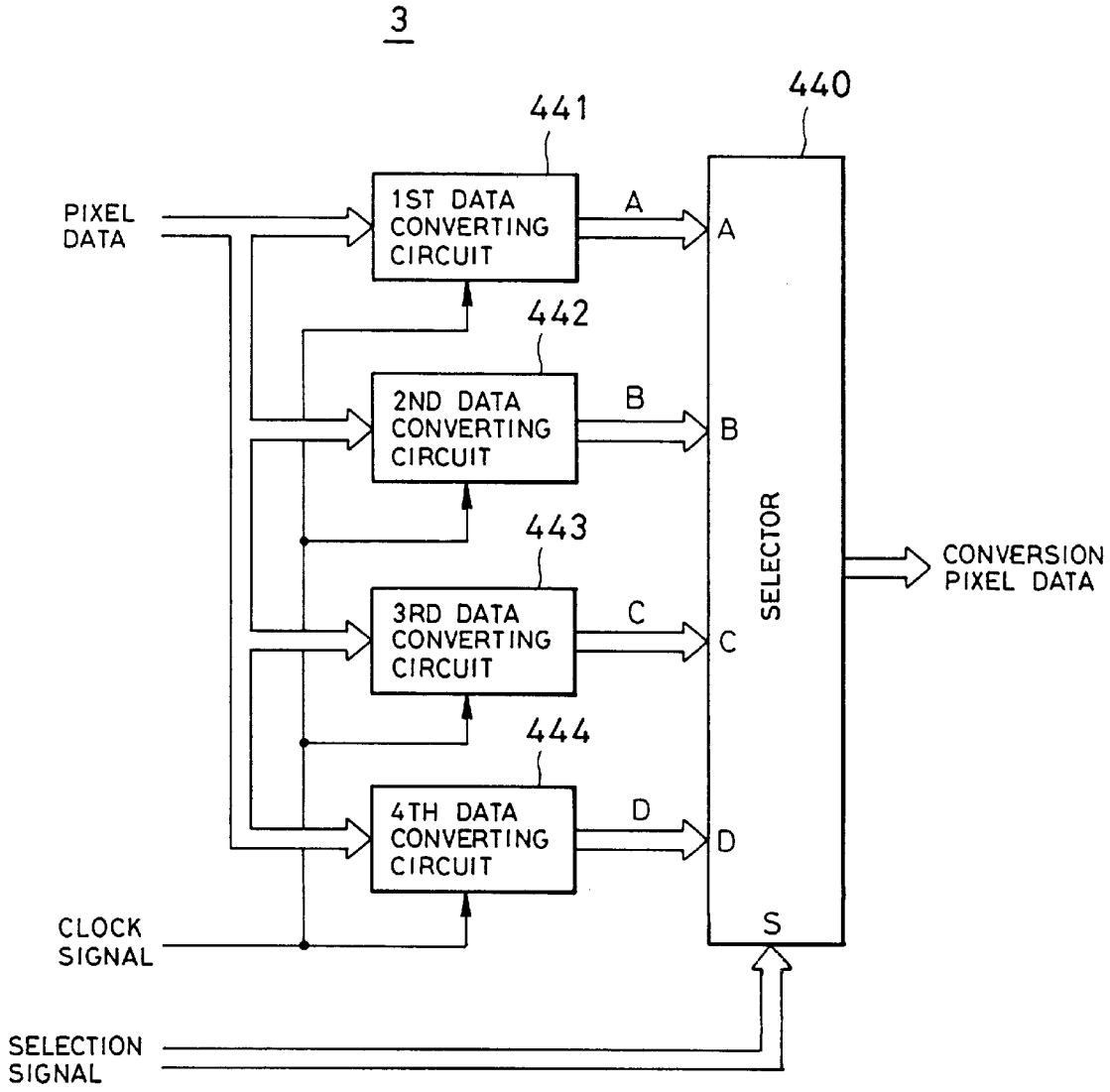
FIG. 43 is a diagram showing another example of an internal construction of the data converting circuit 3.

FIG. 43 is a diagram showing an internal construction of the data converting circuit 3 to execute the light emission driving by a driving format as shown in FIG. 41.

Figure 40:
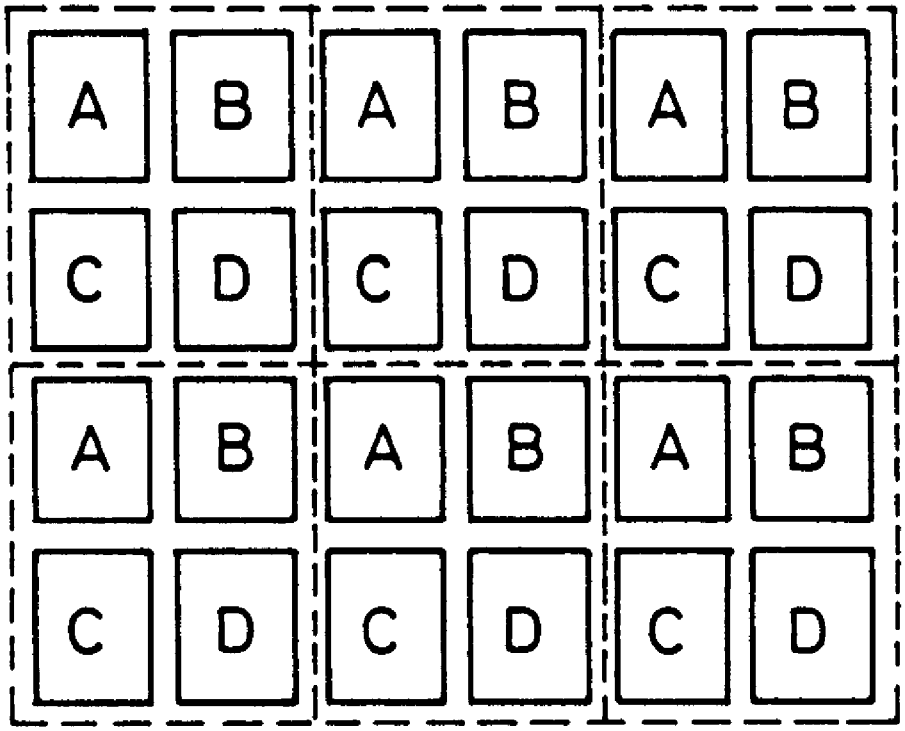
FIG. 40 is a diagram showing the correspondence among the block comprising four discharge cells and the light emitting modes A to D.

In FIG. 43, a first data converting circuit 441, a second data converting circuit 442, a third data converting circuit 443, and a fourth data converting circuit 444 convert the pixel data of 8 bits into 5-bit conversion pixel data A to D, respectively, in accordance with a conversion table as shown in FIG. 44. In FIG. 44, it is assumed that bits 8 to 5 of the received pixel data become bits 5 to 2 of the conversion pixel data as they are. A selector 440 alternatively supplies any one of outputs from the first to fourth data converting circuits 441 to 444 to the memory 4 so as to obtain the conversion pixel data A to D in a format as shown in FIG. 40 for each discharge cell.

Figure 45:
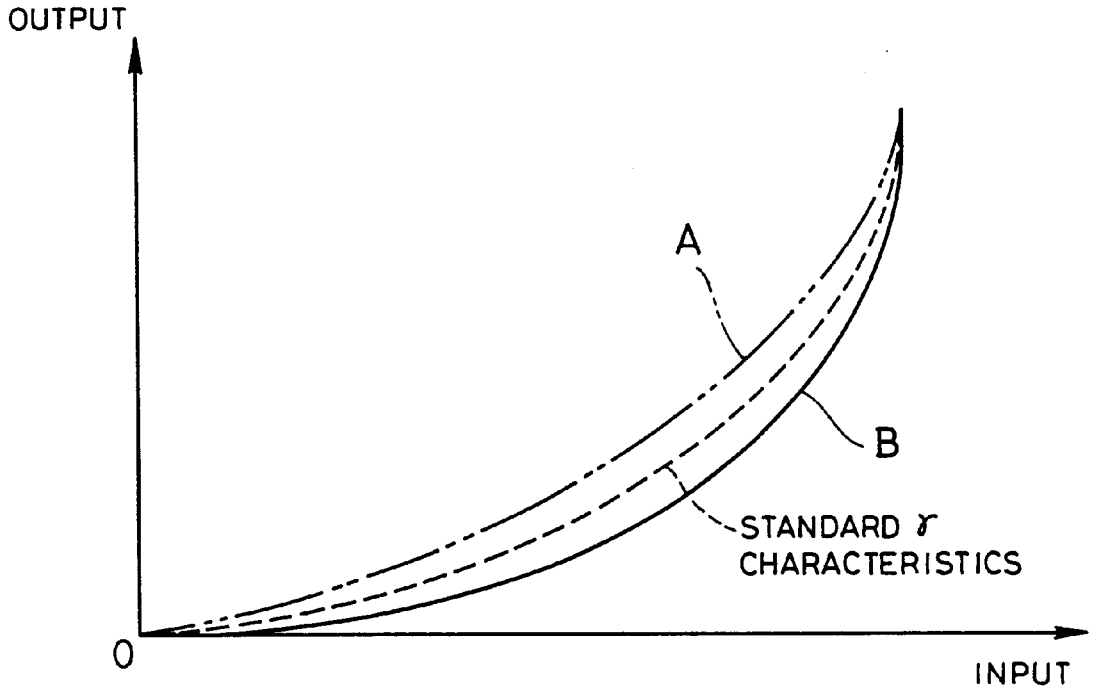
FIG. 45 is a diagram showing γ characteristics A and B which are used in a γ characteristics correcting circuit.

A γ correcting circuit having A characteristics shown by an alternate long and two short dashes line in FIG. 45 and a γ correcting circuit having B characteristics shown by a solid line in FIG. 45 can be also provided at the front stages of the first data converting circuit 31 and second data converting circuit 33 shown in FIG. 2. According to the γ correction, by modulating the pixel data every discharge cell so as to obtain the opposite characteristics in the horizontal, vertical, and time directions, the pixel data is corrected so that the average luminance level in the time direction becomes the inherent level. According to the γ correction, a strong bright line (dark line) which is caused when the luminance level of the pixel data is shifted from "63" to "64" or from "127" to "128" can be reduced.

Figure 46:
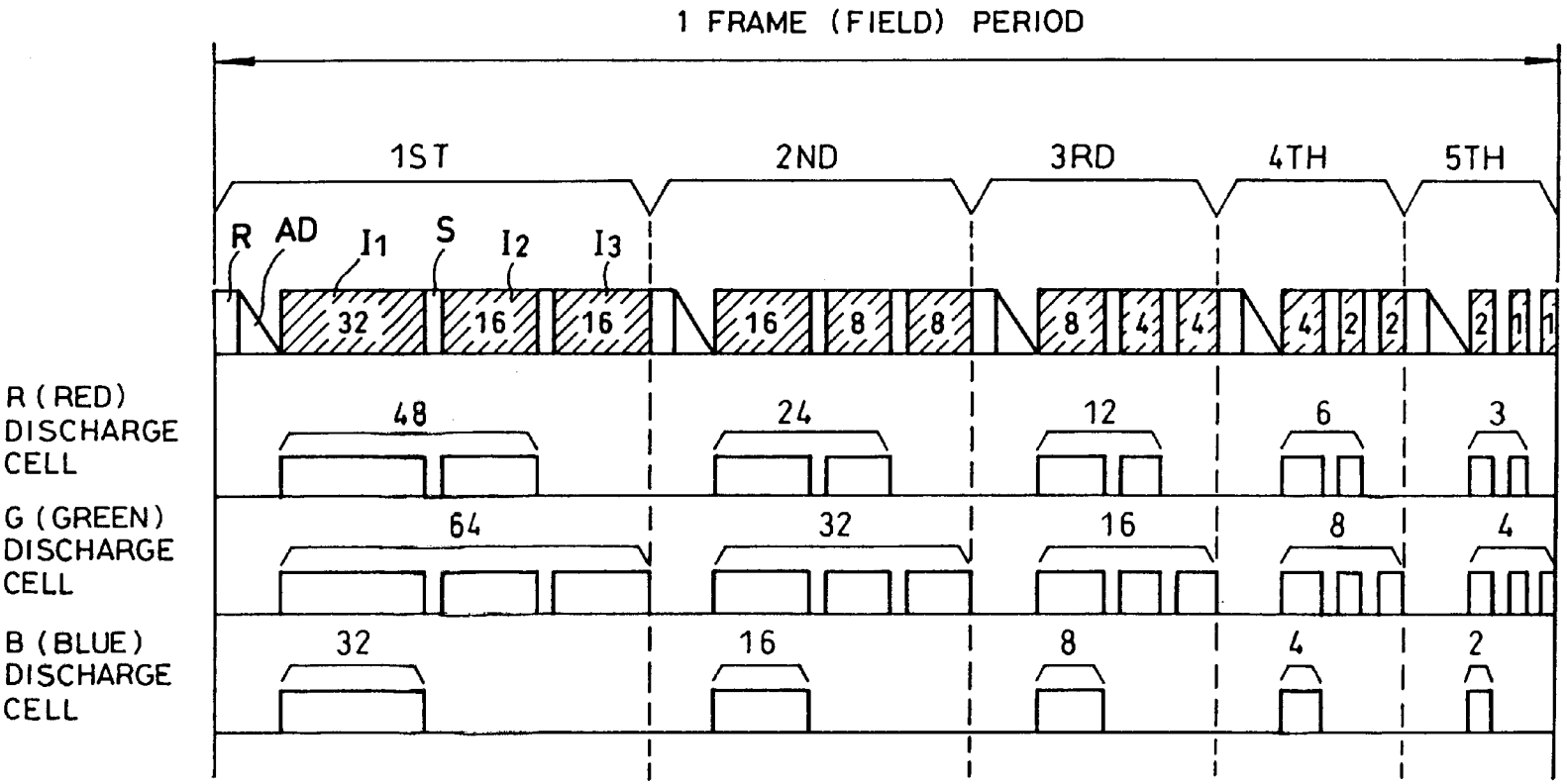
FIG. 46 is a diagram showing a light emission driving format in each of an R discharge cell, a G discharge cell, and a B discharge cell.

In the embodiment, although the same light emitting pattern is allocated to the pixel data corresponding to each of the R (red) component, G (green) component, and B (blue) component in the video signal, the light emitting period can be also changed every discharge cell corresponding to each color as shown in a driving format of FIG. 46.

According to the driving method shown in FIG. 46, the light emission driving of the PDP can be executed at a proper balance in which differences of the light emitting sensitivities of the discharge cells to perform the light emission of R (red), G (green), and B (blue) were corrected.

As data conversion tables which are used in the first data converting circuit 31 and second data converting circuit 33 shown in FIG. 2, data conversion tables shown in FIGS. 47 and 48 can be also used besides the data conversion tables shown in FIGS. 3, 4, 16, and 17.

In the embodiment, after the resetting operation was certainly once performed in the head portion of each divided period, the operation is shifted to the address operation. Even if the resetting operation is not performed in a partial divided period in one frame (field) period, however, the normal light emission can be performed.

Figure 49:
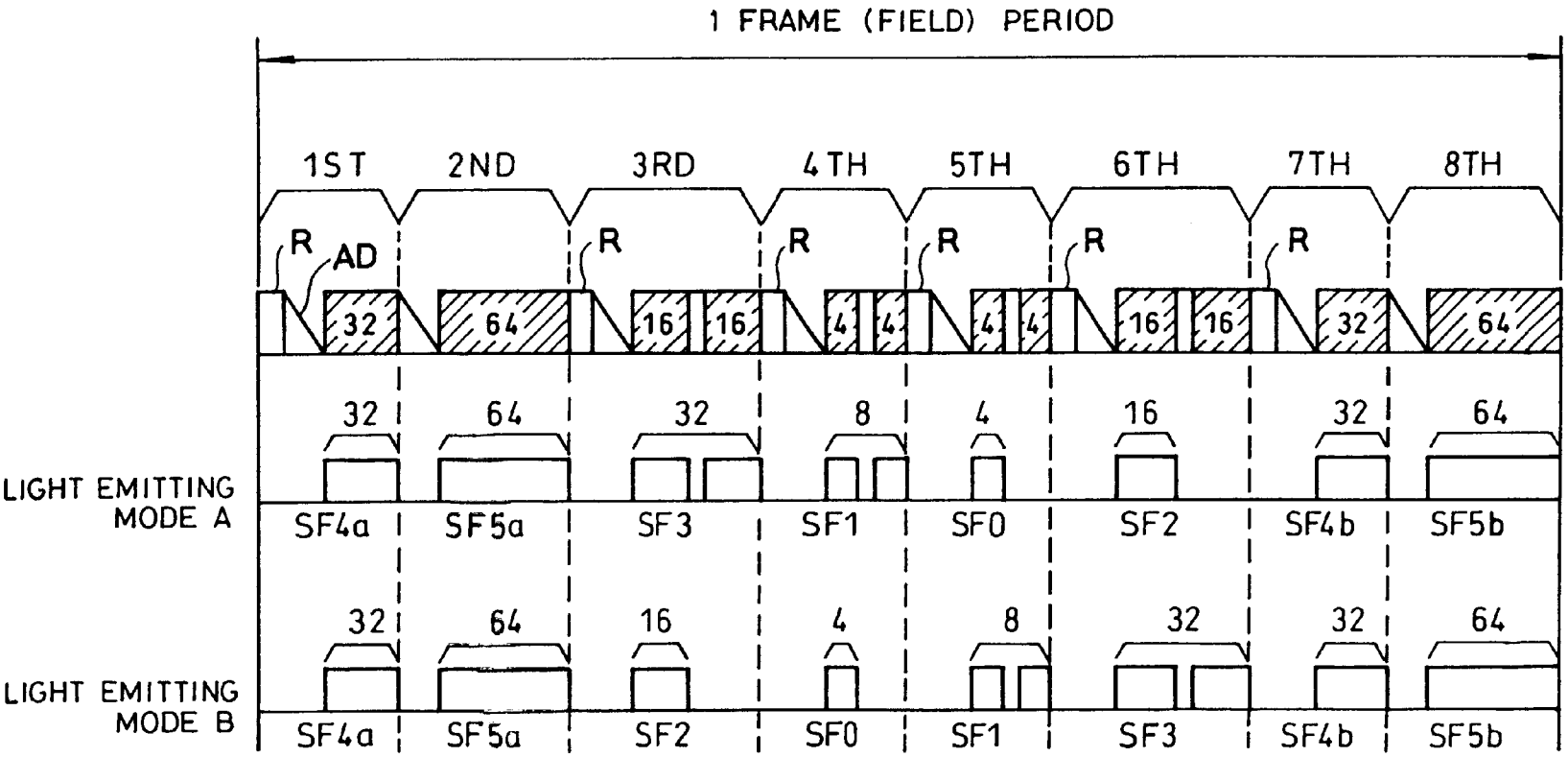
FIG. 49 is a diagram showing an example of a light emission driving format based on the half tone display method of the invention.

FIG. 49 is a diagram showing one example of a driving format made in consideration of the above point. FIGS. 50 and 51 are diagrams showing an example of data conversion tables which are used in each of the first data converting circuit 31 and second data converting circuit 33 when the driving of the PDP is executed by the driving format.

In FIG. 49, the 8-bit pixel data is converted into 6-bit data by the dither process or the like, a subframe (subfield) SF of a long light emitting period corresponding to each of upper two bits is divided into two subframes (subfields) (namely, SF5→SF5*a* and SF5*b*; further, SF4→SF4*a* and SF4*b*) as shown in FIG. 16, and the order of the subframes is exchanged every discharge cell.

In this instance, as shown in FIG. 49, no reset period is provided in each of the second and eighth divided periods shown in FIG. 49.

That is, since the discharge cell which is selected as a light-on discharge cell in the address period of SF5*a* or SF5*b* is also certainly selected as a light-on discharge cell in SF4*a* or SF4*b*, the wall charges remaining in SFf*a* or SFf*b* can be left as they are without resetting.

According to this construction, since the number of times of the resetting operation which is executed for one frame (field) period is reduced from 8 to 6, the contrast of the image can be improved.

When the 8-bit pixel data is converted to 6-bit data by the dither process or the like and the light emission driving is executed in eight divided periods as mentioned above by using the 6-bit data, a weight of each divided light emitting period can be also set so as to reduce the number of inversion bits which are caused due to a carry of the bits.

Figure 52:
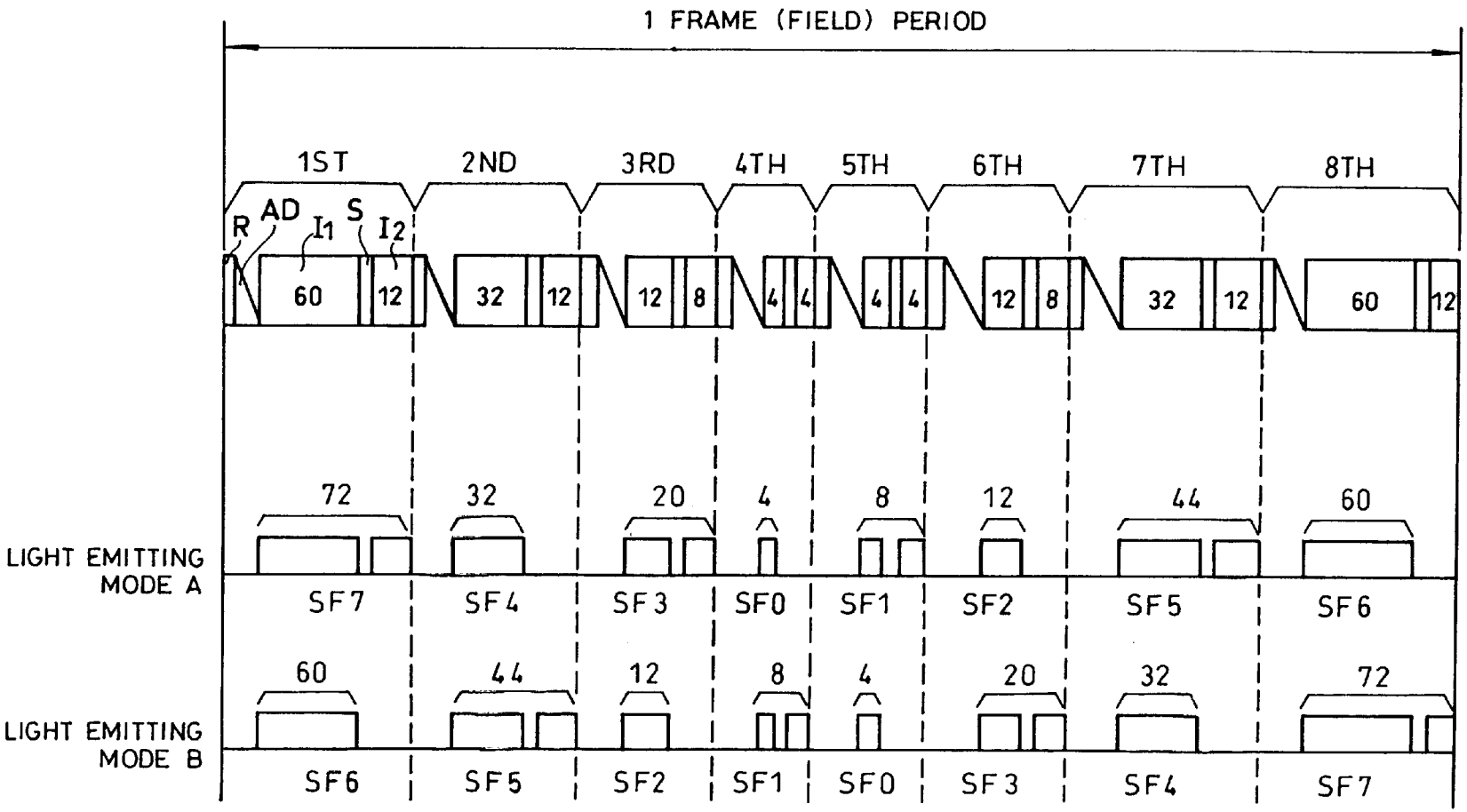
FIG. 52 is a diagram showing an example of the light emission driving format based on the half tone display method of the invention.

FIG. 52 is a diagram showing an example of a driving format made in consideration of the above point. FIGS. 53 and 54 are diagrams showing an example of data conversion tables which are used in each of the first and second data converting circuits 31 and 33 when the driving of the PDP is executed by the driving format.

In the light emission in the light emitting mode A, the period ratio of the light emission which is executed in each divided period is as follows.

First divided period:72
Second divided period:32
Third divided period:20
Fourth divided period:4
Fifth divided period:8
Sixth divided period:12
Seventh divided period:44
Eighth divided period:60

In the light emission in the light emitting mode B, the period ratio is as follows.

First divided period:60
Second divided period:44
Third divided period:12
Fourth divided period:8
Fifth divided period:4
Sixth divided period:20
Seventh divided period:32
Eighth divided period:72

In FIG. 46, although the operation example such that the light emitting periods are changed every discharge cell to perform the light emission of R, G, and B has been shown, it is also possible to combine a technique such that a plurality of different light emitting patterns are allocated every discharge cell or every plurality of adjacent discharge cells as shown in FIGS. 6, 16, and 25 to 31 to the above operation example.

Figure 55:
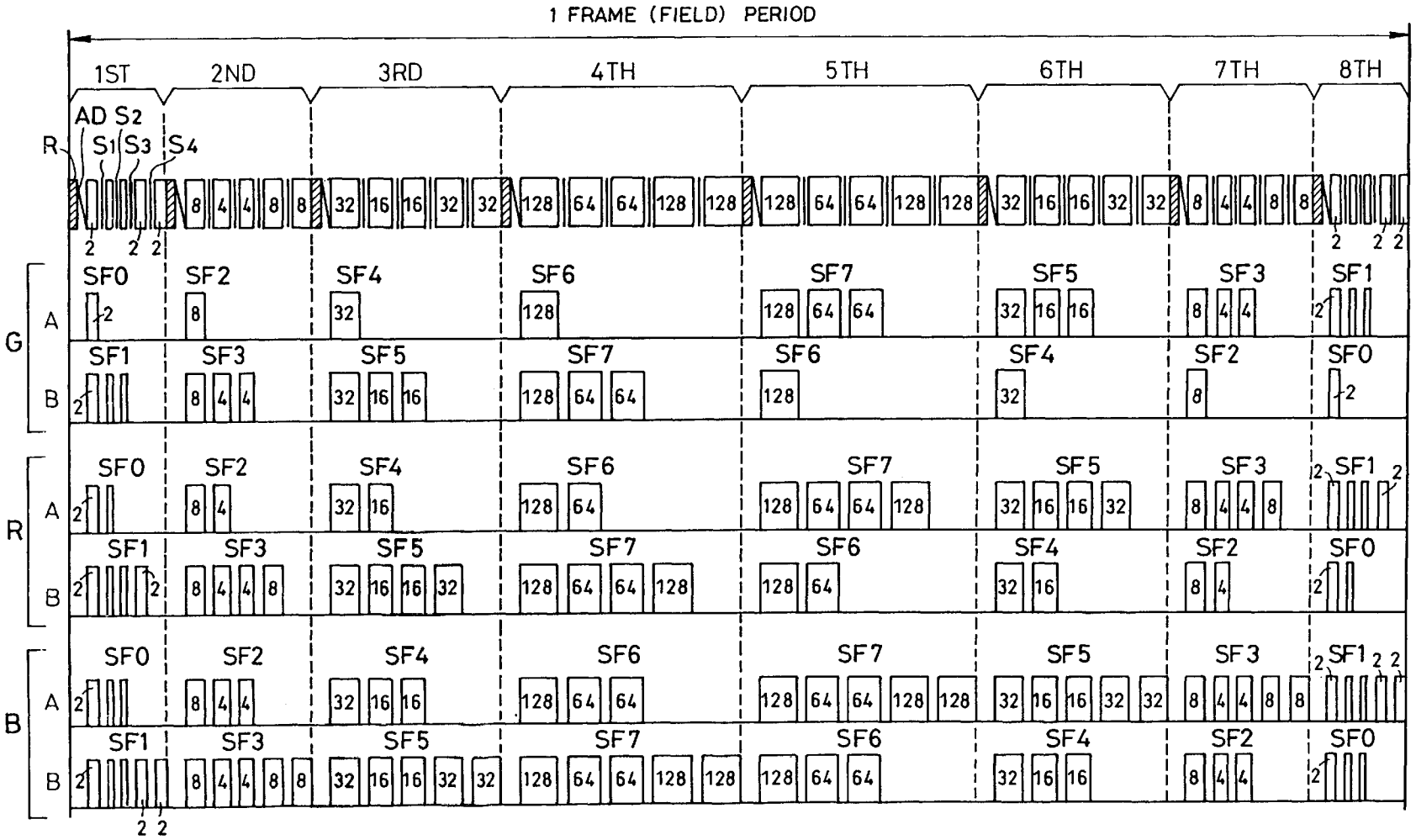
FIG. 55 is a diagram showing an example of a light emission driving format in each discharge cell corresponding to each of R, G, and B.

FIG. 55 is a diagram showing an example of a driving format made in consideration of the above point.

In FIG. 55, one frame (field) period is divided into eight divided periods comprising the first to eighth divided periods. In each divided period, the resetting operation R, address operation AD, and selective erasing operation $S_1$ to $S_4$ as mentioned above are executed. By the selective erasing operations $S_1$ to $S_4$, the sustain discharging operation is divided into five operations as shown in FIG. 55.

According to the driving format shown in FIG. 55, a control is made so that the ratio of the maximum light emission luminance for the discharge cells to perform the light emission of each of G (green), R (red), and B (blue) is as follows.

Discharge cell to perform the light emission of G (green): 512

Discharge cell to perform the light emission of R (red): 765

Discharge cell to perform the light emission of B (blue): 1020

Further, as shown in FIG. 55, two different light emitting patterns (light emitting modes A and B) are allocated every discharge cell corresponding to each of G (green), R (red), and B (blue) and the light emission in the light emitting modes A and B is executed in the form shown in, for example, FIG. 20 mentioned above.

According to the invention as described in detail above, the display order of the divided periods (subfields) is exchanged every discharge cell or every discharge cell block in which a plurality of adjacent discharge cells are combined.

An effect such that the bright line or dark line (pseudo outline) which is caused at the time of a specific gradation change (when a flat image moves and its gradation level transverses a boundary of $2^n$) is apparently set off as bright and dark patterns on every other discharge cell or every other discharge cell block is improved. A flickering or a pseudo outline can be sufficiently suppressed.

What is claimed is:

1. A half-tone display method of a display panel, in which when a display panel having a plurality of row electrodes arranged in a horizontal direction in correspondence with display lines and a plurality of column electrodes which are arranged in a vertical direction that crosses said row electrodes and form discharge cells at crossing points is light emission driven, a unit display period is divided into a plurality of divided periods and light emitting periods of said discharge cells which are executed in each of said divided periods are made different, thereby performing a half-tone display, wherein a plurality of light emitting modes, in which the order of said divided periods in said unit display period is made different between adjoining discharge cells or cell blocks in which a plurality of adjacent discharge cells that form one set, are switched for execution, and wherein upper bits of each of dither addition pixel data obtained by adding different dither coefficients to pixel data corresponding to said plurality of discharge cells which are adjacent each other or said discharge cell block in which a plurality of adjacent discharge cells form one set are set to dither processing pixel data, and a predetermined half tone display level is set by a combination of said plurality of discharge cells or said discharge cell block.

2. A method according to claim 1, wherein any one of said light emitting modes is selected every said discharge cells arranged in said horizontal direction or every said discharge cell block in which a plurality of adjacent discharge cells form one set.

3. A method according to claim 1, wherein one light emitting mode among said plurality of light emitting modes and another light emitting mode different from said one light emitting mode are switched so as to be executed in a zigzag manner on said display panel every said discharge cells or every said discharge cell block in which a plurality of adjacent discharge cells form one set.

4. A method according to claim 1, wherein said light emitting modes corresponding to every said discharge cells or every said discharge cell block in which a plurality of adjacent discharge cells form one set are changed every said unit display period.

5. A method according to claim 1, wherein said dither coefficients are changed every said unit display period.

6. A method according to claim 1, wherein each of said divided periods includes: a reset period for forming wall charges in all of the discharge cells of said display panel; and an address period for selectively erasing said wall charges formed in each of said discharge cells in accordance with pixel data and obtaining light-up discharge cells and light off discharge cells.

7. A method according to claim 1, wherein at least one of said divided periods includes: a reset period for discharge light emitting all of the discharge cells of said display panel and erasing the wall charges; and an address period for forming wall charges according to pixel data in each of said discharge cells and obtaining light-up discharge cells and light-off discharge cells.

8. A method according to claim 1, wherein one pixel in said display panel is formed by three said discharge cells corresponding to three light emitting colors of red, green, and blue, and said light emitting modes are controlled in a lump on said pixel unit basis.

9. method according to claim 1, wherein one pixel in said display panel is formed by three said discharge cells corresponding to three light emitting colors of red, green, and blue, and said light emitting modes are independently controlled on said discharge cell unit basis.

10. A half-tone display method of a display panel, in which when a display panel having a plurality of row electrodes arranged in a horizontal direction in correspondence with display lines and a plurality of column electrodes which are arranged in a vertical direction that crosses said row electrodes and form discharge cells at crossing points is light emission driven, a unit display period is divided into a plurality of divided periods and light emitting periods of said discharge cells which are executed in each of said divided periods are made different, thereby performing a half-tone display, wherein a plurality of light emitting modes, in which the order of said divided periods in said unit display period is made different between adjoining discharge cells or cell blocks in which a plurality of adjacent discharge cells that form one set, are switched for execution, and wherein a divided period having said predetermined light emitting period among said divided periods is further divided into a plurality of divided periods, thereby obtaining divided light emitting periods, a plurality of light emitting patterns are prepared in which total light emitting periods in said unit display period are the same and selecting orders of said divided light emitting periods whose light emitting periods are equal to or approximate to each other are different, and any one of said plurality of light emitting patterns is selected every said discharge cells arranged in said horizontal direction or every said discharge cell block.

11. A half-tone display method of a display panel having a plurality of row electrodes arranged in a horizontal direction in correspondence to display lines and a plurality of column electrodes which are arranged in a vertical direction that crosses said row electrodes and form discharge cells at crossing points, in which a unit display period is constructed by a plurality of divided periods each of which includes an address period for obtaining light-on discharge cells and light-off discharge cells by performing an address scan according to pixel data and a sustain discharge period for sustaining a discharge light emitting state of said light-on discharge cells for only a predetermined light emitting period by a discharge sustain pulse and a gradation display is performed by making weights of said light emitting periods in each of said divided periods different, wherein said sustain discharge period in at least one said divided period in said unit display period is separated into a plurality of divided sustain discharge periods and a selective erasing period to select a light-off discharge cell in said second and subsequent divided sustain discharge periods is provided just before each of said second and subsequent divided sustain discharge periods, thereby enabling different light emitting periods to be set every said discharge cells or every said discharge cell block in which a plurality of adjacent discharge cells form one set in said divided period, and wherein said plurality of row electrodes are divided into first and second row electrode groups and said plurality of column electrodes are divided into first and second column electrode groups, and said selective erasing period comprises:

a period for supplying an erasing pulse to said first row electrode group in a lump and supplying a first selecting pulse to said first column electrode group synchronously with said erasing pulse, thereby obtaining non-discharge cells; and a period for supplying the erasing pulse to said second row electrode group in a lump and supplying a second selecting pulse to said second column electrode group synchronously with said erasing pulse, thereby obtaining non-discharge cells.

12. A method according to claim 11, wherein in said address period, the number of times of light emission of different weights is set by said address scan of one time every said discharge cells or every said discharge cell block in which a plurality of adjacent discharge cells form one set.

13. A method according to claim 11, wherein said first row electrode group is odd number designated row electrodes in said display panel, said first column electrode group is odd number designated column electrodes in said display panel, said second row electrode group is even number designated row electrodes in said display panel, and said second column electrode group is even number designated column electrodes in said display panel.

14. A method according to claim 11, wherein by setting the number of times of light emission of different weights every said discharge cell or every said discharge cell block in which a plurality of adjacent discharge cells form one set in at least one of said divided periods, a plurality of light emitting modes in which display orders of said divided periods in said unit display period are different are prepared, and any one of said plurality of light emitting modes is selected every said discharge cell or every said discharge cell block.

15. A method according to claim 14, wherein one pixel unit in said display panel is formed by three said discharge cells corresponding to three light emitting colors of red, green, and blue, and said light emitting modes are controlled in a lump on a pixel unit basis.

16. A method according to claim 14, wherein one pixel in said display panel is formed by three said discharge cells corresponding to three light emitting colors of red, green, and blue, and said light emitting modes are independently controlled on a discharge cell unit basis.

17. A method according to claim 11, wherein by allocating the divided period having different light emitting periods to each of the discharge cells in the discharge cell block in which a plurality of adjacent discharge cells form one set and adding the light emitting periods of each discharge cell in each block, a half tone display level corresponding to one pixel data is obtained.

18. A method according to claim 11, wherein upper bits of each of dither addition pixel data obtained by adding different dither coefficients to the pixel data corresponding to each of said plurality of adjacent discharge cells or said discharge cell block in which a plurality of adjacent discharge cells form one set are used as dither processing pixel data, and a predetermined half tone display level is obtained by a combination of said plurality of discharge cells or said discharge cell block.

19. A method according to claim 18, wherein said dither coefficients are changed every said unit display period.

20. A method according to claims 11, wherein the light emitting periods in each of said divided periods for said discharge cell or said discharge cell bock in which a plurality of adjacent discharge cells form one set are changed every said unit display period.

21. A method according to claim 11, wherein the divided period having a predetermined light emitting period in each of said divided periods is further divided into a plurality of periods, thereby obtaining divided light emitting periods, a plurality of light emitting patterns in which total light emitting periods in said unit display period are the same and selecting orders of said divided light emitting periods in that the light emitting periods are equal or approximate are different are prepared, and any one of said plurality of light emitting patterns is selected every said discharge cells arranged in said horizontal direction or every said discharge cell block.

22. A method according to claim 11, wherein each of said divided periods includes a reset period for forming wall charges in all of the discharge cells of said display panel; and an address period for selectively erasing wall charges formed in each of said discharge cells in accordance with pixel data and obtaining light-on discharge cells and light-off discharge cells.

23. A method according to claims 11, wherein at least one of said divided periods includes a reset period for discharge light emitting all of the discharge cells of said display panel and erasing wall charges; and an address period for forming wall charges according to pixel data into each of said discharge cells and obtaining light-on discharge cells and light-off discharge cell.

24. A method according to claim 11, wherein when a discharge cell block in which a plurality of adjacent discharge cells form one set is formed for a predetermined designated whole half tone display level and the light emitting periods of each of the discharge cells in said discharge cell block are added and said predetermined designated whole half tone display level is displayed, light emitting periods of different lengths are set every discharge cell in said discharge cell block in at least one of said divided periods so that partial half tone display levels in each of said discharge cells are made different.

25. A method according to claim 11, wherein one pixel in said display panel is formed by three said discharge cells corresponding to three light emitting colors of red, green, and blue, and the number of times of light emission which is executed in said unit display period is independently controlled on a discharge cell unit basis corresponding to each of said three light emitting colors.

26. A method according to claim 25, wherein light emitting patterns which are executed in said unit display period are changed every said discharge cell corresponding to each of said three light emitting colors or every said discharge cell block comprising said plurality of adjacent discharge cells.

27. A half-tone display method of a display panel having a plurality of row electrodes arranged in a horizontal direction in correspondence to display lines and a plurality of column electrodes which are arranged in a vertical direction that crosses said row electrodes and form discharge cells at crossing points, in which a unit display period is constructed by a plurality of divided periods each of which includes an address period for obtaining light-on discharge cells and light-off discharge cells by performing an address scan according to pixel data and a sustain discharge period for sustaining a discharge light emitting state of said light-on discharge cells for only a predetermined light emitting period by a discharge sustain pulse and a gradation display is performed by making weights of said light emitting periods in each of said divided periods different, wherein said sustain discharge period in at least one said divided period in said unit display period is separated into a plurality of divided sustain discharge periods and a selective erasing period to select a light-off discharge cell in said second and subsequent divided sustain discharge periods is provided just before each of said second and subsequent divided sustain discharge periods, thereby enabling different light emitting periods to be set every said discharge cells or every said discharge cell block in which a plurality of adjacent discharge cells form one set in said divided period, and wherein said plurality of row electrodes are divided into first and second row electrode groups and said plurality of column electrodes are divided into first and second column electrode groups, and said selective erasing period comprises:

an all erasing period for supplying an erasing pulse to said first and second row electrode groups in a lump and at once setting all of the discharge cells into a light-off state;

a first selective writing period for supplying a writing pulse to said first row electrode group in a lump and supplying a first selecting pulse to said first column electrode group synchronously with said writing pulse, thereby forming light-on discharge cells; and a second selective writing period for supplying the writing pulse to said second row electrode group in a lump and supplying a second selecting pulse to said second column electrode group synchronously with said writing pulse, thereby forming light-on discharge cells.

28. A method according to claim 27, wherein said first row electrode group is odd number designated row electrodes in said display panel, said first column electrode group is odd number designated column electrodes in said display panel, said second row electrode group is even number designated row electrodes in said display panel, and said second column electrode group is even number designated column electrodes in said display panel.

* * * * *